US010583943B2

(12) United States Patent
Feijen et al.

(10) Patent No.: US 10,583,943 B2
(45) Date of Patent: Mar. 10, 2020

(54) METHOD AND SYSTEM FOR AUTOMATICALLY PROCESSING BLANKS FOR PACKAGING BOXES

(71) Applicant: Neopost Technologies, Bagneux (FR)

(72) Inventors: Fransiscus Hermannus Feijen, Leeuwarden (NL); Herman Sytema, Terhorne (NL)

(73) Assignee: NEOPOST TECHNOLOGIES, Bagneux (FR)

( * ) Notice: Subject to any disclaimer, the term of this patent is extended or adjusted under 35 U.S.C. 154(b) by 838 days.

(21) Appl. No.: 14/764,398

(22) PCT Filed: Jan. 29, 2013

(86) PCT No.: PCT/EP2013/051687

§ 371 (c)(1),
(2) Date: Jul. 29, 2015

(87) PCT Pub. No.: WO2014/117816

PCT Pub. Date: Aug. 7, 2014

(65) Prior Publication Data

US 2015/0360433 A1 Dec. 17, 2015

(51) Int. Cl.
*B65B 5/02* (2006.01)
*B65D 5/66* (2006.01)
(Continued)

(52) U.S. Cl.
CPC ..... *B65B 5/02* (2013.01); *B31B 50/74* (2017.08); *B65B 5/024* (2013.01); *B65D 5/6664* (2013.01);
(Continued)

(58) Field of Classification Search
CPC ..... B65B 2/024
(Continued)

(56) References Cited

U.S. PATENT DOCUMENTS 1,772,785 A 8/1930 Smith
3,745,864 A 7/1973 Watson
(Continued)

FOREIGN PATENT DOCUMENTS

DE 445 179 C 6/1927
EP 0 456 156 A1 11/1991
(Continued)

OTHER PUBLICATIONS

International Search Report dated May 28, 2014 for corresponding International Application No. PCT/EP2013/051687, 5 pages.
(Continued)

*Primary Examiner* — Chelsea E Stinson
(74) *Attorney, Agent, or Firm* — Cozen O'Connor

(57) ABSTRACT

Method and system for automatically processing blanks for forming packaging boxes. By means of a feeding conveyor blank material is fed in a feeding direction from a storage of blank material to a single blank cutting station comprising a blank forming apparatus for cutting and creasing blank material into a blank. By means of said blank forming apparatus a blank is formed having a rectangular bottom panel and rectangular corner, side and end panels. Cutting and creasing blank material into the blank is performed during feeding of said blank material in feeding direction through the blank forming apparatus.

11 Claims, 36 Drawing Sheets

(51) Int. Cl.

| | |
|---|---|
| ***B31B 50/74*** | (2017.01) |
| *B31B 50/52* | (2017.01) |
| *B31B 50/25* | (2017.01) |
| *B31B 50/16* | (2017.01) |

(52) U.S. Cl.
CPC ..... *B31B 50/16* (2017.08); *B31B 50/256* (2017.08); *B31B 50/52* (2017.08); *B65B 2210/04* (2013.01)

(58) Field of Classification Search
USPC ..... 493/59
See application file for complete search history.

(56) References Cited

U.S. PATENT DOCUMENTS

| | | | | |
|---|---|---|---|---|
| 3,844,201 | A | 10/1974 | Eggert et al. | |
| 6,170,231 | B1 * | 1/2001 | Detterman | B65B 5/024 53/207 |
| 8,282,537 | B2 * | 10/2012 | Gebhardt | B31B 1/48 493/136 |
| 2008/0020916 | A1 * | 1/2008 | Magnell | B65B 5/02 493/65 |
| 2012/0100976 | A1 * | 4/2012 | Graham | B31B 50/00 493/52 |
| 2013/0045849 | A1 * | 2/2013 | Infanger | B31F 1/0025 493/357 |

FOREIGN PATENT DOCUMENTS

| | | | |
|---|---|---|---|
| EP | 0 983 940 | B1 | 3/2004 |
| GB | 672428 | A | 5/1952 |
| GB | 1083889 | A | 9/1967 |

OTHER PUBLICATIONS

Communication pursuant to Rule 114(2) EPC, dated Apr. 4, 2017, for European Application No. 13702026.9-1708 / 2951010, 4 pages.

* cited by examiner

METHOD AND SYSTEM FOR AUTOMATICALLY PROCESSING BLANKS FOR PACKAGING BOXES

BACKGROUND

Technical Field

The invention relates to a method for automatically processing blanks for packaging boxes.

Description of the Related Art

Such a method is known from U.S. Pat. No. 6,170,231B1. This known method relates to wrap-around packaging wherein discrete articles, such as books, are deposited upon carton blanks which are wrapped about the articles to surround all sides of the articles. Articles of different sizes such as different pack sizes of books, are wrapped with a carton formed from a blank in a continuous manner in which a standard size blank is partly custom trimmed in a first cutting station and after transport to a second cutting station is cut to a size related to the pack size and wherein slotting and scoring means are adjusted to form the blank so that it wraps neatly about the book packs. Information on sizing from previous orders of book packs is stored and used by a controller to produce a pre-sized and pre-formed flat blank which is identical to the said previous orders. At a wrap-around station, the book packs are seated on a bottom panel of the flat customized blank, and the book packs and the blank are pushed downward forcing the carton blank through former guides to turn up end and side flaps. Next, the book packs and the partially erected box are fed horizontally to a former station where a top panel is bent over the book packs and the wrap-around packaging is finally finished by, e.g., wrapping tape around the carton. Although the controller operates automatically it is the operator of the apparatus who identifies the pack size for the books and thus the operation of the apparatus is prone to human error. With the increasing availability of merchandise, products and other items through on-line retailers recent years have shown an ever increasing purchasing behavior of customers leading to an increase in parcel sending and leading to a need for packaging a huge variety of products of all kinds of shapes with a large capacity without human intervention. In particular due to the relatively long time needed for cutting a blank to size the capacity of the known method is relatively low.

BRIEF SUMMARY

It is therefore an object of the invention to provide a method for automatically processing blanks for packaging boxes in which a large variety of products and articles of all kinds of shapes can be packaged without human intervention, in which method blanks can be processed with a high industrial capacity.

The above objects are achieved in accordance with the invention by providing a method for automatically processing blanks for forming packaging boxes according to claim 1. Since according to the invention only one blank cutting station is necessary for cutting the blank to size the production capacity can be increased. Furthermore, since the transport of the blank material does not need to be stopped for cutting and cutting is performed during feeding of the blank material the capacity can be even further increased.

In particular the cutting-out device is configured to be displaceable in a direction opposite the feeding direction from the active position to the inactive position at a higher speed than the feeding speed of the blank material. Please note that since the cutting is performed during feeding of the blank material the inactive and active position are not stationary positions.

In a further embodiment of a method according to the invention the method is used in a method for automatically forming a packaging box from said blank and packaging at least one article in said packaging box, wherein the method comprises the steps of

- measuring the length, width and height dimensions of the at least one article, and
- adjusting the transverse distance between the pair of longitudinal score line applicators and the transverse distance between the longitudinal cutters based on the dimensions of the at least one article. The method then preferably comprises the steps of:
- providing at least four folding units at a supporting station, wherein the at least four folding units comprise a front pair of folding units and a rear pair of folding units positioned at a longitudinal distance from the front pair of folding units, wherein the folding units of the front pair are positioned at a transverse distance from each other, and wherein the folding units of the rear pair are positioned at a transverse distance from each other;
- placing a blank formed by said blank forming apparatus onto the at least four folding units such that the folding units support the rectangular bottom panel;
- wherein at least one, preferably at least two and more preferred all of the at least four folding units is/are provided with a controllable gripping element for gripping the bottom panel, wherein said controllable gripping element is activated into an operative mode gripping the bottom panel and is deactivated for releasing the bottom panel; and
- wherein the at least one of the folding units is configured for Folding respective side and/or end panels of the blank upwardly. In this manner by using the inventive method a packaging box can be created and folded in a relatively short period of time. It is then in particular advantageous when the method comprises the step of packaging at least one article in a packaging box, preferably simultaneously with the formation of said packaging box, said method comprising the steps of:
- conveying, preferably horizontally conveying said at least one article by means of an input conveyor in a conveying direction;
- said at least one article having overall length, width and height dimensions;
- by means of the blank forming apparatus cutting and creasing blank material into a custom sized blank based on the length, width and height dimensions;
- providing at least four folding units at a supporting station downstream of the conveyor in conveying direction;
- feeding the custom sized blank into the supporting station and feeding the custom sized blank onto the at least four folding units such that the folding units support the rectangular bottom panel;
- conveying the at least one article, preferably in horizontal direction, onto the bottom panel supported by the folding units;
- displacing the at least four folding units supporting the custom sized blank and the at least one article supported on the rectangular bottom panel thereof in conveying direction towards a sealing station and during said displacement of the folding units folding side and end panels of the Custom sized blank upwardly;

sealing the packaging box at the sealing station, preferably by means of a seal applicator apparatus of the sealing station; and optionally discharging the packaging box with the at least one article by means of a discharge conveyor;

wherein the at least four folding units comprise a front pair of folding units and a rear pair of folding units positioned upstream at a longitudinal distance from the front pair of folding units seen in conveying direction, wherein the folding units of the front pair are positioned at a transverse distance from each other, and wherein the folding units of the rear pair are positioned at a transverse distance from each other; and wherein the method comprises the step of adjusting said longitudinal distance and/or said transverse distances based on the length and width dimensions, respectively. By using the length, width and height dimensions of said at least one article for cutting and creasing blank material into a custom sized blank the method according to the invention can be performed automatically and thus an action performed by a human operator for identifying the size of a blank for a box for packaging the articles, which human action is inherently prone to error, is redundant. In addition it is possible to form a custom sized blank of any size based on the dimensions, so that the inventive method is not restricted to choose from blank sizes previously used. Furthermore, since during displacement of the folding units supporting the custom sized blank the blank is folded it is possible to reduce the cycle time which can lead to an increased packaging capacity. In addition, since the blank is formed by folding the panels upwards for forming the packaging box the forces exerted on the articles to be packed during folding are minimal as a result of which it is also possible to pack delicate or low weight products since the bottom panel is held by the gripping elements.

In an embodiment of a method according to the invention the method comprises the step of providing an input conveyor comprising a number of input sub-conveyors positioned consecutively in conveying direction. Preferably, the method comprises the step of driving each of the input sub-conveyors independently of one another. By using a number of input sub-conveyors it is possible to convey several sets of articles, each set destined to be packaged into one custom sized box, one after the other without interference and with an increase in packaging capacity. In case the input sub-conveyors are driven independently of one another it is possible to create buffers in dependence of the downstream processing speed.

The operation of the method according to the invention can be checked when the method comprises the step of determining the number of articles present on at least one of the input sub-conveyors. Alternatively or additionally the method comprises the step of determining at which of the input sub-conveyors the at least one article is present during any given moment during conveying. In this manner it is possible to keep track of the progress of the articles during the operation of forming packaging boxes around the articles and by comparing the number of articles as determined to be present on a specific input sub-conveyor at a given moment with the expected number and position of articles it is possible to check whether the progress takes place correctly. In a preferred embodiment of a method according to the invention the method then comprises the step providing an alarm signal in case the number of articles determined to be present on said specific input sub-conveyor differs from the number of said at least one article which is expected to be present thereon. Such an alarm signal can be used to automatically solve the detected discrepancy or can be used to notify a human operator that an inspection is necessary.

According to a further embodiment of a method according to the invention a transfer strip is provided adjacent to the downstream end of the input conveyor or the last input sub-conveyor. It is then preferred that the method comprises the step of stopping the conveying of said at least one article by means of the last downstream input sub-conveyor. Temporarily stopping the conveyance of the articles can in some cases be necessary to properly time the conveyance of the articles with the feeding of the custom sized blank, so that a correct positioning of the articles on the bottom panel can be obtained.

In a still further embodiment of a method according to the invention a step of measuring the overall length, width and height dimensions of said at least one article by a measuring device is included, in which preferably the step of measuring the length, width and height dimensions of said at least one article by means of said measuring device is performed, preferably during conveying of said at least one article by the input conveyor. In this manner the time needed to automatically form packaging boxes can be decreased leading to a larger operating capacity. In alternative embodiments the overall dimensions can be provided via automatic identification of the article(s) through for example barcode scanning, RFID detection, image recognition and/or looking up the dimensions in databases or even by operator input, e.g., when handling many small batches of equally sized articles.

In an advantageous embodiment of a method according to the invention the step of cutting and creasing blank material into a custom sized blank having a bottom panel based on the dimensions is performed during feeding of said blank material in feeding direction. In this manner the time needed to automatically form closed packaging boxes can be decreased leading to a larger operating capacity.

In a further embodiment of a method according to the invention the conveying direction of said at least one article is at least substantially parallel to the feeding direction of the blank material at the moment the at least one article is conveyed in horizontal direction onto the bottom panel supported by the folding units. In this manner no transverse forces are exerted on the articles when they are placed on the bottom panel, which transverse forces could lead to unintended tumbling or displacement of the articles and thus the positioning of the articles on the bottom panel can be performed in a correct manner. Preferably, the method then comprises the step of providing the blank forming apparatus in a position below the input conveyor. In this manner an apparatus for performing the inventive method can be constructed in a relatively simple manner. It is then preferred that the step of feeding the bottom panel into the supporting station comprises feeding the blank material upwards via a (shallow) S-bend from the blank forming apparatus into the supporting station so that the conveying direction of the items and the feeding direction of the blank material at least substantially coincide at the level of the input conveyor.

Forming packaging boxes and packaging items therein can be performed in a relatively easy manner when the step of feeding the bottom panel into the supporting station is performed such that a center line of the bottom panel in conveying direction is centered between the folding units of the front and rear pair and/or when the step of conveying said at least one article from the input conveyor onto the bottom panel of the custom sized blank is performed such that a leading end of the at least one article positioned against the leading transverse folding line of the bottom panel.

In yet a further embodiment of a method according to the invention the method comprises the step of activating the blank forming apparatus for cutting and creasing blank material into a custom sized blank when said at least one article is present on the last input sub-conveyor. It is then preferred to activate the blank forming apparatus only when the number of articles as determined to be present on the last input sub-conveyor equals the expected number of said at least one article, i.e., the number of articles belonging to the order to be processed. In addition it is possible to use the total weight or the identification of the articles (e.g., by scanning a (bar) code, RFID as a parameter for activating the blank forming apparatus. In this manner the custom sized blank is formed at a stage in which it is almost certain that the correct articles to be packaged are present on the last downstream input sub-conveyor and it can thus be prevented that unintended changes in the number or position of articles necessitate that an earlier formed blank has to be discarded, not only leading to unnecessary waste of material but also leading to an unnecessary decrease of operating capacity.

In an embodiment of a method according to the invention the method comprises the step of providing the blank forming apparatus with a pair of longitudinal score line applicators for applying longitudinal score lines as folding lines to the blank material between respective panels, a single transverse score line applicator for applying transverse score lines as folding lines between respective panels, a single transverse cutter for cutting the blank material to the length of the custom size blank and a single longitudinal cutter or a pair of longitudinal cutters for cutting the blank material to the width of the custom sized blank, wherein the transverse distance between the pair of longitudinal score line applicators and/or the transverse distance between the longitudinal cutters is adjusted based on the width and/or height dimension(s). It is then, in view of obtaining a high operating capacity, preferred, that the method comprises the step of moving the single transverse cutter along a line which is positioned at such an angle with respect to the feeding direction of the blank material that in combination with a feeding speed of the blank material and a speed of said cutter along said line a cutting line transverse to the feeding direction, i.e., perpendicular to the side edges of the blank material, is formed in the blank material. Such a cutter can be realized in the form of a displaceable rotating knife or a displaceable laser beam generator. Please note that in an alternative embodiment instead of a single transverse score line applicator two or more transverse score line applicators can be used for applying transverse score lines. In a further embodiment of a method according to the invention after the cutting line is made the upstream blank material is retracted and/or the cutter is lifted to allow the reverse movement of the transverse cutter.

In an advantageous embodiment of a method according to the invention by means of said blank forming apparatus a custom sized blank is formed having a rectangular bottom panel having a center line (centrally positioned between longitudinal folding lines) substantially parallel to the feeding direction, rectangular side panels and rectangular end panels joined to the bottom panel, rectangular corner panels joined to the end panels, a rectangular top panel joined to one of the end panels, rectangular top side panels joined to the top panel, a rectangular top end panel joined to the top panel and rectangular top corner panels joined to the top end panel, having score lines between the rectangular bottom panel, the rectangular side panels, the rectangular end panels and the rectangular top panel and having cut-outs in line with respective score lines between the corner panels and the adjoining side panels provided by a cutting-out device of the blank forming apparatus. A custom sized blank having such a constitution can be formed relatively simple and by a blank forming apparatus which is relatively simple of construction. The operating capacity can be increased further when the method comprises the step of configuring the cutting-out device comprising a pair of opposite cut-out knives to displace the cut-out knives from a inactive position to an active position synchronously with a feeding speed of the blank material in feeding direction and even further when the method comprises the step of configuring the cutting-out device to displace the cut-out knives from the active position to the inactive position at a higher speed than the feeding speed of the blank material in a direction opposite the feeding direction.

In a further embodiment of a method according to the invention after cutting and creasing blank material waste blank material is automatically discharged via a waste conveyor. The waste can alternatively fall directly into a waste container.

In a further embodiment of a method according to the invention in which the positioning of the articles on the bottom panel can be performed correctly in an easy manner said at least one article is positioned centrally on the input conveyor. Alternatively or additionally said blank material and said customized blank are positioned centrally on the feeding conveyor.

In a preferred embodiment of a method according to the invention the four folding units at a supporting station downstream of the conveyor in conveying direction are positioned relative to one another such that the four folding units of the front and rear pair are each positioned in a location in which they are able to support a respective corner of the rectangular bottom panel. In this manner it is possible to correctly support the bottom panel independent of the size of the bottom panel, while the folding elements on the folding units for folding side panels, end panels and corner panels can then be constructed in a relatively simple manner. Preferably, during adjusting the transverse distances between respective folding units the folding units are displaced symmetrically with regard to a central line between the folding units, and preferably the adjustment of the transverse distances between the front folding units and the rear folding units is performed synchronously. In this manner the device or apparatus for adjusting the relative distances between the folding units can be realized with a relatively simple construction.

Preferably the method comprises the step of activating the at least one gripping element into the operative mode before the step of folding respective side and/or end panels of said custom sized blank upwardly and the step of keeping the at least one gripping element in the operative mode at least until folding respective side and/or end panels of said custom sized blank upwardly has been completed. In this manner it can be guaranteed that during folding the bottom panel remains fixed on the folding units even if the weight of the items supported on the bottom panel is low. In addition, in this manner folding can be performed reproducible and the risk of items tumbling over during folding is strongly reduced.

In a further embodiment of a method according to the invention the method comprises the step of, during gripping of the rectangular bottom panel, allowing the at least one gripping element to move freely in a horizontal plane in order to be able to follow possible transverse movements of the rectangular bottom panel. As a result of the fact that the gripping element follows the possible transverse movements of the bottom panel, which, e.g., can occur during folding of side and end panels upwardly there is no relative displacement of the gripping element with respect to the bottom panel which reduces the risk that the gripping element inadvertently loses its grip on the bottom panel.

In a particularly advantageous embodiment of a method according to the invention the method comprises the step of providing the at least one gripping element with a suction cup for exerting underpressure at a respective gripping position at an underside of the rectangular bottom panel, said suction cup preferably being manufactured from flexible material. It is then preferred that the method comprises the step of raising the suction cup from a lower inoperative position to an operative position in contact with the bottom panel for gripping and supporting the bottom panel, wherein the underpressure in the suction cup preferably is activated before it contacts the bottom panel, such that the suction cup can reproducibly grip the bottom panel without changing the position of the bottom panel in the supporting station.

In a still further embodiment of a method according to the invention the step of adjusting the longitudinal distance between the rear and front folding units is performed during feeding of the custom sized blank into the supporting station, preferably by starting the displacement of the front pair of folding units towards the sealing station earlier than the displacement of the rear pair of folding units. Since adjusting of the longitudinal distance between the front and rear folding units takes place during displacement of the front folding units the time needed to fold a box can be reduced so that the process capacity can be increased. Preferably, the step of raising the suction cup is started during displacement of or preferably substantially simultaneously with starting displacement of the front pair of folding units towards the sealing station so that correct gripping can be realized and processing capacity can be increased.

Preferably the method comprises the step of displacing the folding units in a direction from the sealing station to the supporting station, wherein the step of adjusting the transverse distances between respective folding units is performed during said displacement of the folding units towards the supporting station. In this manner the correct transverse position of the folding units to support a next custom sized bottom panel at the corners thereof can be assumed before the four folding units reach the supporting position thereby allowing increasing the operating capacity. Optionally it is possible that during displacement of the folding units in a direction from the sealing station towards the supporting station the transverse distances are first adjusted to a default transverse distance, e.g., in case the data for the transverse distance for the next custom sized bottom panel is not available yet and, e.g., to avoid collision with in particular corner portion of panels of the blank which bend downwardly too much. In particular when the displacement of the folding units from the supporting station towards the sealing station and vice versa is independent from the relative positioning of the folding units the flexibility and the operating speed of the method can be increased.

Forming packaging boxes and packaging items therein can be performed relatively fast in an embodiment of a method according to the invention when the step of feeding the bottom panel onto the at least four folding units is performed without interruption after the step of cutting and creasing blank material into a custom sized blank. Alternatively or additionally the processing speed can be increased when the step of conveying the at least one article onto the bottom panel is performed while the custom sized blank is being fed onto the folding units.

In an embodiment of a method according to the invention wherein the step of cutting and creasing blank material into a custom sized blank by said blank forming apparatus comprises the step of cutting and creasing blank material into a custom sized blank having a top panel downstream of the bottom panel and preferably at least one of top side panels, a top end panel and top corner panels, the method preferably comprises the step of, during transporting the custom sized blank from the supporting station towards the sealing station, gradually raising the top panel. During said raising the top panel is at the same time supported and thus prevented from inadvertently bending downwards. In addition, gradually raising the top panel can promote further folding of the top panel. The step of gradually raising the top panel is preferably performed by means of a top panel raiser, preferably comprising a slanting belt extending from the supporting station to the sealing station.

In particular when the method comprises the step of providing a top panel folder, the step of positioning the top panel folder at a top folder level above the level defined by the bottom panel based on the height dimension and the step of displacing the top panel folder in a direction from the sealing station towards the supporting station while the folding units are displaced from the supporting station towards the sealing station folding of the top panel into a position which is substantially parallel to the rectangular bottom panel can be performed reliably and quickly. Preferably, the method then comprises the step of providing the top panel folder with a top pair of top folding units, the step of adjusting a top transverse distance between the top folding units based on the width dimension, and the step of activating the top folding units for folding down top side panels and/or a top end panel and/or top corner panels preferably after the top panel has been folded into the position which is substantially parallel to the rectangular bottom panel. Optionally the top folding units can be provided with a gripping element, e.g., for gripping the top panel. Independent of the displacement speed of the folding units from the supporting station towards the sealing station a correct folding of top end, side and corner panels can be obtained in an embodiment of a method according to the invention when during activation of the top folding units the method comprises the step of reversing the displacement of the top panel folder so that the top panel folder is displaced in a direction towards the sealing station.

In a further embodiment of a method according to the invention comprising the step of providing the top panel folder with at least one controllable rod, preferably at least two controllable rods, which after activating the top folding units is/are activated to engage a rear wall of the custom sized box, and preferably with at least one further controllable rod, preferably at least two controllable rods, which after activating the top folding units is activated to engage a (respective) side wall of the custom sized box recoiling of the top end panel and the top side panels can be prevented and in addition the rods engaging the rear wall of the box at least assist in further transport of the box towards the sealing station. Preferably the controllable rod(s) engaging the rear wall is (are) used for further transport towards the sealing station together with an additional supporting element extending centrally between the folding units and extending from the supporting station to the sealing station such that the folding units can be deactivated and already be returned to the supporting station after the rod(s) has (have) taken over transport.

Although upward folding of panels can be realized by stationary guides positioned adjacent to the displacement track of the folding units from the supporting station towards the sealing station a method according to the invention can be performed by a particularly compact and versatile apparatus when in a preferred embodiment of a method according to the invention the method comprises the step of providing each of the folding units of the front and rear pair and preferably the top pair with controllable end panel folding flaps and/or controllable side panel folding flaps and/or a controllable initiator for initiating the folding of a corner panel.

In a still further embodiment of a method according to the invention the method comprises the step of providing the seal applicator with displaceable seal applicator units and the step of displacing the seal applicator units based on the length, width and/or height dimensions. In this manner sealing boxes of different dimensions can be realized in a correct and automatic manner.

The invention further relates to a system for automatically processing blanks for forming packaging boxes according to claim 7. Since according to the invention, only one blank cutting station is necessary for cutting the blank to size and since the transport of the blank material does not need to be stopped for cutting, i.e., cutting is performed during feeding of the blank material, the production capacity of the system can be increased.

In a particular advantageous embodiment of a system according to the invention the system is incorporated in a system for automatically forming packaging boxes, said system comprising:

at least four folding units at a supporting station, wherein the at least four folding units comprise a front pair of folding units and a rear pair of folding units positioned at a longitudinal distance from the front pair of folding units, wherein the folding units of the front pair are positioned at a transverse distance from each other, and wherein the folding units of the rear pair are positioned at a transverse distance from each other;

the folding units being configured for supporting a blank formed by said blank forming apparatus;

wherein at least one of the at least four folding units is provided with a controllable gripping element for gripping the bottom panel, wherein the control unit is configured for activating said controllable gripping element into an operative mode for gripping the bottom panel and for deactivating said controllable gripping element for releasing the bottom panel; and wherein at least one of the folding units is configured for folding respective side and/or end panels of the blank upwardly. In this manner by using the inventive system a packaging box can be created and folded in a relatively short period of time. It is then in particular advantageous when the system is configured for packaging at least one article in a packaging box, preferably simultaneously with the formation of said packaging boxes, said system comprising:

an input conveyor for conveying, preferably horizontally conveying said at least one article in a conveying direction, said input conveyor being operatively connected to said control unit;

a device for providing data indicative of the overall length, width and height dimensions of the at least one article to the control unit;

said blank forming apparatus operatively connected to said control unit for, under control of the control unit, cutting and creasing blank material into a custom sized blank based on the data indicative for the length, width and height dimensions;

a sealing station downstream of the supporting station;

the at least four folding units being suspended to be displaceable under control of the control unit from the supporting station to sealing station and vice versa;

said input conveyor being configured for, under control of the control unit, conveying said at least one article, preferably in horizontal direction, onto the rectangular bottom panel supported at the supporting station;

said control unit being configured for displacing the folding units supporting the bottom panel and the at least one article supported thereon in conveying direction towards the sealing station and for during said displacement operating the folding units for folding side and end panels of the custom sized blank upwardly;

a seal applicator apparatus included at the sealing station operatively connected to said control unit for sealing the packaging box;

and optionally a discharge conveyor for discharging the packaging box with the at least one article;

wherein the control unit is configured for adjusting said longitudinal distance and/or said transverse distances based on the data indicative for the length and width dimensions, respectively. By using the length, width and height dimensions of said at least one article the control unit can control the system for cutting and creasing blank material into a custom sized blank automatically and thus actions performed by a human operator for identifying the size of a blank for a box for packaging the articles, which human action is inherently prone to error, are redundant. In addition it is possible to form a custom sized blank of any size based on the dimensions, so that the inventive system is versatilely applicable and is not restricted for forming boxes out of predetermined blank sizes. Furthermore, since the operative device of the system is configured for, during displacement of the folding units supporting the custom sized blank, folding the blank, it is possible to reduce the cycle time which can lead to an increased packaging capacity. In addition, since the blank is formed by folding the panels upwards for forming the packaging box the forces exerted on the articles to be packaged during folding are minimal as a result of which it is also possible to pack delicate products by means of the inventive system.

In an embodiment of a system according to the invention the input conveyor comprises a number of input sub-conveyors positioned consecutively in conveying direction. Preferably, the control unit is configured for driving the input sub-conveyors independently of one another. By using a number of input sub-conveyors it is possible to convey several sets of articles, each set destined to be packaged into one custom sized box, one after the other without interference and with an increase in packaging capacity. In case the input sub-conveyors are driven independently of one another it is possible to create buffers in dependence of the downstream processing speed.

In a still further embodiment of a system according to the invention the system comprises a number determining apparatus operatively connected to the control unit for determining the number of articles present on at least one of the input sub-conveyors and for providing data indicative of said number of articles to the control unit. Alternatively or additionally the system comprises a position determining apparatus operatively connected to the control unit for determining at which of the input sub-conveyors the at least one article is present during any given moment during conveying and for supplying data indicative for said determined position to the control unit. In this manner it is possible to configure the control unit for keeping track of the progress of the articles during the operation of forming packaging boxes around the articles and for comparing the number of articles as determined to be present on a specific input sub-conveyor at a given moment with the expected number and position of articles so that it is possible to check whether the progress takes place correctly. Please note, that the control unit is also configured for being inputted with the number of articles or items belonging to an order either manually or automatically. In a preferred embodiment of a system according to the invention the control unit is configured for providing an alarm signal in case the number of articles determined to be present on said specific input sub-conveyor differs from the number of said at least one article which is expected to be present thereon. Such an alarm signal can be used to automatically solve the detected discrepancy or can be used to notify a human operator that an inspection is necessary.

According to a further embodiment of a system according to the invention a transfer strip is provided adjacent to the downstream end of the input conveyor or the last input sub-conveyor. Such a transfer strip preferably is configured to allow a correct and smooth transfer of items from the input conveyor into the supporting station and onto the bottom panel. It is then preferred that the control unit is configured for stopping the conveyance of said at least one article by means of the last downstream input sub-conveyor. Temporarily stopping the conveyance of the articles can in some cases be necessary for the control unit to properly time the conveyance of the articles with the feeding of the custom sized blank, so that a correct positioning of the articles on the bottom panel can be obtained.

In a still further embodiment of a system according to the invention the device for providing data indicative of the overall dimensions comprises a measuring device which is configured for measuring the length, width and height dimensions of said at least one article, preferably during conveying of said at least one article by the input conveyor. In this manner the time needed to automatically form packaging boxes can be decreased leading to a larger operating capacity of the inventive system. In alternative embodiments the system can include alternative devices for providing data indicative of the overall dimensions for example devices for automatic identification of the article(s) through for example barcode scanning, RFID detection, image recognition and/or looking up the dimensions in databases or even by an operator input, e.g., when handling many small batches of equally sized articles.

In a further embodiment of a system according to the invention the input conveyor and the feeding conveyor are positioned such that said at least one article is conveyable in horizontal direction onto the bottom panel supported by the folding units. In this manner no transverse forces are exerted on the articles when they are placed on the bottom panel, which transverse forces could lead to unintended tumbling of the articles and thus the positioning of the articles on the bottom panel can be performed in a correct manner. Preferably, the blank forming apparatus is positioned below the input conveyor. In this manner the system can be constructed in a compact and in a relatively simple manner. It is then preferred that the feeding conveyor comprises a (shallow) S-bend which slopes upwards from the blank forming apparatus to the supporting station so that the conveying direction of the items and the feeding direction of the blank material at least substantially coincide at the level of the output or discharge end of the input conveyor.

Forming packaging boxes and packaging items therein can be performed by the system in a relatively easy manner when the control unit and/or the feeding conveyor are configured for feeding the bottom panel into the supporting station such that a center line of the bottom panel in conveying direction is centered between the folding units of the front and rear pair and/or when the control unit and the input conveyor are configured for conveying said at least one article from the input conveyor onto the bottom panel of the custom sized blank such that a leading end of the at least one articles positioned against the leading transverse folding line of the bottom panel.

In yet a further embodiment of a system according to the invention the control unit is configured for activating the blank forming apparatus for cutting and creasing blank material into a custom sized blank when said at least one article is present on the last input sub-conveyor. It is then preferred that the control unit is configured for activating the blank forming apparatus only when the number of articles as determined to be present on the last input sub-conveyor equals the expected number of said at least one article, i.e., the number of articles belonging to the order to be processed. In this manner the custom sized blank is formed at a stage in which it is almost certain that the correct articles to be packaged are present on the last downstream input sub-conveyor and it can thus be prevented that unintended changes in the number or position of articles necessitate that an earlier formed blank has to be discarded, not only leading to unnecessary waste of material but also leading to an unnecessary decrease of operating capacity.

In an embodiment of a system according to the invention the blank forming apparatus comprises a pair of longitudinal score line applicators for applying longitudinal score lines as folding lines to the blank material between respective panels, a single transverse score line applicator for applying transverse score lines as folding lines between respective panels, a single transverse cutter for cutting the blank material to the length of the custom size blank and a single longitudinal cutter or a pair of longitudinal cutters for cutting the blank material to the width of the custom sized blank, wherein the transverse distance between the pair of longitudinal score line applicators and the transverse distance between the longitudinal cutters is adjustable under control of the control unit based on the data indicative for the width and/or height dimension(s). It is then possible to obtain a high operating capacity when the single transverse cutter is suspended to be movable along a line which is positioned at such an angle with respect to the feeding direction of the blank material and when the control unit is configured to control the movement of the single transverse cutter along the line and the feeding speed of the feeding conveyor such that the cutter forms a cutting line transverse to the feeding direction, i.e., perpendicular to the side edges of the blank material. Such a cutter can be realized in the form of a displaceable rotating knife or a displaceable laser beam generator. Please note that in an alternative embodiment instead of a single transverse score line applicator the system can comprise two or more transverse score line applicators for applying transverse score lines.

In an advantageous embodiment of a system according to the invention said blank forming apparatus is configured for, under control of the control unit, cutting and creasing blank material into a custom sized blank having a rectangular bottom panel having a center line (centrally positioned between longitudinal folding lines) substantially parallel to the feeding direction, rectangular side panels and rectangular end panels joined to the bottom panel, rectangular corner panels joined to the end panels, a rectangular top panel joined to one of the end panels, rectangular top side panels joined to the top panel, a rectangular top end panel joined to the top panel and rectangular top corner panels joined to the top end panel, having score lines between the rectangular bottom panel, the rectangular side panels, the rectangular end panels and the rectangular top panel and having cut-outs in line with respective score lines between the corner panels and the adjoining side panels provided by a cutting-out device of the blank forming apparatus. A custom sized blank having such a constitution can be formed relatively simple and by a blank forming apparatus which is relatively simple of construction.

In an advantageous embodiment of a system according to the invention the blank forming apparatus and the control unit are configured for cutting and creasing blank material into a custom sized blank having a bottom panel based on the dimensions during feeding of said blank material in feeding direction. In this manner the time needed to automatically form packaging boxes can be decreased leading to a larger operating capacity of the system.

The operating capacity can be increased further when the blank forming apparatus comprises a cutting-out device comprising a pair of opposite cut-out knives, said cut-out knives being suspended to be displaceable downwards for forming cut-outs between corner panels and adjoining side panels of the custom sized blank, wherein the transverse distance between the opposite cut-out knives is adjustable based on the data indicative for the width and wherein the cutting-out device is configured for displacing the cut-out knives from an inactive position to an active position synchronously with a feeding speed of the blank material in feeding direction and even further when the cutting-out device is configured to displace the cut-out knives from the active position to the inactive position at a higher speed than the feeding speed of the blank material in a direction opposite the feeding direction.

Preferably the cutting-out device comprises a lower transverse guide, wherein the cut-out knives comprise an extension in engagement with the lower transverse guide. Said lower transverse guide is positioned below the path of the blank material. In a further embodiment of a system according to the invention the blank forming apparatus comprises a pair of longitudinal score line applicators, said longitudinal score line applicators being suspended to be displaceable downwards for applying longitudinal score lines as longitudinal folding lines to the blank material between respective panels, wherein the transverse distance between the longitudinal score line applicators is adjustable under control of the control unit based on the data indicative of the width, and wherein each of the pair of longitudinal score applicators comprises a coupling for mechanically coupling to a respective cut-out knife, said coupling preferably being configured for allowing a relative vertical movement of a cut-out knife and a respective longitudinal score line applicator. Thus, the cut-out knives are suspended and guided such that the cutting movement of the knives is substantially perpendicular to the surface of the blank material during the cutting operation. In an advantageous embodiment the cut out knives are guided between two parallel transversal guides, acting as contra bodies for a punching action punching away a strip of blank material. This way folding the blank to a well-fitting box can be improved, especially when using blank material having a thickness that is relatively high compared to the dimensions of the box. The transverse guides move together with the cut-out knives, e.g., during the cutting operation in feeding direction of the blank material. As a result of the coupling and the lower transverse guide, a frame of the system for mounting the cut-out knives can be constructed light-weight while still providing a correct cutting out of blank material.

In a particularly advantageous system according to the invention the cutting-out device comprises a pair of cam discs each cooperating with cam followers of a respective cut-out knife, each cam disc comprising an outer surface with an outer cam track and an inner surface provided with an inner cam track, one of the outer or inner cam tracks controlling the movement of the cut-out knives from the inactive position to the active position and vice versa and the other one of the outer or inner cam tracks controlling the downward and upward movement of the cut-out knives. In this manner it is due to the cam tracks possible to realize the forward speed of the cut-outs knives in feeding direction synchronously with the feeding speed of the conveyor and at a higher speed in the opposite direction and the downwards and upwards movement of the cut-out knives in an easy manner in the cam discs. Please note that in an alternative embodiment the inner cam track and the outer can track can be provided on a single surface of a cam disc. In addition in a still further embodiment two cam discs on either side can be used of which one comprises the inner cam track and the other one comprises the outer cam track. Preferably, the angle of the cutting edge of a cut-out knife with a horizontal direction is approximately 15°, while it is advantageous for cutting when the free end of the cut-out knives is provided with an indentation for forming a sharp cutting protrusion at the free end of the cut-out knife.

In a further embodiment of a system according to the invention the system comprises a waste conveyor for automatically discharging waste blank material. The waste can, e.g., be discharged to a waste container.

In a further embodiment of a system according to the invention in which the positioning of the articles on the bottom panel can be performed correctly in an easy manner the input conveyor and/or the control unit is/are configured for positioning said at least one article centrally on the input conveyor. Alternatively or additionally the feeding conveyor and/or the control unit is/are configured for positioning said blank material and said customized blank centrally on the feeding conveyor.

In a preferred embodiment of a system according to the invention the control unit is configured for positioning the four folding units at the supporting station downstream of the conveyor in conveying direction relative to one another such that the folding units of the front and rear pair are each positioned in a location in which they are able to support a respective corner of the rectangular bottom panel. In this manner it is possible under proper control by the control unit to correctly support the bottom panel independent on the size of the bottom panel, while the folding elements on the folding units for folding side panels, end panels and corner panels as a consequence be constructed in a relatively simpler manner. Preferably, the folding units and their mutual connection are configured such that during adjusting the transverse distances between the respective folding units the folding units are displaced symmetrically with regard to a central line between the folding units, and preferably such that the adjustment of the transverse distances between the front folding units and the rear folding units is performed synchronously. In this manner the device or apparatus for adjusting the relative distances between the folding units can be realized with a relatively simple construction.

Preferably the control unit is configured for activating the at least one gripping element into the operative mode before folding respective side and/or end panels of said custom sized blank upwardly and for keeping the at least one gripping element in the operative mode at least until folding respective side and/or end panels of said custom sized blank upwardly has been completed. In this manner it can be guaranteed that during folding the bottom panel remains fixed on the folding units even if the weight of the items supported on the bottom panel is low. In addition, in this manner folding can be performed reproducible and the risk of items tumbling over during folding is strongly reduced.

In a further embodiment of a system according to the invention the at least one gripping element is suspended to move freely in a horizontal plane in order to be able to follow possible transverse movements of the rectangular bottom panel. As a result of the fact that the gripping element follows the possible transverse movements of the bottom panel, which, e.g., can occur during folding of side and end panels upwardly, there is no relative displacement of the gripping element with respect to the bottom panel which reduces the risk that the gripping element inadvertently loses its grip on the bottom panel.

In a particularly advantageous embodiment of a system according to the invention the at least one gripping element comprises a suction cup for exerting underpressure at a respective gripping position at an underside of the rectangular bottom panel, said suction cup preferably being manufactured from flexible material. It is then preferred that the suction cup is suspended for being raised from a lower inoperative position to an operative position in contact with the bottom panel for gripping and supporting the bottom panel, and that the control unit preferably is configured for activating the suction cup before it contacts the bottom panel, such that the suction cup can reproducibly grip the bottom panel without changing the position of the bottom panel in the supporting station.

Preferably, the front pair of folding units are simultaneously drivable by a front motor from the supporting station towards the sealing station and vice versa, wherein the rear pair of folding units are simultaneously drivable by a rear motor from the supporting station towards the sealing station and vice versa, and wherein the front and rear folding units are coupled such that their transverse distances are simultaneously adjustable by a transverse motor, wherein the control unit is configured for adjusting said longitudinal distance and said transverse distances based on the data indicative for the length, width and height dimensions by accordingly controlling the front, rear and transverse motors such that the folding units of the front and rear pair are each positionable in a location in which they are able to support a respective corner of the rectangular bottom panel.

In a still further embodiment of a system according to the invention the control unit is configured for adjusting the longitudinal distance between the rear and front folding units during feeding of the custom sized blank into the supporting station, preferably by starting the displacement of the front pair of folding units towards the sealing station earlier than the displacement of the rear pair of folding units. Since adjusting of the longitudinal distance between the front and rear folding units takes place during displacement of the front folding units the time needed to fold a box can be reduced so that the process capacity can be increased. Preferably, the control unit is configured for raising the suction cup substantially simultaneously with starting displacing the front pair of folding units towards the sealing station so that correct gripping can be realized and processing capacity can be increased.

Preferably the control unit is configured for adjusting the transverse distances between respective folding units during said displacement of the folding units from the sealing station towards the supporting station. In this manner the correct transverse position of the folding units to support a next custom sized bottom panel at the corners thereof can be assumed before the four folding units reach the supporting position thereby allowing increasing the operating capacity. Optionally it is possible that, during displacement of the folding units in a direction from the sealing station towards the supporting station, the transverse distances are first adjusted to a default transverse distance, e.g., in case the data for the transverse distance for the next custom sized bottom panel is not available yet and, e.g., to avoid collision with in particular corner portion of panels of the blank which bend downwardly too much. In particular the control unit and the system are configured for displacing the folding units from the supporting station towards the sealing station and vice versa independently from the relative positioning of the folding units such that the flexibility and the operating speed of the method can be increased.

Forming packaging boxes and packaging items therein can be performed relatively fast in an embodiment of a system according to the invention when the control unit is configured for feeding the bottom panel onto the at least four folding units without interruption after cutting and creasing blank material into a custom sized blank. Alternatively or additionally the processing speed can be increased when the control unit is configured for conveying the at least one article onto the bottom panel while the custom sized blank is being fed into the supporting station.

In an embodiment of a system according to the invention wherein the control unit is configured for controlling said blank forming apparatus for cutting and creasing blank material into a custom sized blank having a top panel downstream of the bottom panel and preferably at least one of top side panels, a top end panel and top corner panels, the system preferably comprises a top panel raiser operatively connected to the control unit for, during transport of the bottom panel from the supporting station towards the sealing station, gradually raising the top panel. During said raising, the top panel is at the same time supported and thus prevented from inadvertently bending downwards. In addition, gradually raising the top panel can promote further folding of the top panel. The step of gradually raising the top panel is preferably performed by means of a top panel raiser, preferably comprising a slanting belt extending from the supporting station to the sealing station.

In particular when the control unit is configured for controlling the blank forming apparatus for cutting and creasing blank material into a custom sized blank such that a custom sized blank is formed having a top panel downstream of the bottom panel and when the system comprises a top panel folder downstream of the supporting station operatively connected to the control unit, the top panel folder can be suspended to be displaceable in height at a top folder level above the level defined by the bottom panel based on the data indicative for the height dimension and to be displaceable from and towards the supporting station, the control unit can be configured for displacing the top panel folder in a direction from the sealing station towards the supporting station while the folding units are displaced from the supporting station towards the sealing station for folding the top panel into a position which is substantially parallel to the rectangular bottom panel in a reliable and quick manner. Preferably, the top panel folder comprises a top pair of top folding units, which top folding units are suspended to be displaceable with respect to one another for adjusting a top transverse distance between the top folding units based on the data indicative for the width dimension, and the control unit is configured for activating the top folding units for folding down top side panels and/or a top end panel and/or top corner panels after the top panel has been folded into the position which is substantially parallel to the rectangular bottom panel. Independent of the displacement speed of the folding units from the supporting station towards the sealing station, a correct folding of top end, side and corner panels can be obtained in an embodiment of a system according to the invention when the control unit is configured for, during activation of the top folding units, reversing the displacement of the top panel folder so that the top panel folder can be displaced in a direction towards the sealing station.

In a further embodiment of a system according to the invention the top panel folder is provided with at least one controllable rod, preferably at least two controllable rods, wherein the control unit is configured for activating the controllable rod to engage a rear wall of the custom sized box, and preferably with at least one further controllable rod, preferably at least two controllable rods, which after activating of the top folding units by the control unit is/are activated to engage a (respective) side wall of the custom sized box recoiling of the top end panel and the top side panels can be prevented and in addition the rods engaging the rear wall of the box at least can assist in further transport of the box towards the sealing station. Preferably the controllable rod(s) engaging the rear wall can under control of the control unit be used for further transport towards the sealing station together with an additional supporting element extending centrally between the folding units and extending from the supporting station to the sealing station such that the folding units can be deactivated and already be returned to the supporting station after the rod(s) has (have) taken over transport. Preferably the supporting element comprises a central stationary element and a pair of side supporting elements each at either side of the stationary supporting element, wherein the side support elements are suspended such that the distance between the side support elements is adjustable under control of the control unit based on the data indicative for the width dimension.

Although upward folding of panels can be realized by stationary guides positioned adjacent to the displacement track of the folding units from the supporting station towards the sealing station a method according to the invention can be performed by a particularly compact and versatile apparatus when in a preferred embodiment of a system according to the invention each of the folding units of the front and rear pair and preferably the top pair is provided with controllable end panel folding flaps and/or controllable side panel folding flaps and/or a controllable initiator for initiating the folding of a corner panel.

In a still further embodiment of a system according to the invention the seal applicator comprises displaceable seal applicator units and the control unit is configured for displacing the seal applicator units based data indicative for the length, width and/or height dimensions. In this manner sealing boxed of different dimensions can be realized in a correct and automatic manner.

To further clarify various aspects of embodiments of the present disclosure and additional features and advantages of the embodiments, a more particular description of various aspects and features will be rendered by reference to specific embodiments thereof which are illustrated in the appended drawings. It is appreciated that these drawings depict only typical embodiments of the disclosure and are therefore not to be considered limiting its scope, nor are the figures necessarily drawn to scale.

BRIEF DESCRIPTION OF THE SEVERAL VIEWS OF THE DRAWINGS

The embodiments herein will be described and explained with additional specificity and detail through the use of the accompanying drawings in which:

FIGS. 4A to 4M show schematic top views in perspective of a various stages of a system 61 for packaging items in a box and for packaging the items therein simultaneously with the formation of said packaging box wherein the blank material from which the box is folded is transported during folding;

DETAILED DESCRIPTION

Figure 1:
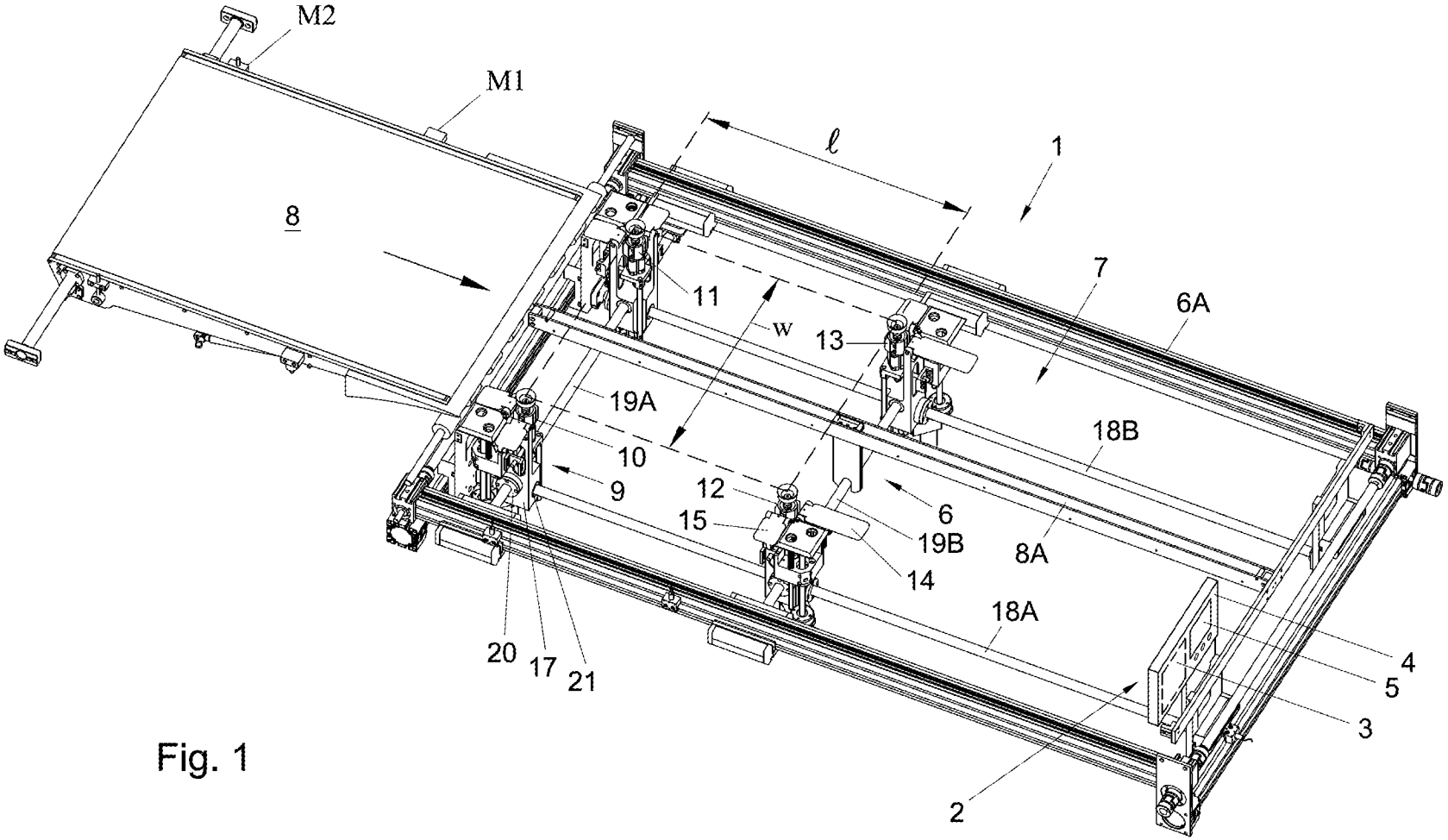
FIG. 1 is a schematic top view in perspective of a system 1 for packaging items in a box and for packaging the items therein simultaneously with the formation of said packaging box wherein the blank material from which the box is folded remains stationary during folding.

In FIG. 1 a schematic top view in perspective of a system 1 for packaging items in a box is shown. The system 1 comprises a control unit 2 comprising a processing unit 3 for controlling the operation of the system 1. The control unit 2 can furthermore comprise a console 4 with control buttons, e.g., for manually inputting data and a display 5. In FIG. 1 the console 4 is placed at the right hand side of the frame 6A downstream with regard to the conveying direction of the feeding conveyor 8. However, the console 4 can be positioned at another side of the frame 6A, e.g., depending on the direction in which folded boxes are discharged from the supporting station and depending on the mounting position of auxiliary devices, such as, e.g., a top panel folder, a sealing apparatus, etc.

The system 1 furthermore comprises a box folding apparatus 6 for folding a box from a blank 40 (FIG. 2) having a rectangular bottom panel 41 and further panels joined to the bottom panel by folding lines. The box folding apparatus 6 is operatively connected to the control unit 2.

The box folding apparatus 6 is able to fold boxes from differently shaped blanks which at least comprises a rectangular bottom panel, two side panels and two end panels and can be used to fold a so called open box which can optionally be closed with a separate cover or lid. However, a blank as shown in FIG. 2 will be used to describe the operation of the box folding apparatus 6.

Figure 2A:
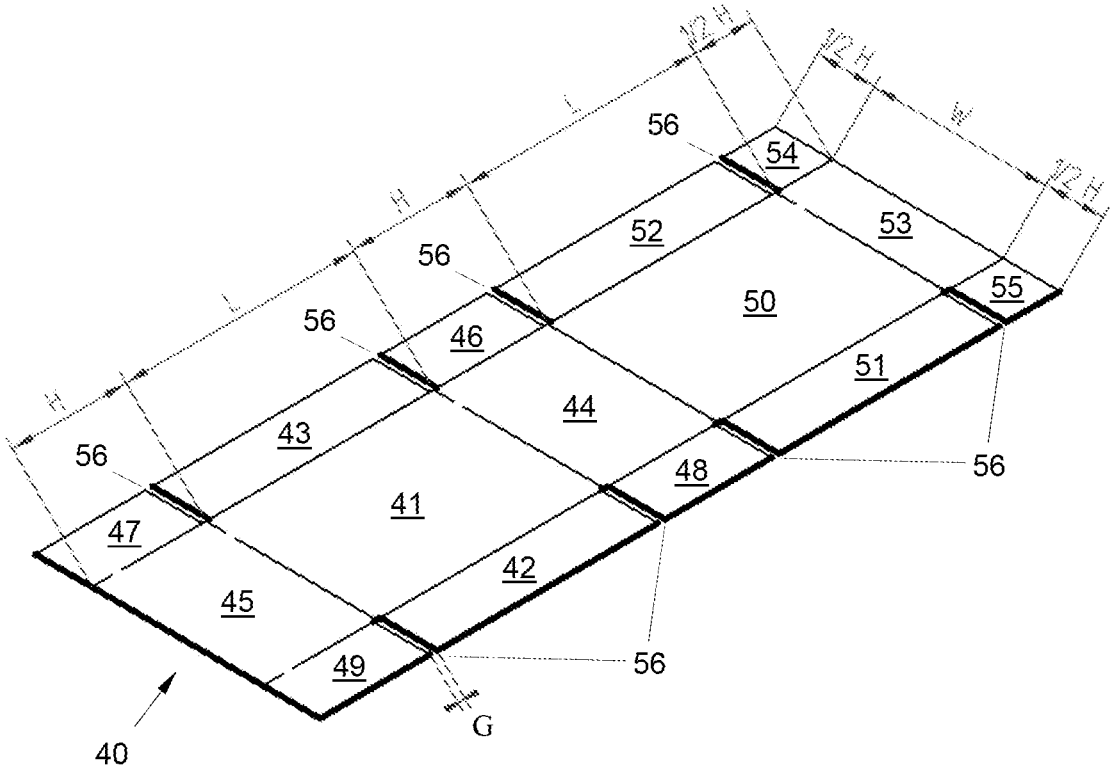
FIGS. 2A to 2G schematically show views in perspective of various stages of folding a custom sized box in which only the blank is shown.
Figure 2B:
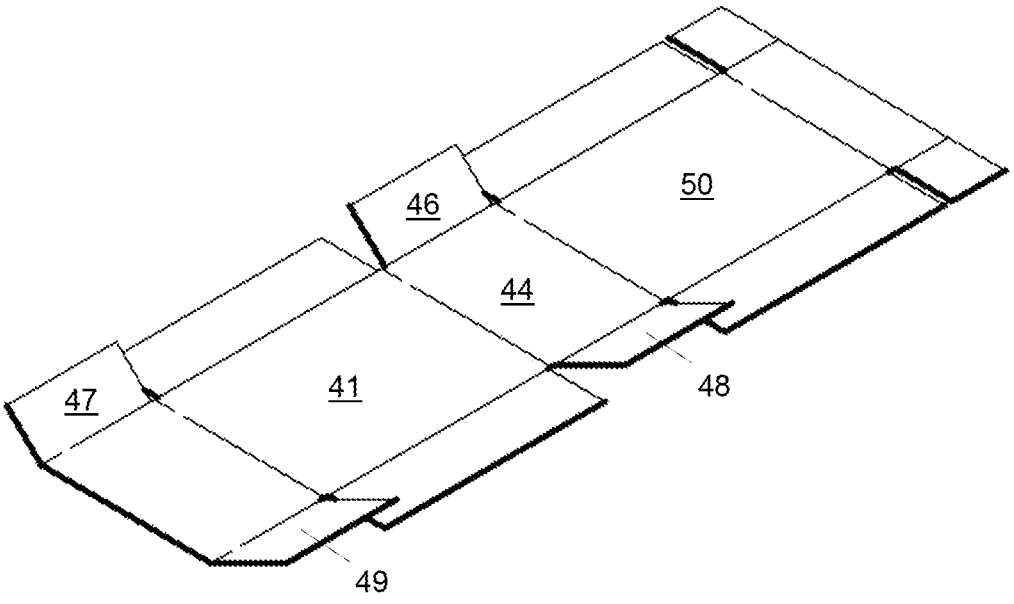

The blank 40 (see FIG. 2A) has a rectangular bottom panel 41, rectangular side panels 42, 43 and rectangular end panels 44, 45 joined to the bottom panel 41, rectangular corner panels 46, 48 joined to the end panel 44, rectangular corner panels 47, 49 joined to the end panel 45, a rectangular top panel 50 joined to the end panel 44, rectangular top side panels 51, 52 joined to the top panel 50, a rectangular top end panel 53 joined to the top panel 50 and rectangular top corner panels 54, 55 joined to the top end panel 53. As indicated in FIG. 2A the rectangular bottom panel 41 has a length L and a width W, the rectangular side panels 42, 43 each have a length L and a width ½H, the rectangular end panels 44, 45 each have a width W and a length H, the rectangular corner panels 46-49 each have a length H and a width ½H, the rectangular top panel 50 has a length L and a width W, the rectangular top side panels 51, 52 have a length L and a width ½H, the rectangular top end panel 53 has a length ½H and a width W, and the rectangular top corner panels 54, 55 have a width and a length of ½H. Cut-outs 56 are present between the respective corner panels and the adjoining side panels and have a width of ½H and a length G which is sufficient for allowing a correct folding of the panels with respect to one another. As can be seen the cut-outs 56 are in line with respective transverse score lines. Please note that the cut-outs can be realized by taking away blank material but can also be formed by incisions in the blank material without taking away blank material.

Please note that the dimensions given above are exemplary. In addition in dependency of the (stiffness) of the material of which the blanks are made the dimensions can be a little larger (by an amount of a few millimeters) in order to ensure a correct folding of the box while still providing sufficient interior volume of the box for the articles to be packaged. In an alternative embodiment the width of the top side panels and the length of the top end panel is a certain amount, preferably about 1 cm to 2 cm, larger than ½H so that an overlapping part is obtained, which protects the items to be packaged when a seal of the box is opened.

The system 1 comprises a supporting station 7 which in FIG. 1 is formed by the box folding apparatus 6 mounted within a frame construction 6A. The supporting station 7 comprises a support for a rectangular bottom panel 41 of a blank 40 which can be put onto the support by hand or can be transported thereon via a feeding conveyor 8. The supporting station 7 is formed by a gripping device 9 having at least four folding units 10, 11, 12 and 13, wherein the folding units 10-13 preferably comprise controllable gripping elements. In case larger blanks are to be folded a central supporting bar 8A can be provided. The gripping device 9 is operatively connected to the control unit 2 which is configured for activating the gripping elements of the folding units 10-13 into an operative mode for gripping the bottom panel 41 and for deactivating the gripping elements of the folding units 10-13 for releasing the bottom panel 41. The relative distance between each of the four folding units 10-13 is adjustable such as to define a respective corner of a rectangular support plane having a length l and a width w such as to support the rectangular bottom panel 41. The support plane thus in fact is a virtual plane which is defined by the corners points formed by the folding units 10-13. In FIG. 1 the folding units 10 and 11 are positioned stationary with respect to the feeding conveyor, meaning that they are mounted at a fixed distance from an output end of the feeding conveyor 8. However, the relative distance between the folding units 10 and 11, defining the width w is adjustable. In FIG. 1 the folding units 12 and 13 are positioned moveably with respect to the folding units 10, 11 and thus with respect to the feeding conveyor, meaning that they are mounted at a distance l from the folding units 10, 11 which is adjustable. The relative distance between the folding units 12 and 13, defining the width w is also adjustable.

According to the invention each folding units 10-13 is provided with folding elements 14, 15, 16 (for clarity reasons in FIG. 1 only shown for the folding unit 12) for folding end, side and corner panels upwardly with respect to the rectangular bottom panel 41.

The four folding units 10-13 including the folding elements 14-16 are thus positioned at the corners of a rectangle and thus form a support surface for the bottom panel 41. To realize a synchronous displacement in either the width and length dimension by using only one motor for each dimension each folding unit 10-13 is provided with a corner connection piece 17 (for clarity reasons in FIG. 1 only shown for the folding unit 10) which interconnects the folding units 10 or 11 with the adjacent downstream folding unit 12 or 13, respectively and the adjacent folding unit 11 seen in a direction transverse to the conveying direction of the feeding conveyor 8 by means of sliding rods 18A, 18B and 19A, 19B. By means of a single longitudinal motor M1 relative displacement of the folding units is allowed along the longitudinal sliding rods 18A, 18B by means of a sliding engagement of the bars and the connection pieces. By means of a single transverse motor M2 relative displacement of the folding units is allowed along the transverse sliding rods 19A, 19B by means of a sliding engagement of the bars and the connection pieces. Each corner connection piece 17 therefore has a transverse sliding sleeve 20 that slidably supports a part of a respective transverse sliding rod 19A, 19B and a longitudinal sliding sleeve 21 that slidably supports a part of a respective longitudinal sliding rod 18A, 18B. The sliding rods 19A, 19B are vertically positioned above the sliding rods 18A, 18B thereby providing additional stability to the folding units 10-13.

Please note that in alternative, not shown embodiments, different kind of connection pieces can be used. As a result of the slidability of the connection pieces 17 over the sliding rods 18, 19 with respect to each other the distance l between the two transverse connecting folding bars 19A, 19B is adjustable to correspond to the length dimension L of the bottom panel and the distance w between the two longitudinal connecting bars 18A, 18B is adjustable to correspond to the width dimension W of the bottom panel 41. These two adjustments can be performed independent from each other and, e.g., automatically under control of the control unit 2 based on data regarding measured dimensions or inputted dimensions of the bottom panel, which control unit 2 is operatively connected to the motors M1, M2. In addition it is possible by using the control buttons on the console 4 to set the distances by manual input.

The four folding units used in the system 1 of FIG. 1 will be described in more detail with reference to FIGS. 3A-3E which schematically show top views in perspective of the folding unit 12. It will be clear that in this embodiment the other folding units are similarly constructed. However, in embodiments where, e.g., the weight of the items on the bottom panels prevents the bottom panel from shifting during folding end and side panels it upwardly is possible to only provide one rear folding unit and one front folding unit with a gripping element or even to only provide one of the at least four folding units with a gripping element.

Figure 3A:
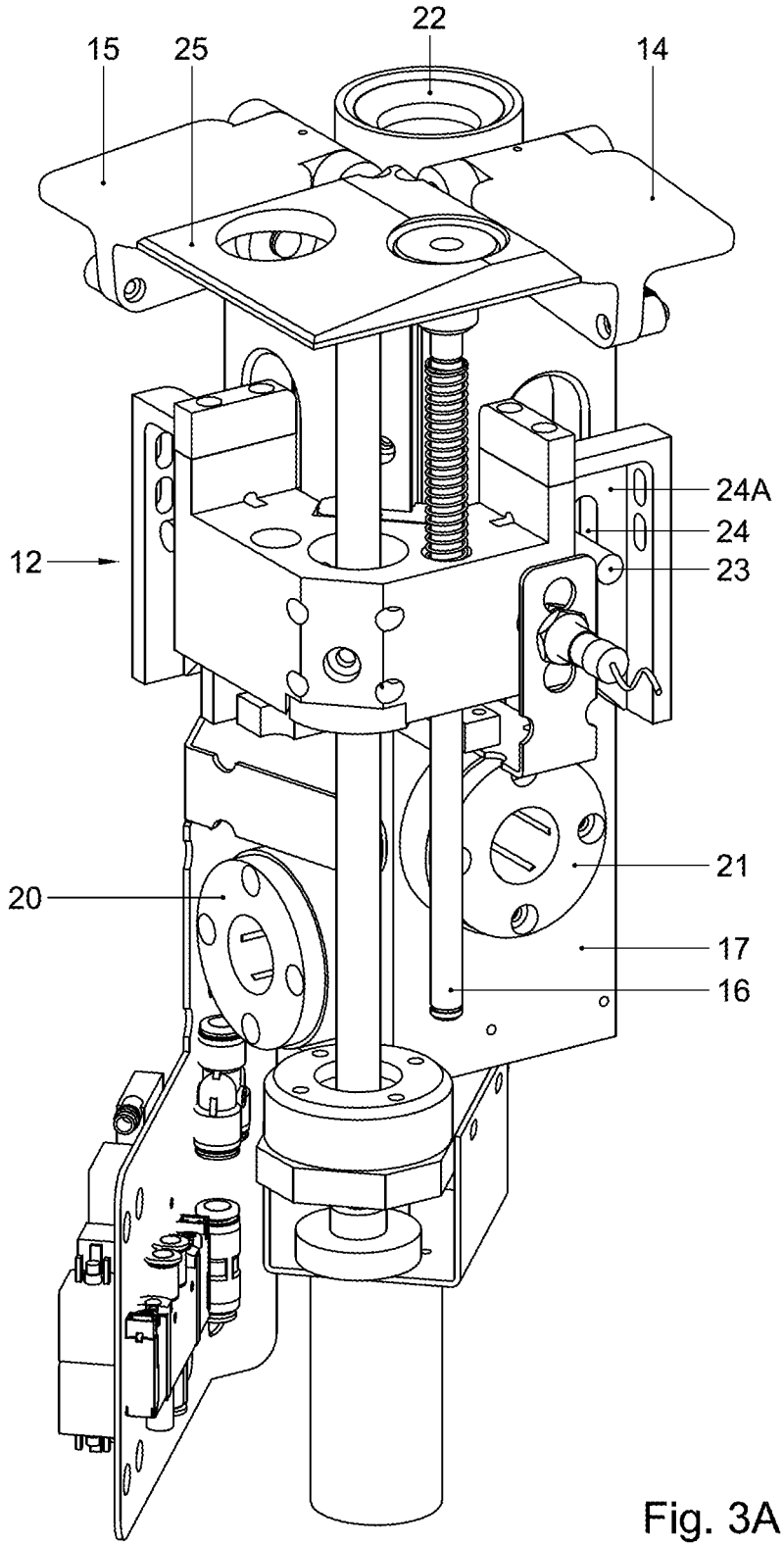
FIGS. 3A to 3E schematically show views in perspective of various stages of activation of a folding unit provided with a suction cup, folding flaps and a corner flap initiator.

The folding unit 12 is shown in FIG. 3A in a starting position in which a blank can be positioned thereon. The folding unit 12 comprises a gripping element, preferably a suction cup 22 of flexible material, which is activated under control of the control unit 2 for gripping and fixation at a respective gripping position of the bottom panel, e.g., when the bottom panel is positioned on all four suction cups of the folding units 10-13. Preferably the underpressure in the suction cups is activated by the control unit 2 before folding respective panels of the blank upwardly in order to prevent the blank from unwantedly lifting up from the suction cups. In cases where articles to be packaged are positioned on top of the bottom panel it is possible to activate the suction cups at a later stage. In addition, the control unit keeps the suction cup activated at least until the panels hand but in the embodiment shown in FIG. 1 the articles can also be transported on the bottom panel by means of the feeding conveyor 8 under control of the control unit 2.

Furthermore, the folding unit 12 is provided with folding elements, preferably an end panel folding flap 14, a side panel folding flap 15 and an initiator 16 for initiating the upward folding of a corner panel, all of which are controllable by the control unit 2. The suction cup 22 is mounted displaceably within the folding unit 12 and is provided with a rod like extension 23 which is guided in a slot 24 of a plate 24A which slot 24 is open at the underside and which plate 24A is mounted so as to move together with the end panel folding flap 14.

In the embodiment shown each suction nozzle comprises a single suction head. However, in dependence on the size of the blank to be folded each suction nozzle can in other embodiments comprise multiple suction heads and/or additional support surfaces, such as support surface 25, top surfaces of which lie in the support plane.

Figure 2C:
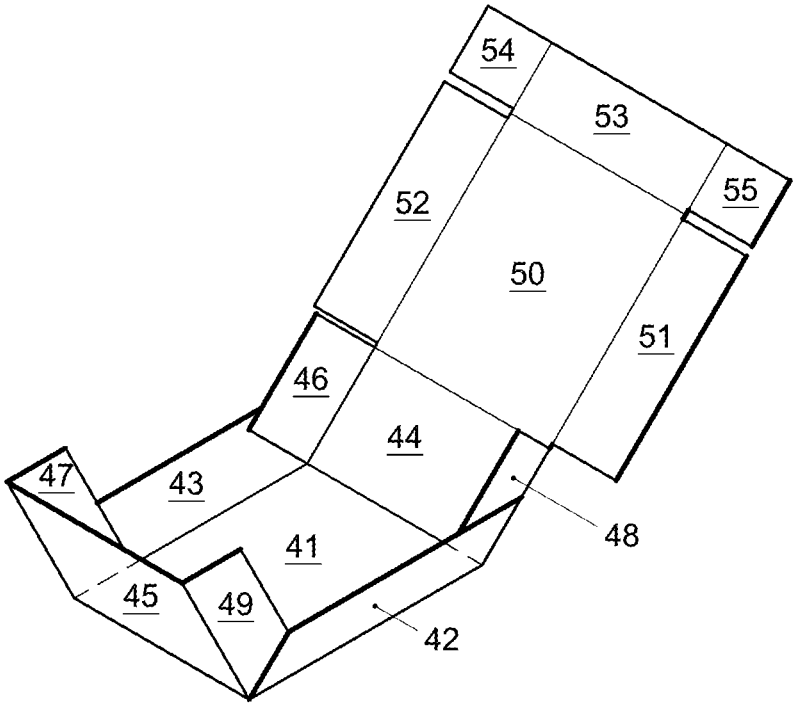
Figure 2D:
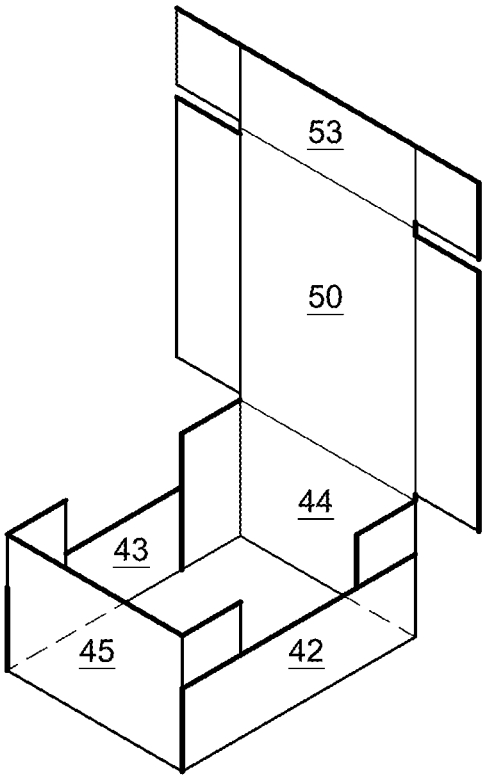

In the embodiment shown in FIGS. 3A-3E the control unit 2 controls the folding unit 12 with the controllable folding elements 14-16 such that panels of blanks with the configuration as shown in FIG. 2 are consistently and reproducibly folded in correct order in the following manner. As shown in FIG. 3B first a body of the folding unit 12 is lowered with respect to the suction cup 22, which thus relatively speaking is raised, while the suction cup 22 is activated to correctly grip the underside of the bottom panel 41 of the blank 40. Thereafter the body of the folding unit 12 is raised and simultaneously the initiator 16 is raised over a first distance for initiating the upward folding of a corner panel 48 (FIG. 3C). By controlling the upward movements of all initiators the control unit 2 can ensure that the corner panels 46-49 are first at least partly folded upwards. (The situation in which the corner panels are partly folded upwards is shown in FIG. 2B.)

Figure 3B:
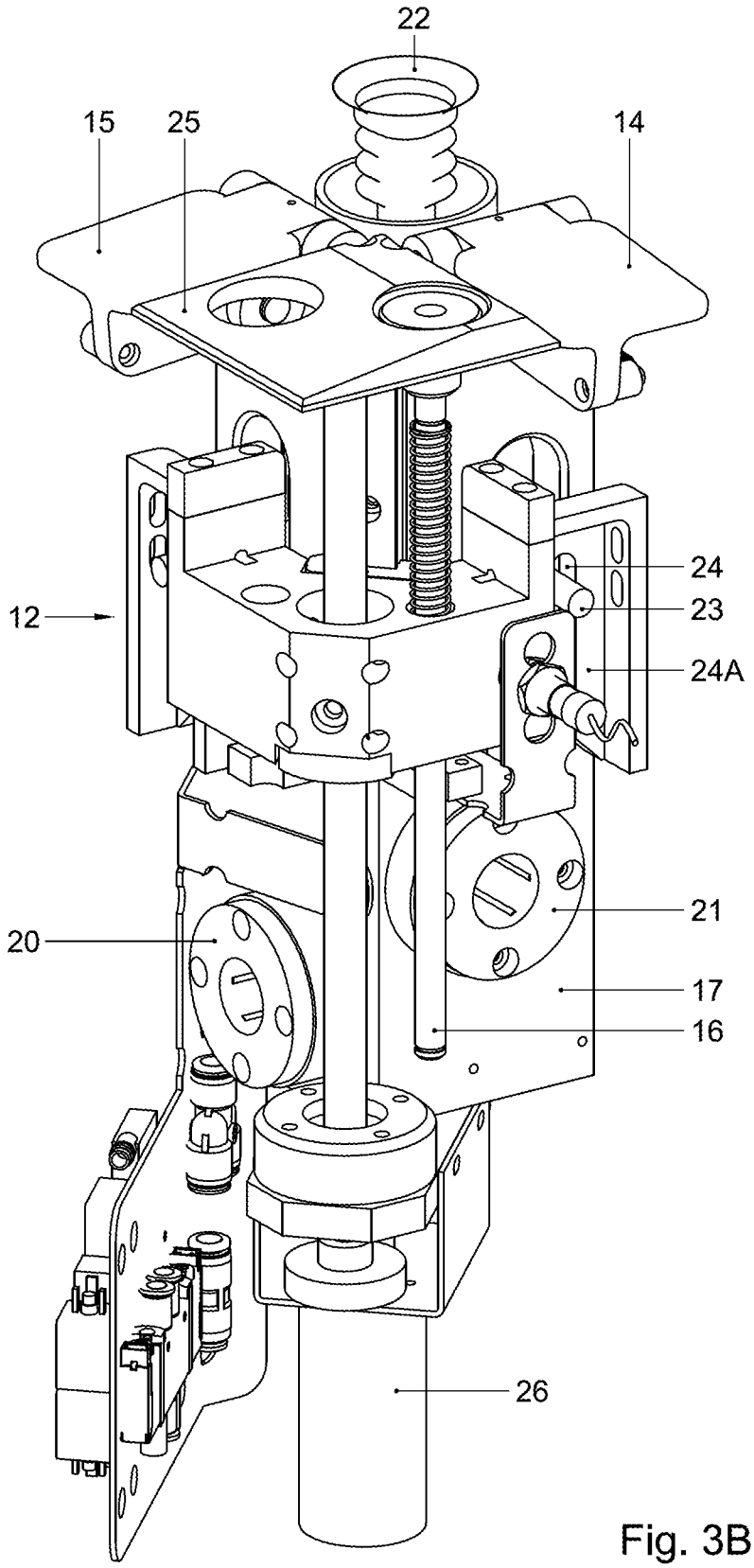
Figure 3C:
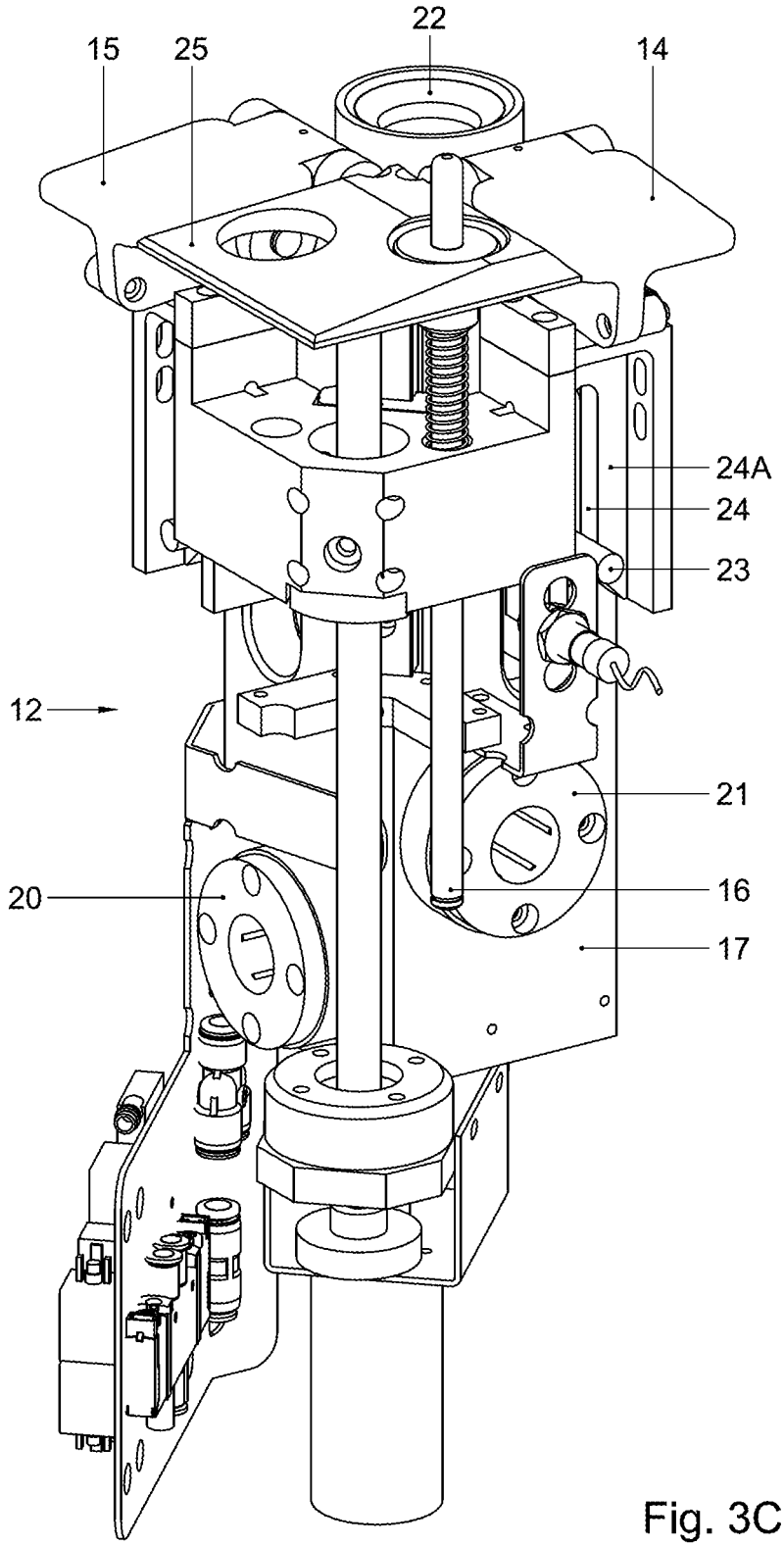
Figure 3D:
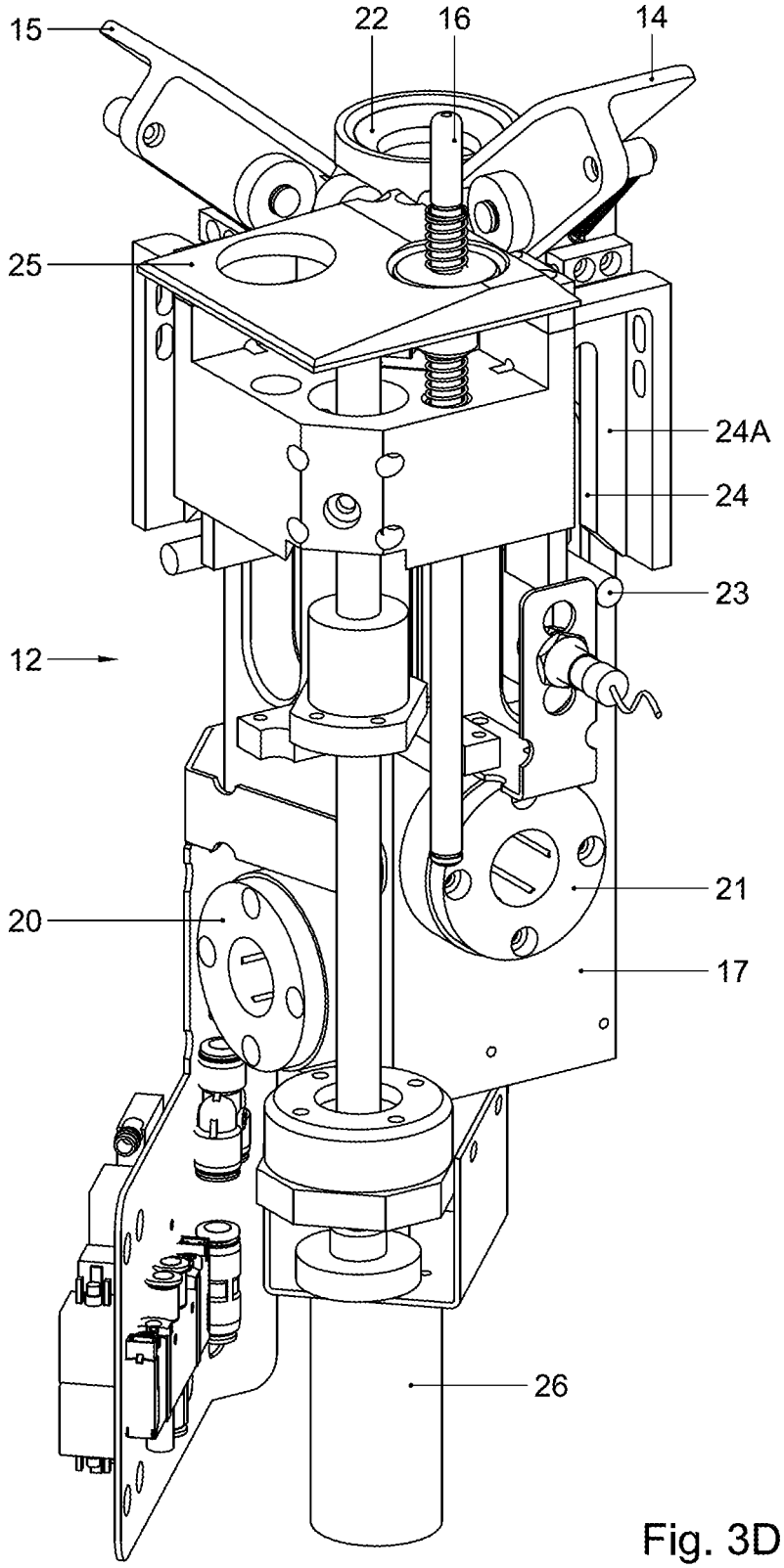

Thereafter the control unit 2 activates the end panel folding flap 14 such that the end panel 44 is caused to be folded partly upwards and the side panel folding flap 15 to fold the side panel 42 partly upwards. In addition the initiator 16 is raised over a corresponding distance (see FIG. 3D). Activation of the end panel folding flaps and side panel folding flaps of all folding units 10-13 ensures that the side panels 42, 43 are situated at the outside of the corner panels 46-49 (as can be seen in FIG. 2C). Depending on the stiffness of the blank material also the top panel 50 and top end panel 53 and top side panels 51 and 52 are raised. As can be seen in FIG. 3D during raising of the end panel folding flap 14 the plate 24A is raised such that the rod like extension 23 of the suction cup is free from the slot 24, meaning that the suction cup 22 is mounted so as to move freely in a horizontal plane in order to be able to follow possible transverse movements of the bottom panel during folding of the respective panels upwardly ensuring a correct gripping throughout the folding operation.

Figure 3E:
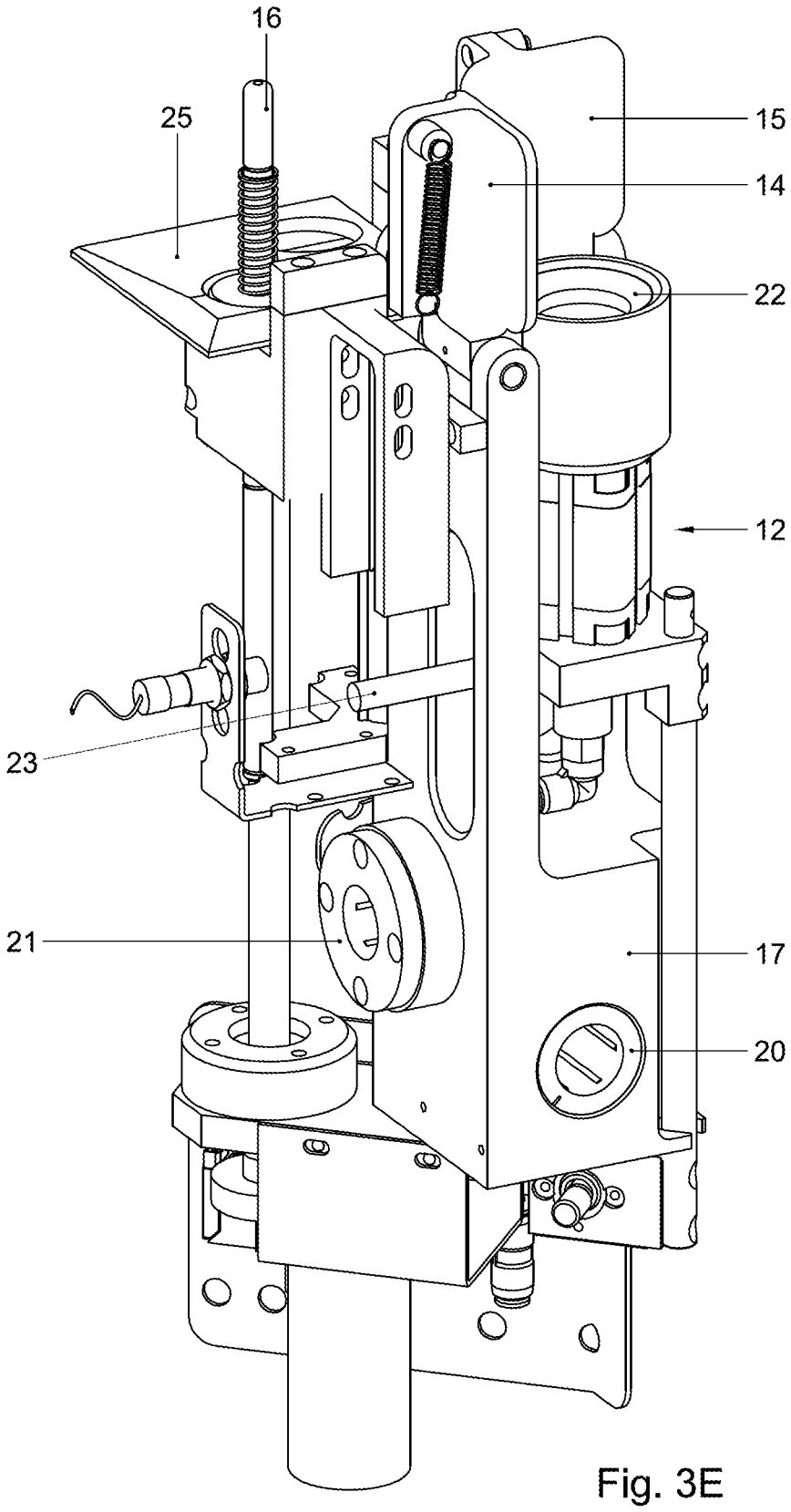

The end panel folding flap 14, the side panel folding flap 15 and the initiator 16 are mounted such in the folding unit such that the above described activation can be realized by using only one activator 26. In other, not shown embodiments, the end and side panel folding flaps and initiator can be driven by separate drivers which are separately activated by the control unit. Ultimately the end pane folding flap 14 and the side panel folding flap 15 are folded so as to take in a vertical position as shown in FIG. 3E, corresponding to a folded blank as shown in FIG. 2D.

Figure 2E:
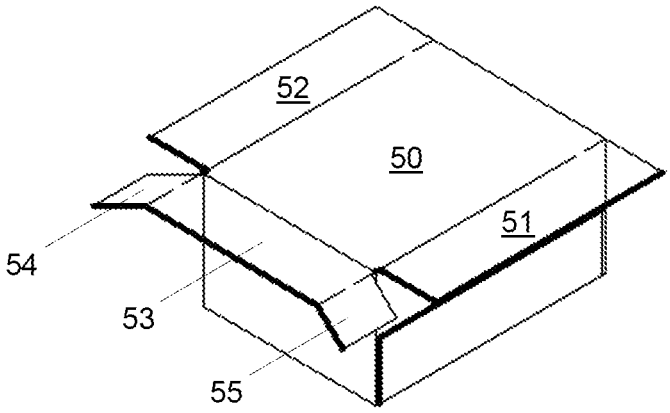
Figure 2F:
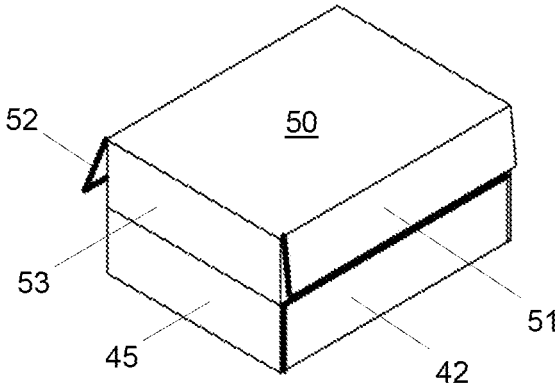
Figure 2G:
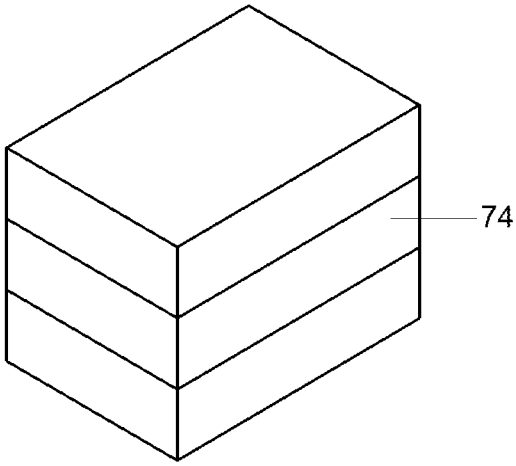

Folding the top panel 50 over the upstanding side panels as shown in FIGS. 2E and 2F can be performed manually or by means of any known top panel folder but preferably by an inventive top panel folder to be described later. Finally the box can be closed by applying a tape 74 over the single seam, as shown in FIG. 2G. This can be performed at the supporting station but can also be done at a separate sealing station. Hereto the system can comprise a transferring means operatively connected to the control unit and preferably integrated in the top panel folder for transferring a folded box, e.g., in transverse direction from the supporting station to the sealing station.

Figure 4A:
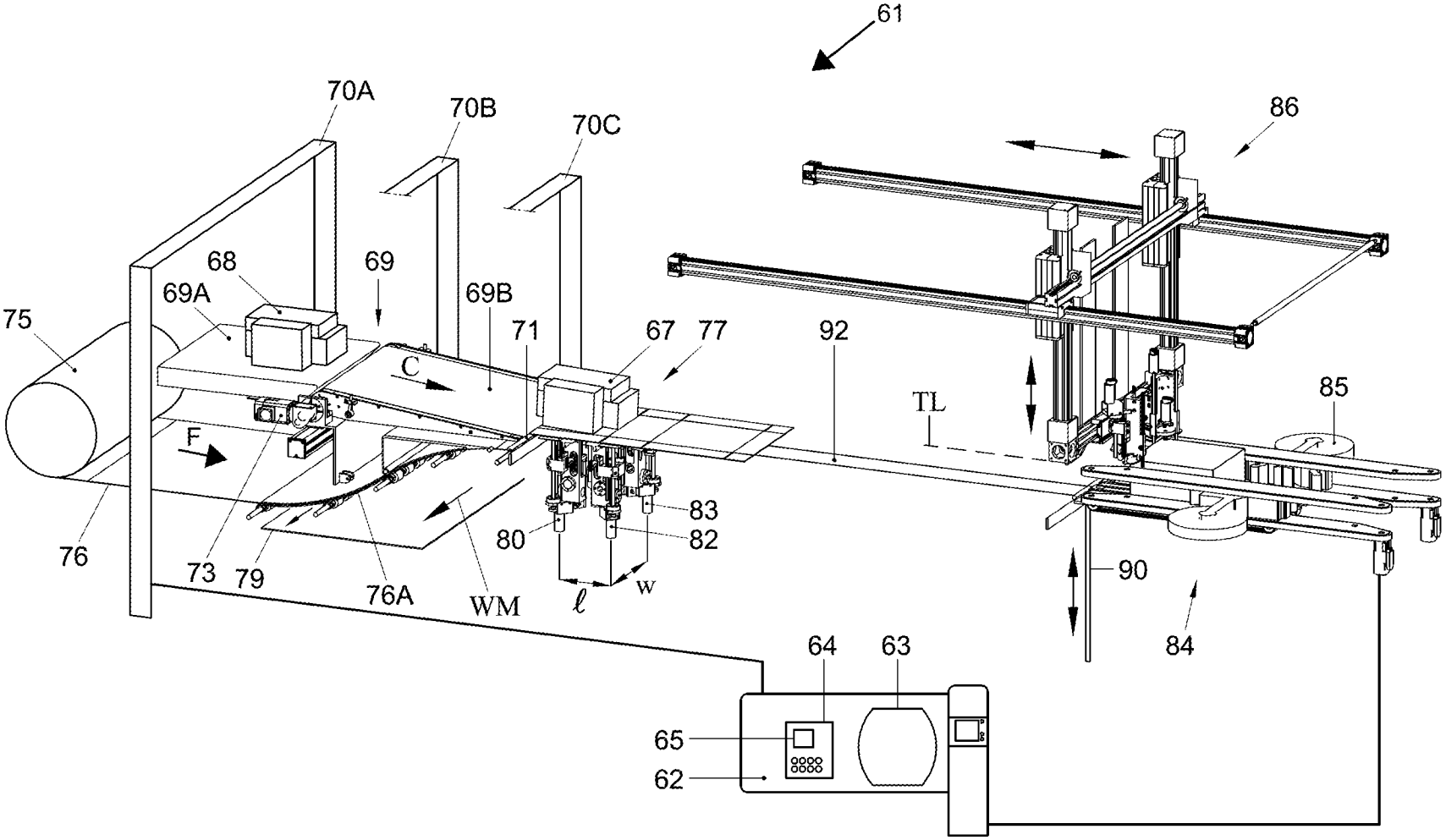

In FIG. 4A a schematic side top view in perspective of a system 61 for automatically forming packaging boxes and for packaging at least one article therein, in this embodiment simultaneously with the formation of said packaging boxes in accordance with the invention is shown. The system 61 comprises a control unit 62 comprising a processing unit 63 for controlling the operation of the system 61. The control unit 62 can furthermore comprise a console 64 with control buttons, e.g., for manually inputting data and a display 65.

Articles or items 67, 68 to be packaged are substantially horizontally conveyed in conveyance direction C indicated by the arrow by an input conveyor 69, which can be realized by any known means, such as endless conveyor belts, roller conveyors, etc. The articles to be conveyed can be positioned centrally on the input conveyor 69 and during conveyance this central position can be maintained. The input conveyor 69 comprises a number of input sub-conveyors of which only two 69A, 69B have been shown. The input sub-conveyors 69A, 69B are positioned consecutively in conveying direction, and include a last downstream input sub-conveyor 69B. Indicators 70A-C (of which 70B, 70C are shown partly in FIG. 4A) are provided for determining of the location or position of the items 67, 68 on the input conveyor 69. Such indicators 70A-C can be in the form of light sensors, cameras or any other known means. In addition, data from encoders driving the input sub-conveyors can be used in determining the position of the articles. Such indicators 70 can in combination with data from the control unit 62, to which the indicators are communicatively connected for providing data indicative for said determined position thereto, also be used to indicate a location on the input conveyor 69 where items belonging to an order for a customer are deemed to be present at any given moment in time. The input sub-conveyors 69A, 69B are configured to be driven independently from each other by means of the control unit based on information provided by the indicators 70. In addition the indicators 70 optionally in combination with weighing means can determine the number of articles present on a specific input sub-conveyor and provide data indicative of said number to the control unit 62. By during conveyance of the articles from one input sub-conveyor to the next one comparing the number of articles as present on said specific input sub-conveyor with the number of articles which are expected to be present thereon it is possible to determine whether or not any articles are unintentionally removed from the input conveyor during conveyance. In case the result of such a comparison indicates that these numbers differ then the control unit 62 can give an alarm signal to an operator and/or can deactivate the input conveyor 69 simultaneously with said alarm signal. The number of articles belonging to an order of a customer can, e.g., be automatically inputted in the control unit during ordering. Please note that the indicator 70A can be configured as measuring device for measuring the length, width and height dimensions of the items during conveyance of said at least one article by the input conveyor, such that the capacity of the system can be increased.

Figure 7:
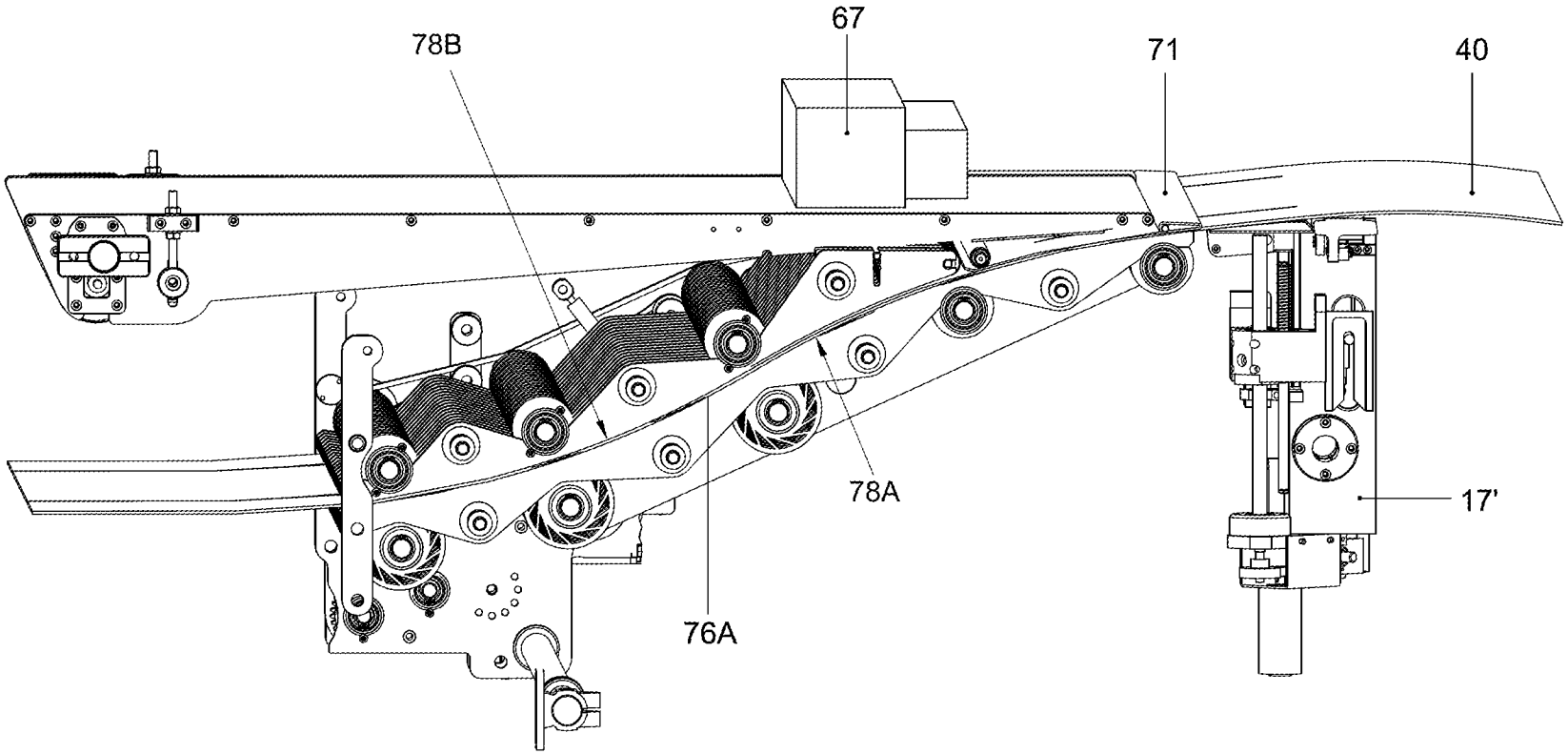
FIG. 7 shows a schematic side view in cross-section of the region around the transfer strip 71 between the input conveyor and the supporting station of the system 61 of FIG. 4 in more detail.

The system 61 is furthermore provided with a transfer strip 71 adjacent to the downstream end of the last downstream input sub-conveyor 69B (see also FIG. 7). The transfer strip 71 preferably lies in the extension of the last downstream input sub-conveyor 69B. Articles to be packaged can be conveyed by means of the last downstream input sub-conveyor 69B onto and over the transfer strip 71. The transfer strip 71 is not drivable. In particular the last downstream input sub-conveyor can be stopped by the control unit in case this is required for further conveyance of the articles onto a bottom panel of a blank.

Transport of items or articles belonging to an order of a customer onto a specific input sub-conveyor can be realized by (not-shown) transport means which, e.g., can be formed by conveyor belts which are oriented transverse to the input conveyor 69 and the operation of which can also be controlled by the control unit 62.

In the system 61 the measurement device 70A is included for measuring the dimensions and optionally weight of items 67, 68 to be packaged and for providing data indicative for the measured dimensions and optionally weight to the control unit 62. The measurement device 70A measures the length, width and height of the items 67, 68 to be packaged while the articles are conveyed such that the capacity of the system can be increased. The measurement device 70A is communicatively connected to the control unit 62 for providing data indicative for the measured dimensions to the control unit 62. Such a connection can be hardwired or wireless.

The system 61 furthermore comprises a blank cutting station 72 comprising a blank forming apparatus 73 for cutting and creasing blank material into a custom sized blank for example from blank material which is fed out of a stock or storage 75 of default blanks. In the embodiment shown in FIG. 4A the blank forming apparatus 73 is positioned below the input conveyor 69, and preferably such that the conveying direction C of said articles 67, 68 is at least substantially parallel to the feeding direction F of the blank material. Although the stock 75 of default blanks is shown in FIG. 4A as a roll of endless blank material, such a stock may also be provided by zigzag folded blank material or a stack of default separate blanks or stocked otherwise. Also the blank forming apparatus 73 is communicatively connected to the control unit 62, which controls the blank forming apparatus 73 for cutting and creasing blank material into a custom sized blank having a rectangular bottom panel at least based on the data indicative for the measured dimensions as provided by the measurement device 70A.

The blank forming apparatus 73 will be more detailed described with reference to FIG. 6 and is controlled by the control unit 62 for cutting and creasing blank material into a custom sized blank 40 as shown in FIG. 2A and as described above in detail.

Feeding of blank material is performed by a feeding conveyor 76 which is operatively connected to the control unit 62. In FIG. 4A the feeding conveyor 76 both transports the blank material from the storage 75 to the blank cutting station 72 and transports custom sized blanks from the blank cutting station 72 to a supporting station 77. The feeding conveyor 76 can be arranged for feeding the blank material and the custom sized blank centrally positioned thereon towards the supporting station 77. The feeding conveyor 76 can, e.g., be formed by superposed conveyor belts 78A, 78B (FIG. 7) in between which the blank is transferred from the blank forming apparatus 73 to the supporting station 77. Since in the shown embodiment the blank forming apparatus 73 is positioned below the input conveyor the feeding conveyor 76 transports the blank upwards, preferably via a (shallow) S-bend 76A which slopes upwards.

Waste blank material remaining after formation of the custom sized blank falls down on a waste conveyor 79 and is discharged via this waste conveyor 79 preferably in a direction WM transverse to the conveying direction C.

At the supporting station 77 downstream of the input conveyor in 69 at least four folding units 80, 81, 82, 83 are positioned. The folding units 80-83 are provided with a controllable suction cup as gripping element for gripping the bottom panel and are constructed as shown and described with reference to FIG. 3. Depending on, e.g., the material of the bottom panel and the articles to be placed on the bottom panel at least one of the folding units can be provided with a suction cup. The folding units 80-83 are thus operatively connected to the control unit 62 which is configured for activating said folding units and the suction cup into an operative mode for gripping the bottom panel and for deactivating the suction cup for releasing the bottom panel. The four folding units 80-83 comprise a front pair of folding units 82, 83 and a rear pair of folding units 80, 81 positioned upstream at a longitudinal distance l from the front pair of folding units 82, 83 seen in conveying direction. In this embodiment, the folding units 82, 83 of the front pair and the folding units 80, 81 of the rear pair are positioned at the same transverse distance w from each other, which distance is adjustable under control of the control unit 62 based on the data indicative for the measured length and width dimensions, respectively. In this manner the control unit 62 can adjust the longitudinal distance and the transverse distance between the folding units 80-83 such that the folding units are able to support a respective corner of a bottom panel 41 of the custom sized blank 40. In other embodiments the transverse distance between the front folding units and the transverse distance between the rear folding units is different.

Although the control unit 62 can control the rear pair of folding units 80, 81 such that their distance with regard to the transfer strip 71 stays constant throughout folding, in the embodiment shown in FIG. 4A all the folding units 80-83 are suspended to be displaceable under control of the control unit 62 from the supporting station 77 to a sealing station 84 and vice versa. In the embodiment shown in FIG. 4 the front folding units 82, 83 are simultaneously drivable by a front motor FM (see FIG. 5B) from the supporting station 77 towards the sealing station 84 and vice versa, whereas the rear folding units 80, 81 are simultaneously drivable by a rear motor RM from the supporting station 77 towards the sealing station 84 and vice versa, independent from the displacement of the front folding units. Analogous to the system 1 of FIG. 1 the front and rear folding units are coupled by means of sliding rods 88A, 88B and 89A, 89B such that by means of a single transverse motor 87 (FIG. 5B) relative transverse displacement of the folding units is allowed by means of a sliding engagement of the sliding rods or bars and the connection pieces of the folding units. In this manner the control unit 62 can control the motors FM, RM and 87 independently from each other so as to adjust said longitudinal distance and said transverse distances such that the folding units of the front and rear pair are each positionable in a location in which they are able to support a respective corner of the rectangular bottom panel. In particular advantageous is that front folding units are drivable in longitudinal direction independent from the rear folding units, as a result of which it is possible to adjust the distance between the front and rear folding units to match the measured length during displacement of the (front) folding units, thereby increasing the production capacity. Please note that during transverse positioning of the four folding units the four folding units are synchronously displaced symmetrically with regard to a central line between the four folding units.

The sealing station 84 is thus positioned downstream of the supporting station 77 and comprises a seal applicator apparatus 85 which is operatively connected to said control unit 62 for sealing a folded packaging box.

Between the supporting station 77 and the sealing station 84 a top panel folder 86 is positioned downstream of the supporting station 77, which top panel folder 86 is operatively connected to the control unit 62. The top panel folder 86 is displaceable in height at a top folder level TL above the level defined by the bottom panel 41, which height is adjustable based on the data indicative for the measured height dimension. Furthermore, the top panel folder 86 is displaceable from and towards the supporting station 77 and in particular the control unit 62 is configured for displacing the top panel folder 86 in a direction from the sealing station 84 towards the supporting station 77 while the folding units 80-83 are displaced from the supporting station 77 towards the sealing station 84 for folding the top panel 50 into a position which is substantially parallel to the rectangular bottom panel 41, as will be described below.

The operation of the system 61 will be described with reference to FIGS. 4A to 4M in which an order of a customer comprises three items 67. The items 67 are first positioned on an input sub-conveyor (not-shown) and are then transported by the input conveyor 69 until the items 67 arrive at the last downstream sub-conveyor 69B where the conveyance of the items 67 is temporarily stopped. During the transport the measuring device 70A measures the width, length and height of all the items 67 together and sends data indicative for these dimensions to the control unit 62. The indicator 70C determines the number of items 67 present on the last sub-conveyor 69B and sends this information to the control unit 62. The control unit 62 compares the number of items present on the last downstream sub-conveyor 69B with the number of items belonging to the order of the customer and in case the numbers match then the control unit 62 activates the feeding conveyor 76 to transport blank material from the storage 75 and furthermore activates the blank forming apparatus 73 (which will be described in detail with regard to FIG. 6) for cutting and creasing blank material into a custom sized blank 40 as indicated in FIG. 2 during feeding of the blank material in feeding direction F.

The four folding units 80-83 are positioned at the supporting station 77 and the transverse distance w between the folding units of the front pair and rear pair is already adjusted to the measured width and thus also to the width W of the bottom panel. The longitudinal distance l between the front and rear pair is adjusted to an initial distance which can be smaller than the length of the bottom panel as determined on the measured length. Preferably, this initial distance is set to the smallest length dimension of bottom panels to be processed in the system.

During forming the custom sized blank the feeding conveyor 76 feeds the custom sized blank to the supporting station 77 such that the top end panel 53 is first transported over the folding units 80-83 and the rest of the blank follows. Based on the measured dimensions and the feeding speed of the feeding conveyor 76 the control unit 62 activates the front motor FM for the front folding units 82, 83 to start moving the front folding units 82, 83 in the direction of the sealing station and activates the suction cups of the folding units 82, 83 (the position as indicated in FIG. 3B) with such a timing that the suction cups of the front folding units 82, 83 grip the two respective corners of the bottom panel 41 during feeding of the blank by the feeding conveyor 76. The front folding units 82, 83 are accelerated to a speed matching the feeding speed of the feeding conveyor and thus the front folding units 82, 83 not only support the blank but also transport the blank together with the feeding conveyor. The rear folding units 80, 81 remain deactivated. Thus the control unit is configured for adjusting the longitudinal distance l during feeding of the blank into the supporting station by starting the displacement of the front folding units earlier than the displacement of the rear folding units.

Simultaneously, the control unit 62 activates the last downstream sub-conveyor 69B at such timing that the items are transported in horizontal direction onto the rectangular bottom panel supported at the supporting station such that the items 67 are positioned as close as possible to the folding line connecting the bottom panel 41 with the bottom end panel 44. In FIG. 7 a schematic side view in cross-section of a part of the S-bend 76A, the transfer strip 71 adjacent to the downstream end of the last downstream input sub-conveyor 69B, a connection piece 17' of one of the rear (deactivated) folding units and the blank 40 are shown at a moment during feeding of the blank 40 into the supporting station. In FIG. 7 it can be seen that the system is configured such that the transfer strip 71 lies in the extension of the last downstream input sub-conveyor 69B so that items 67 can be conveyed by means of the last downstream input sub-conveyor 69B horizontally onto and over the transfer strip 71 and onto the blank. The situation which is obtained at this moment and in which the top panel folder 86 is positioned in its start position is indicated in FIG. 4A.

The bottom panel is thus fed into the supporting station 77 such that a center line of the bottom panel in conveying direction is centered between the folding units of the front and rear pair and in addition the items are conveyed centralized.

Figure 4B:
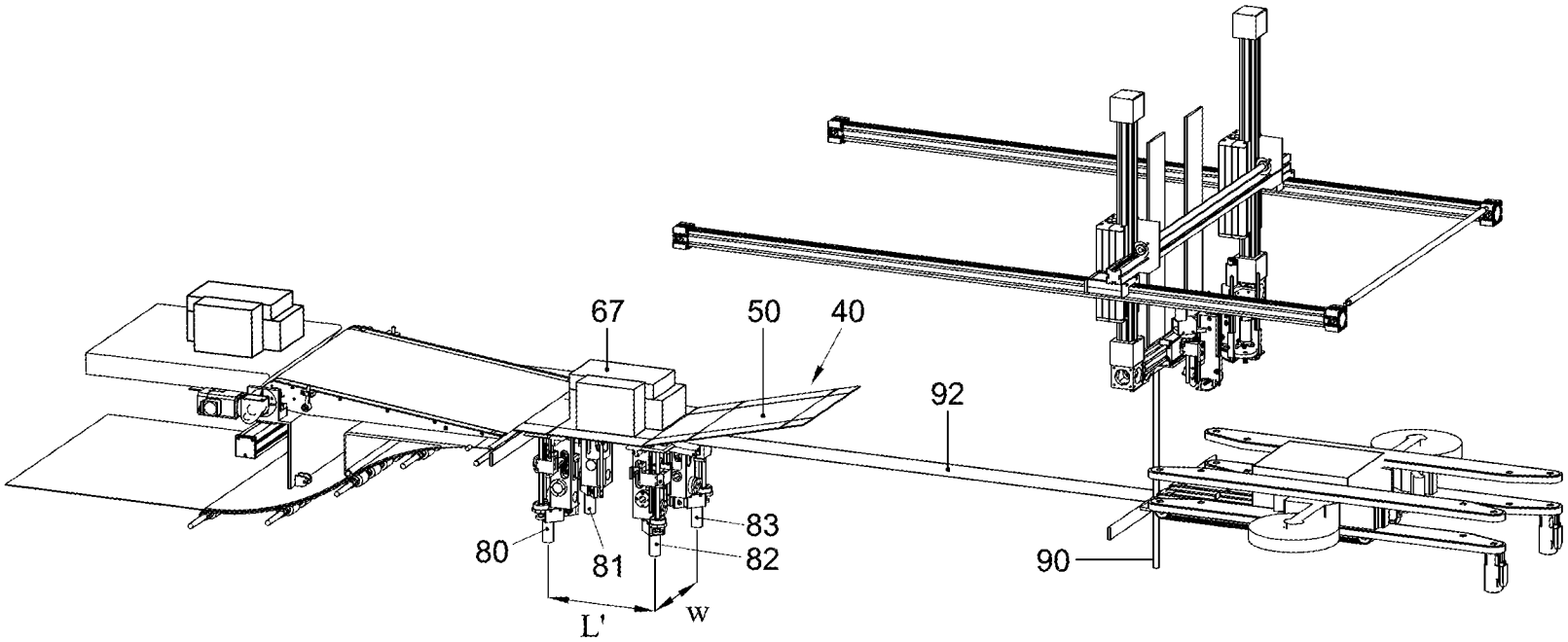
Figure 4C:
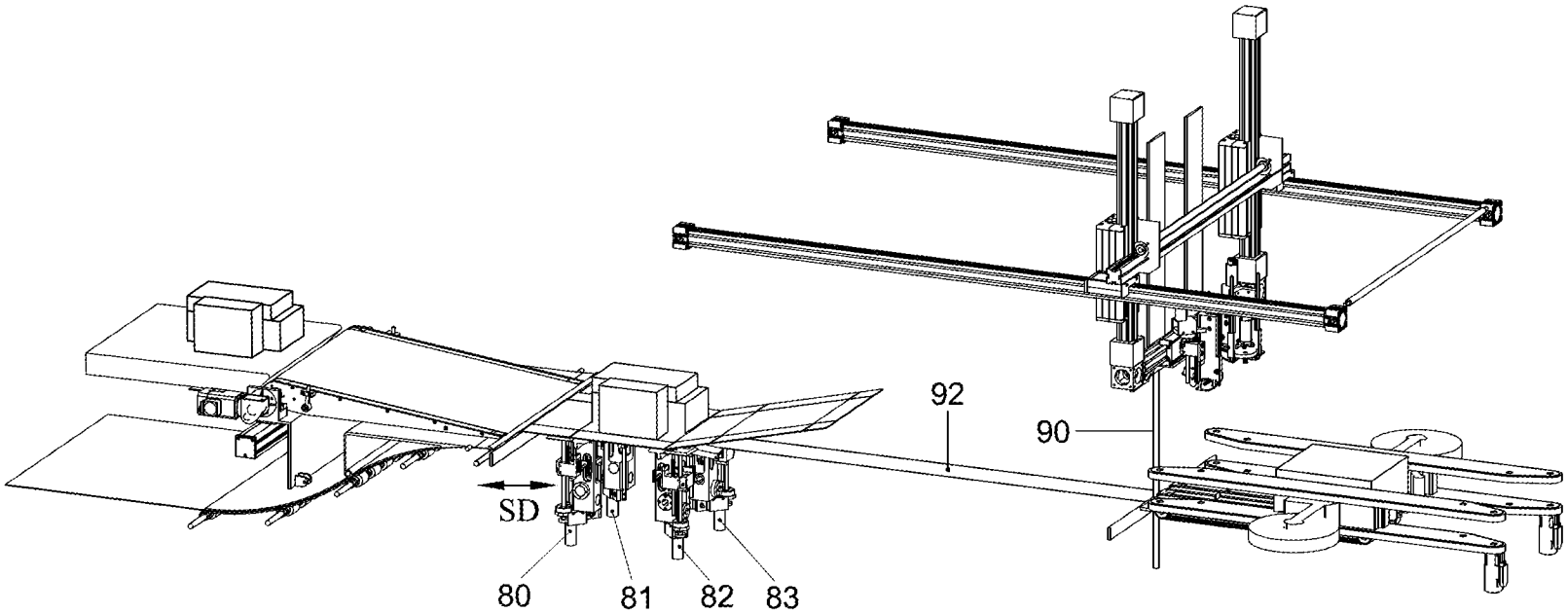
Figure 4D:
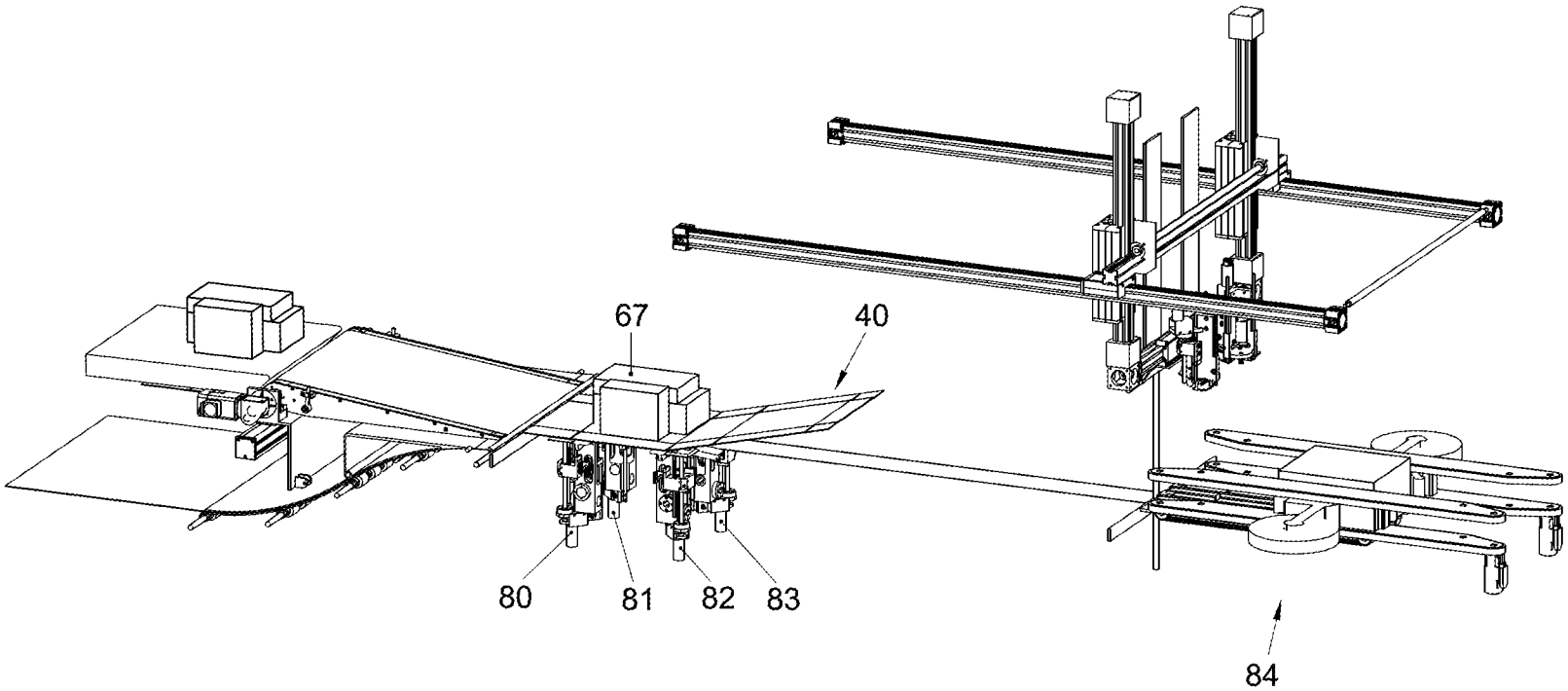
Figure 4E:
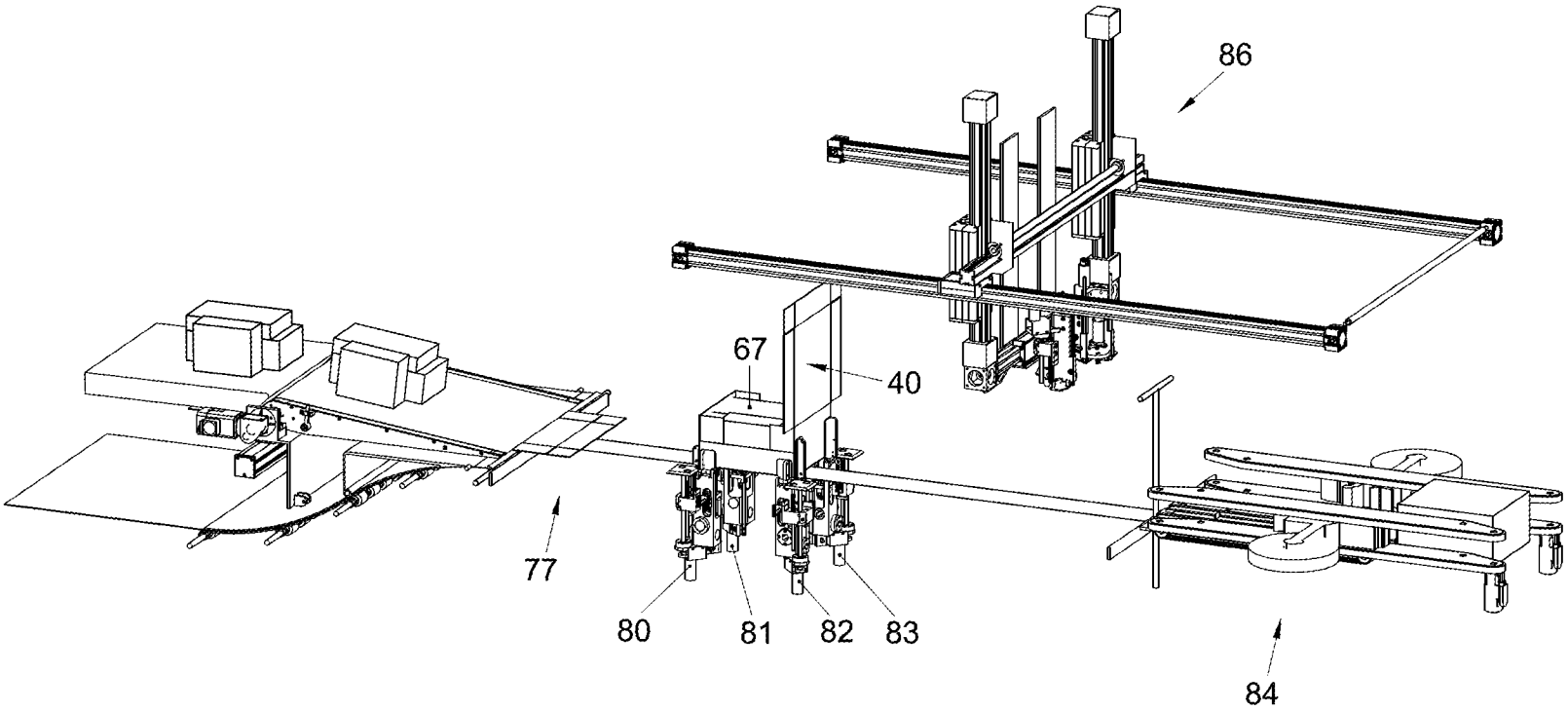

During further feeding of the blank and based on the measured length and the feeding speed of the feeding conveyor 76, the control unit 62 activates the rear motor RM for the rear folding units 80, 81 to start moving the rear folding units 80, 81 in the direction of the sealing station and activates the suction cups of the rear folding units 80, 81 (the position as indicated in FIG. 3B) with such a timing that the suction cups of the rear folding units 80, 81 grip the two respective corners of the bottom panel 41 during feeding of the blank by the feeding conveyor 76. To increase the processing speed the control unit can be configured for starting raising the suction cup substantially simultaneously with starting displacing the front pair of folding units towards the sealing station. The rear folding units 80, 81 are accelerated to a speed matching the speed of the front folding units 82, 83. This situation in which the suction cups of the rear folding units have just gripped the bottom panel is indicated in FIG. 4B in which it is indicated that the control unit 62 has timed the activation of the RM such that the distance L' between the front and rear folding units is such that the folding units support the respective corners of the bottom panel having a length L. In this position the front and rear folding units 80-83 fully support the blank and the blank is not supported or transported anymore by the feeding conveyor. The folding units thus not only function as a support for the blank but also as a transport means for the blank from the supporting station 77 to the sealing station 84. The feeding conveyor 76 which fed the blank into the supporting station without interruption of the feeding movement does not transport the blank anymore. As indicated in FIG. 4B the top panel 50 of the blank has been raised during the initial transport of the bottom panel from the supporting station towards the sealing station. Raising of the top panel 50 is effected by means of a top panel raiser 90 which is operatively controlled by the control unit 62 and which comprises a slanting belt 91 (see FIG. 5) extending from the supporting station to the sealing station. The slanting belt is not indicated in FIG. 4 for convenience of drawing, in addition the distance between the supporting station and sealing station has been somewhat extended in the FIGS. 4A-4M to more clearly indicate the distinct steps. A more realistic view of the scales is shown in FIGS. 5A, 5B. Please note, that the slanting belt functions as a support for the top panel and prevents it from unwantedly bending downwards along the respective folding line.

Also indicated in FIGS. 4A-4M is an additional supporting element 92 which is positioned centrally between the folding units of the front and rear pair and which extends between the supporting station and the sealing station. The supporting element 92 can comprise a central stationary element 92A (FIG. 5A) and a pair of side supporting elements 92B, 92C each at either side of the central stationary element 92. The side support elements 92B, 92C are suspended such that the distance between them is adjustable under control of the control unit 62 based on data indicative for the measured width dimension to ensure proper support for heavier articles 67.

Please note that up to now the folding elements of the folding units 80-83 have not been activated and may preferably be only activated after all the suction cups have gripped the bottom panel in order to ensure a correct folding. In addition, to be sure that the end panel 45 has left the feeding conveyor before folding of this panel upwardly is started the control unit 62 first displaces all the folding units over a safety distance SD towards the sealing station 84 before it activates the folding elements. This safety distance can be dependent on the measured length and height dimensions. In FIG. 4C the situation is indicated in which the folding units have just reached this safety distance SD and at this moment the control unit 62 is going to activate the folding elements in the same manner as described with reference to FIG. 3.

During further displacement of the folding units 80-83 supporting the blank 40 and the items 67 supported thereon in conveying direction towards the sealing station 84 the folding units are activated such that the folding elements fold corner, side and end panels of the custom sized blank upwardly in the same manner as described with reference to FIGS. 2 and 3. In FIGS. 4D and 4E folding of the panels upwardly is indicated schematically. Please note, that also in this system 61 the folding units 80-83 are suspended to move freely in a horizontal plane in order to be able to follow possible transverse movements of the rectangular bottom panel during folding of the panels. In addition as indicated in FIG. 4E the top panel folder has been activated by the control unit to move in a direction towards the supporting station 77.

Figure 4F:
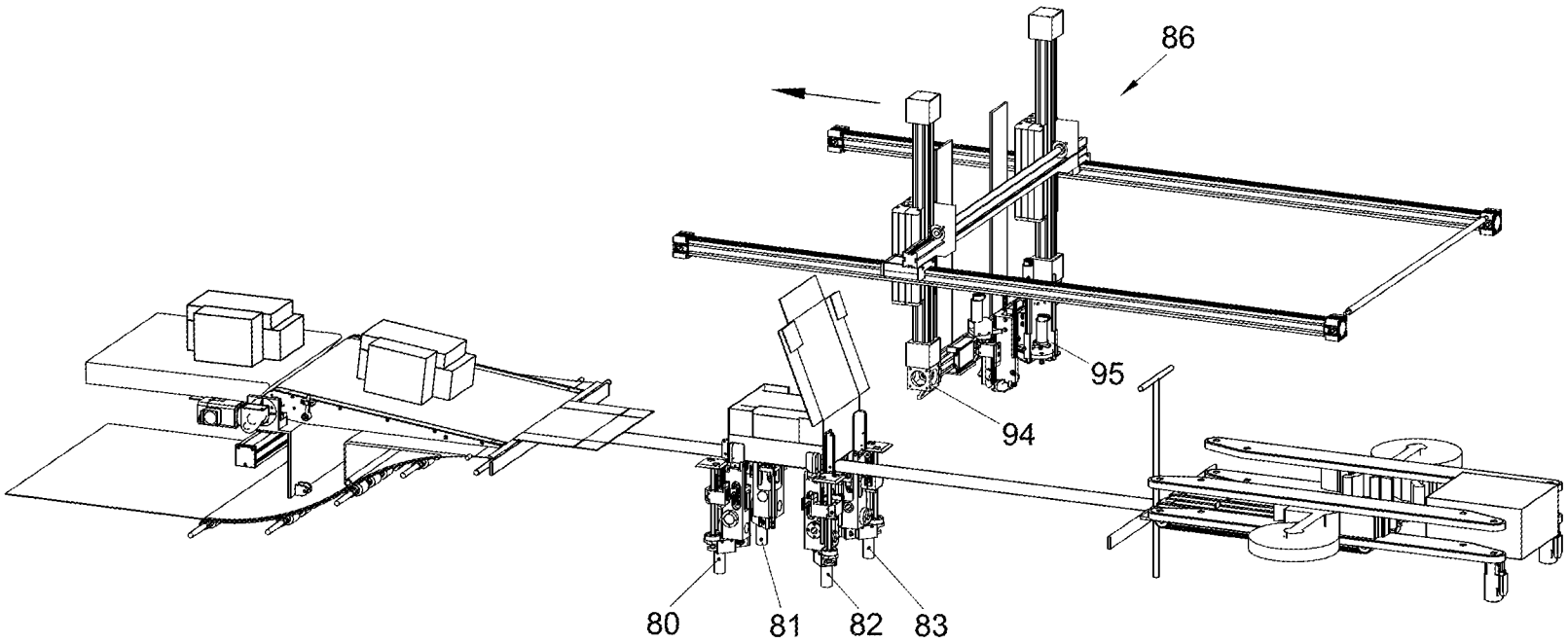
Figure 5A:
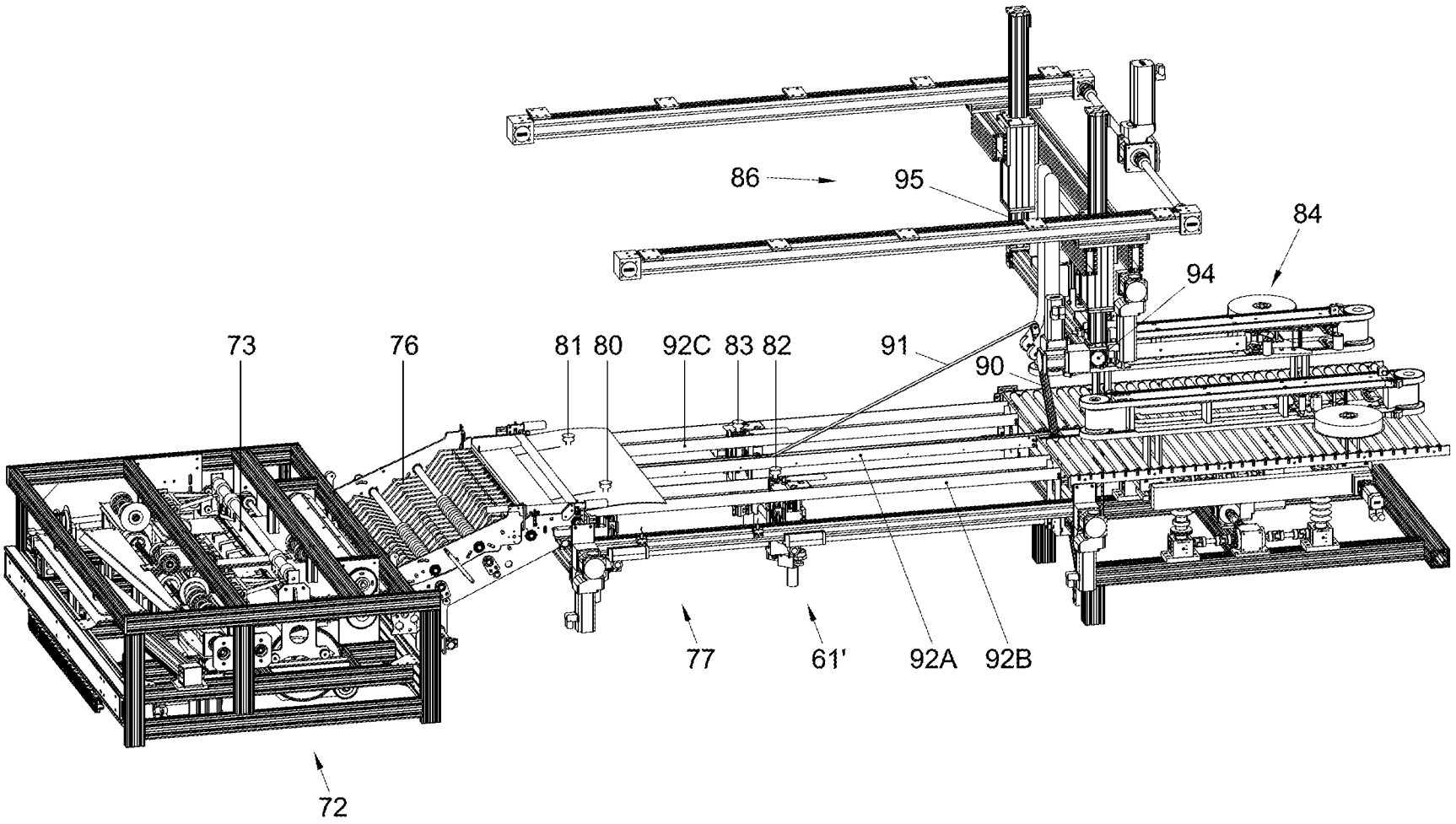
FIGS. 5A and 5B schematically show top views in perspective of an embodiment of a system 61' for packaging items in a box and for packaging the items therein simultaneously with the formation of said packaging box wherein during folding of the box the blank material can be either transported or remain stationary.
Figure 5B:
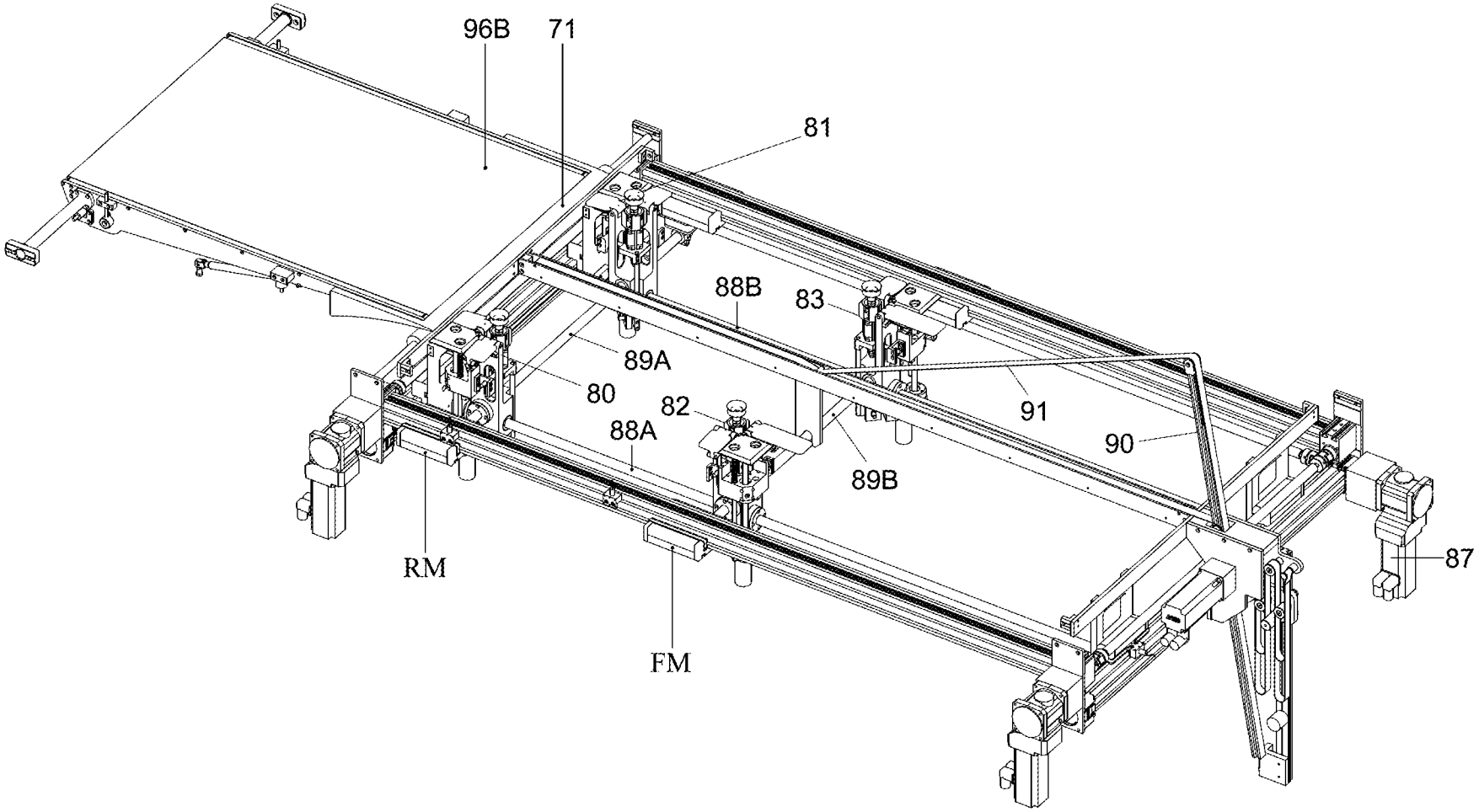

In FIG. 4F the situation is shown in which the top panel folder 86 has been transported over such a distance in the direction towards the folding units and the top panel that top panel guides 93 (for convenience of drawing not shown in FIG. 4F but indicated in FIG. 8) have come into contact with the top panel 50 and have taken over the support thereof as provided by the slanting belt. Please note, that based on the measured dimensions and the transport speed of the blank the control unit 62 controls the upward movement of the top panel raiser 90 and movement of the top panel folder 86 towards the supporting station such that the top panel has reached a sufficient height to enable the top panel guides 93 to engage the top panel correctly. This ensures further folding the top panel 50 over the bottom panel 41 and the articles positioned thereon. The top panel folder 86 is in this embodiment linearly moveable along a rail construction 186, 286 (see FIG. 4I).

Figure 4G:
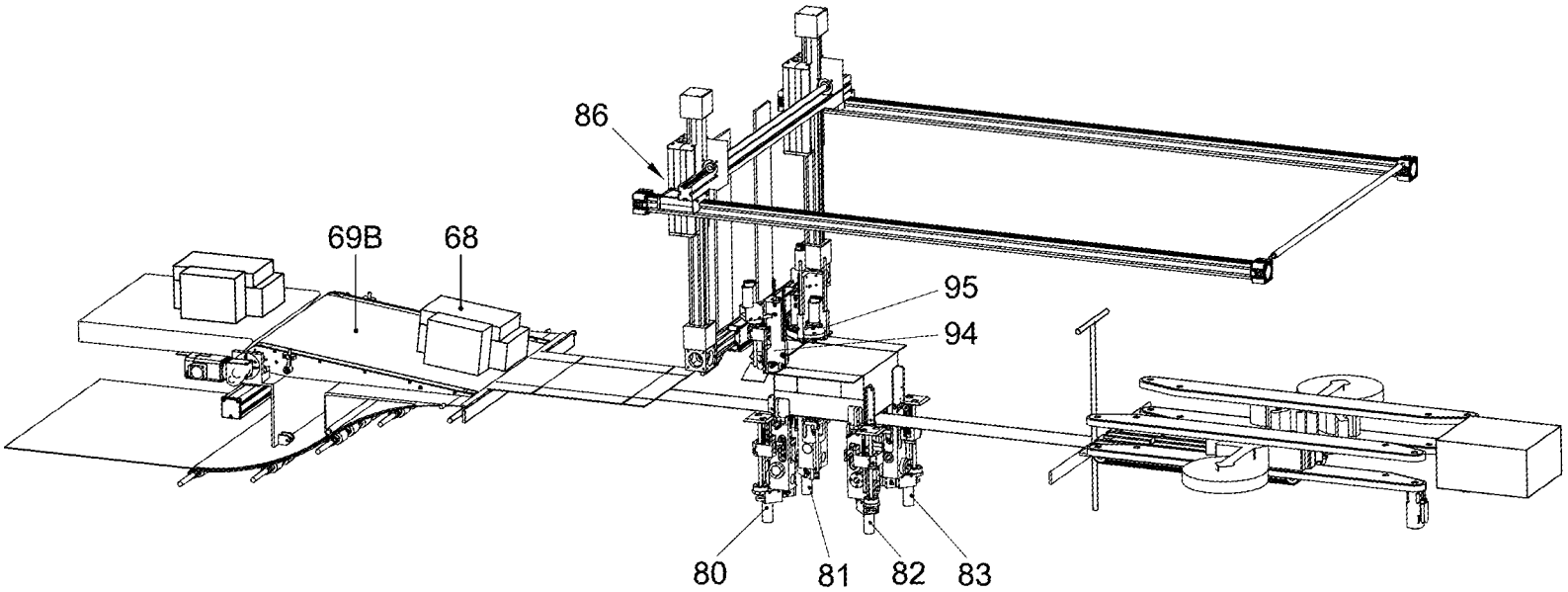

The top panel guides 93 can be mounted pivotally on the top panel folder 86. During further transport of the top panel folder in the direction of the supporting station and further transport of the folding units towards the sealing station the top panel will be folded into a horizontal position as shown in FIG. 4G. At this position a pair of top folding units 94, 95 of the top panel folder 86, which top folding units 94, 95 are suspended to be displaceable with respect to one another under control of the control unit 62 for adjusting a top transverse distance there between based on the data indicative for the measured width dimension, are lowered to come into contact with respective corners of the top panel 50. These top folding units 94, 95 are described in more detail with reference to FIG. 9. At least substantially at the same moment that the top folding units 94, 95 make contact with the top panel the control unit reverses the movement of the top panel folder 86 such that it moves synchronously with the movement of the folding units 80-83 supporting the bottom panel and the items. In the meantime the next items 68 to be packaged have arrived at the last downstream input sub-conveyor 69B.

Figure 4H:
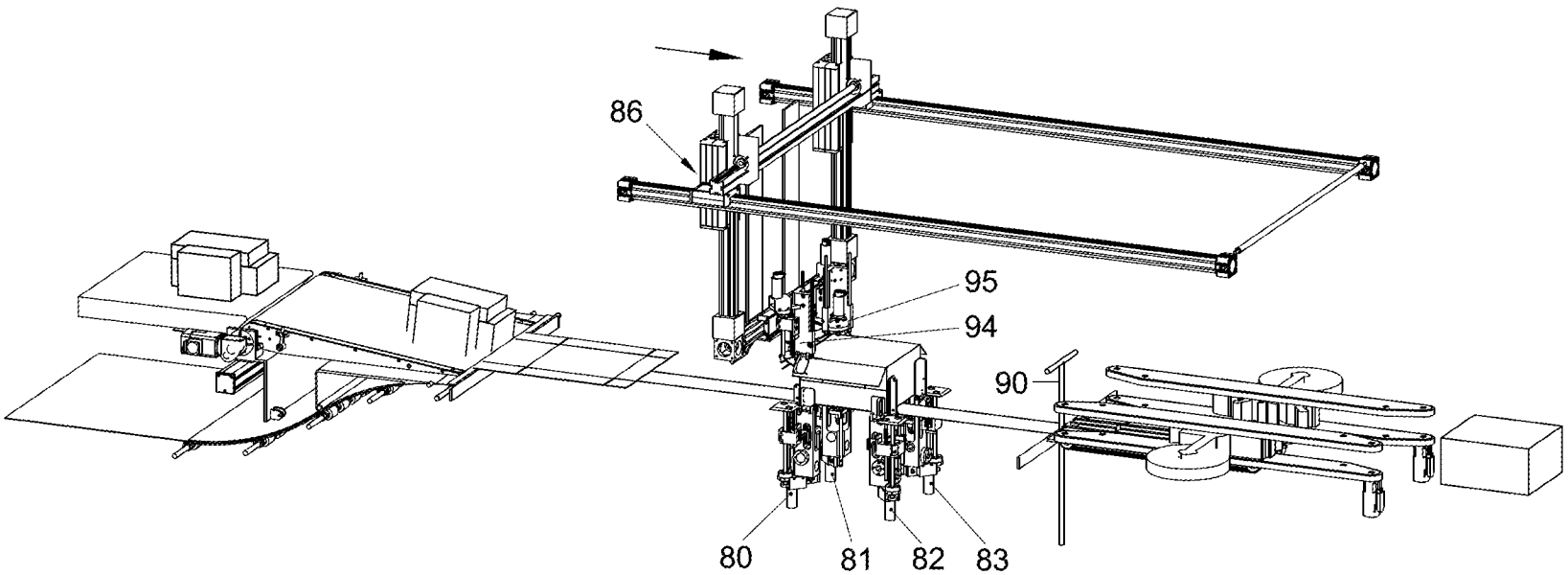
Figure 41:
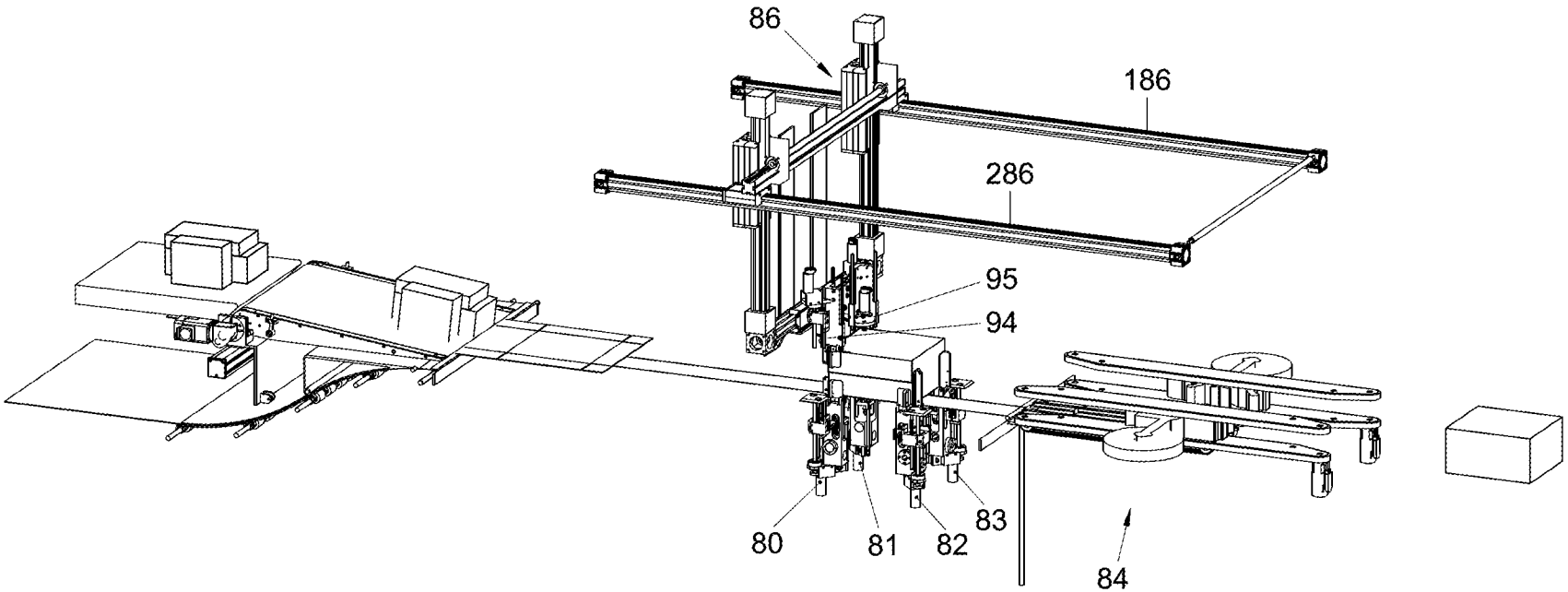

Thereafter the control unit 62 activates the top folding units 94, 95 for folding down top corner panels 54, 55, top side panels 51, 52 and a top end panel 53 as indicated in FIG. 4H. In addition, the control unit 62 lowers the top panel raiser 90.

During further transport towards the sealing station 84 the top corner, end and side panels are completely folded downwards and the top panel raiser has been completely lowered, as indicated in FIG. 4I.

Figure 4J:
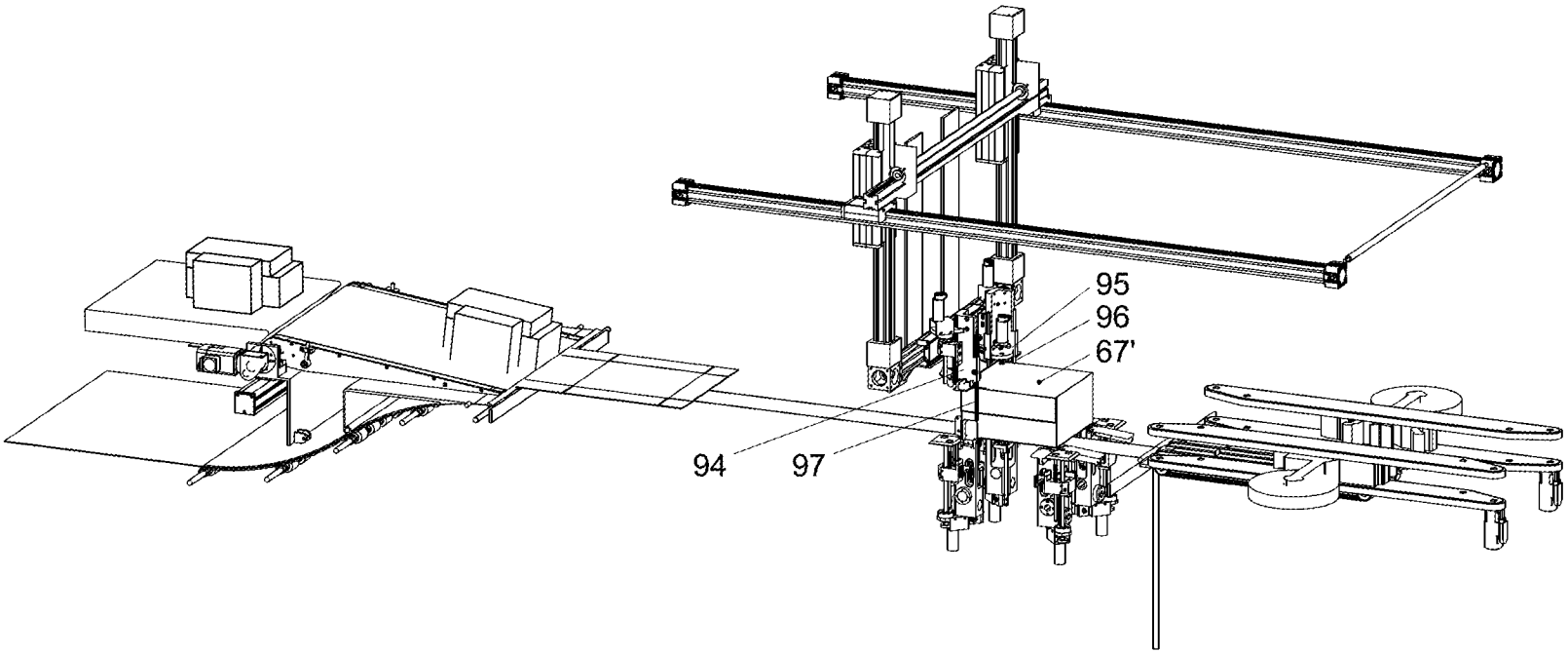

The top folding units 94, 95 are provided with controllable rods 96, 97 and 98, 99 (see also FIG. 9A) which are activated, i.e., lowered, under control of the control unit 62 after the box is completely folded as shown in FIG. 4J. The rods 98 and 99 engage the side surfaces of the box, whereas the rods 96, 97 engage the rear surface of the box, i.e., the surface which is directed towards the sealing station. To ensure proper engagement of the rods 96-99 with the box the top folding units 94, 95 can be displaced a little distance towards one another under control of the control unit 62. The rods 96-99 keep the box 67' in shape and prevent recoiling of the panels of the blank.

The control unit 62 is thus configured for activating the suction cups of flexible material into the operative mode such that they grip the bottom panel at respective gripping position at its underside before corner, side and end panels of said custom sized blank are folded upwards. Furthermore, the control unit is configured for keeping the suction cups gripping element in the operative mode at least until folding of corner, side and end panels of the custom sized blank upwardly has been completed, but preferably until also top corner, top side and top end panels have been completely folded downwards.

Figure 4K:
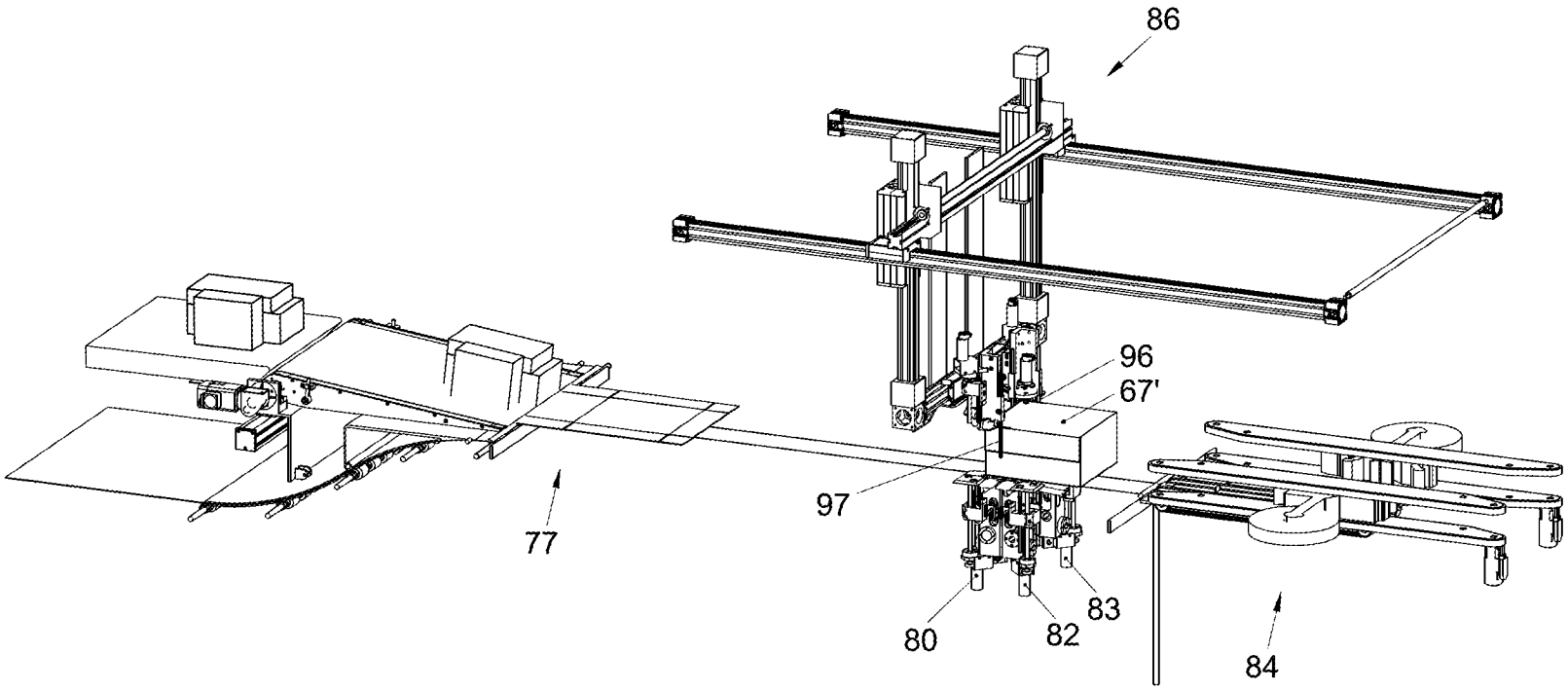
Figure 4L:
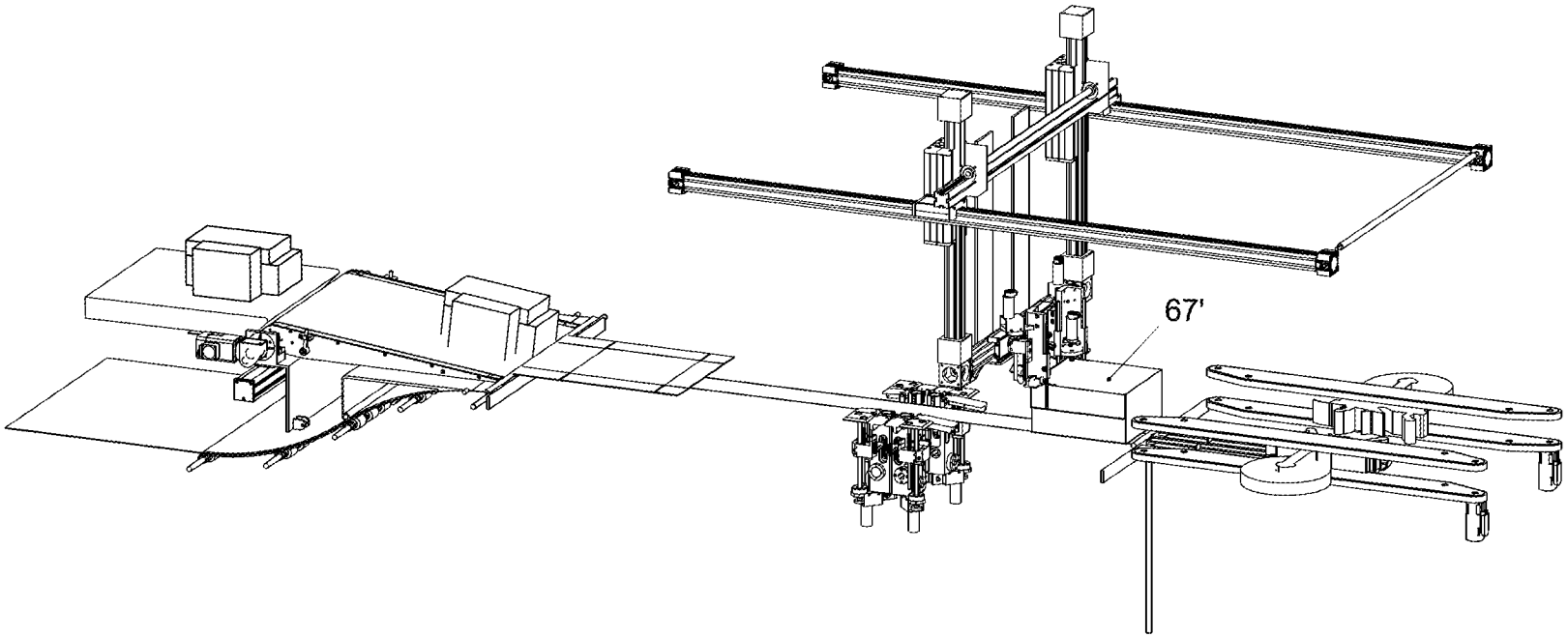
Figure 4M:
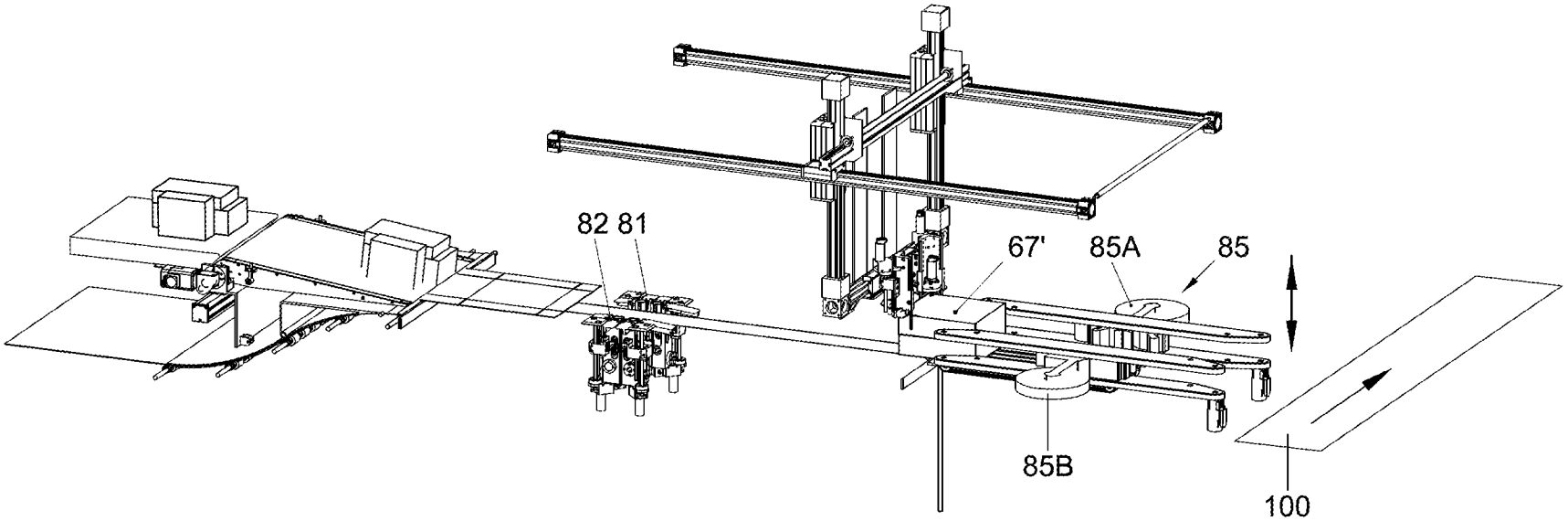

After the rods 96-99 have been put into engagement with the box, the suction cups of the folding units 80-83 are deactivated for releasing the bottom panel and the rear and front motors of the four folding units are controlled by the control unit 62 such as to reverse to movement of the folding unit to return them to the supporting station 77, as indicated in FIG. 4K where the next custom sized blank is already waiting. The transport of the box 67' towards and into the sealing station is then completed by the movement of the top panel folder and the rods 96-99, as indicated in FIG. 4M. To increase system capacity the control unit 62 activates the transverse motor 87 for adjusting the transverse distance between folding units 80-83 during displacement of the folding units in a direction from the sealing station back to the supporting station. In addition, the front motor FM and the rear motor RM can be activated independently to adjust the relative positioning of the rear and front folding units, preferably to the initial distance which can be used at the supporting station 77. Please note, that the top panel folder 86 with rods 96-99 described here can also be used in the folding system of FIG. 1 in which the box remains stationary during folding not only to fold the top panels but also for discharging the box from the supporting station 7 thereof.

In the meantime at the sealing station 77 the seal applicator 85 comprising seal applicator units 85A, 85B which are displaceable in height and in transverse distance away from and towards each other has applied the sealing tape 74 (FIG. 2G) around the box and the sealed box 67' is discharged via a discharge conveyor 100. The control unit 62 controls the displacement of the seal applicator units 85A, 85B based on the data indicative for the measured length, width and height dimensions such that the tape is applied on the box 67' at the correct level.

In FIG. 5A a system 61' for automatically forming packaging boxes and for packaging items therein, in this embodiment simultaneously with the formation of packaging boxes as described with reference to FIGS. 4A-4M is shown in which the scale of drawing is more realistic. In addition the control unit of this system 61' can be configured to either fold the box during transport of the blank material as described with reference to FIG. 4 or to fold the box while the blank material remains stationary. In the latter case the top folding units 94, 95 are displaceable to above the rear folding units 80, 81. The input conveyor is left out in FIG. 5A so that the blank cutting station 72 with the blank forming apparatus 73 is visible as well as the feeding conveyor 76. As can be seen the slanting belt 91 can already be raised by the top panel raiser 90 to support the top panel after the moment front suction cups of folding elements 82, 83 have been activated. Furthermore, it can be seen that the system 61 is quite compact in length and the top folding units 94, 95 of the top panel folder 86 can be displaced to a position above the rear folding units 80, 81. As mentioned above the system 61' can thus operate in two operation modes under control of the control unit. One operation mode in which the custom sized blank is gripped and transported from the supporting station 77 towards the sealing station 84 by the folding units 80-83, wherein during said transport the panels of the blank are folded and the other operation mode in which the custom sized blank is gripped by the folding units but is not supported towards the sealing station but remains at the supporting station. Folding of the blank then occurs correspondingly to the folding as described with reference to FIGS. 1-3 wherein the top panel folder 86 is activated to move in a direction from the sealing station to the supporting station to fold the top panel and the top folding units are activated to fold the top corner, end and side panels. After folding has been completed the rods 96-99 of the top folding units are activated to engage the box and the top panel folder 86 is moved from the supporting station to the sealing station to discharge the folded box from the supporting station into the sealing station. Please note, that activation of the top folding units can take place during movement of the top panel folder towards the sealing station.

In FIG. 5B, which has already been described above, a top view of FIG. 5A seen from above the top panel folder is shown. In this FIG. 5B the top panel folder has been left out as well as the additional supports 92A-92C to more clearly depict the connection of the front and rear folding units 80-83 which are coupled by means of sliding rods 88A, 88B and 89A, 89B such that by means of a single transverse motor 87 relative transverse displacement of the folding units is allowed by means of a sliding engagement of the sliding rods or bars and the connection pieces of the folding units. In addition, FIG. 5B shows that the last downstream input sub-conveyor 69 and the transfer strip 71 are positioned closely adjacent to each other as is also indicated in FIG. 7.

In FIGS. 6A-6F the blank forming apparatus 73 of the system 61 will be described in more detail. Since this blank forming apparatus 73 and the control unit 62 can be configured for performing cutting and creasing blank material into a custom sized blank based on the data indicative for the measured dimensions during feeding of the blank material in feeding direction the production capacity of the system 61 can be increased.

Although the blank forming apparatus 73 is in particular suitable to be used in said system 61, it might also be advantageously used in combination with the system 1 as described with reference to FIG. 1 and be controlled by the control unit 2 thereof. Custom sized blanks which are produced can then be transported by the feeding conveyor 8 towards the supporting station. In addition the blank forming apparatus 73 can be used autonomously.

Figure 6A:
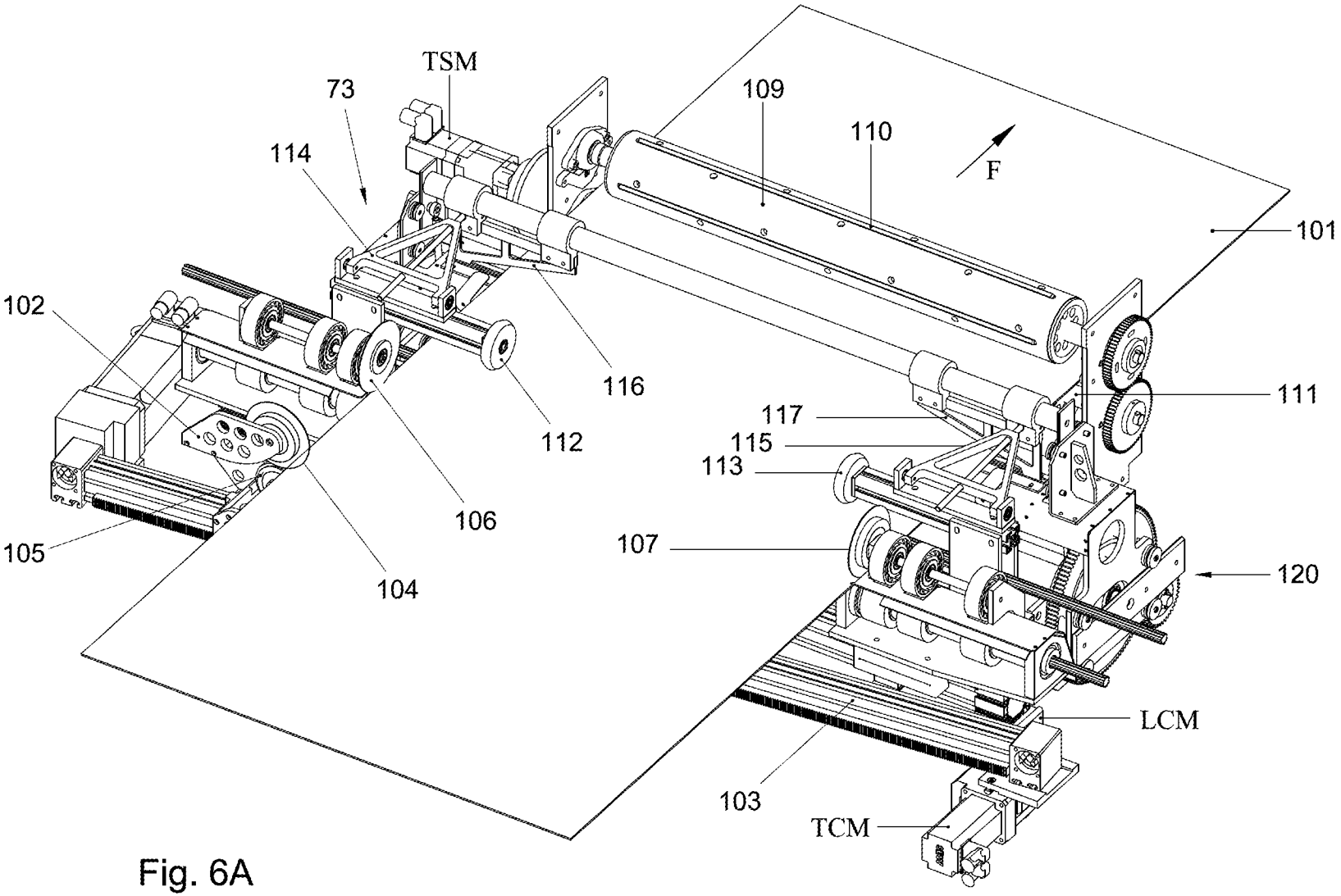
FIGS. 6A to 6F schematically shows views in perspective of a blank forming apparatus 73 for cutting and creasing blank material into custom sized blanks which apparatus 73 can be used autonomously or in combination with any one of the systems 1, 61, 61' shown in FIGS. 1, 4 and 5, respectively.
Figure 6B:
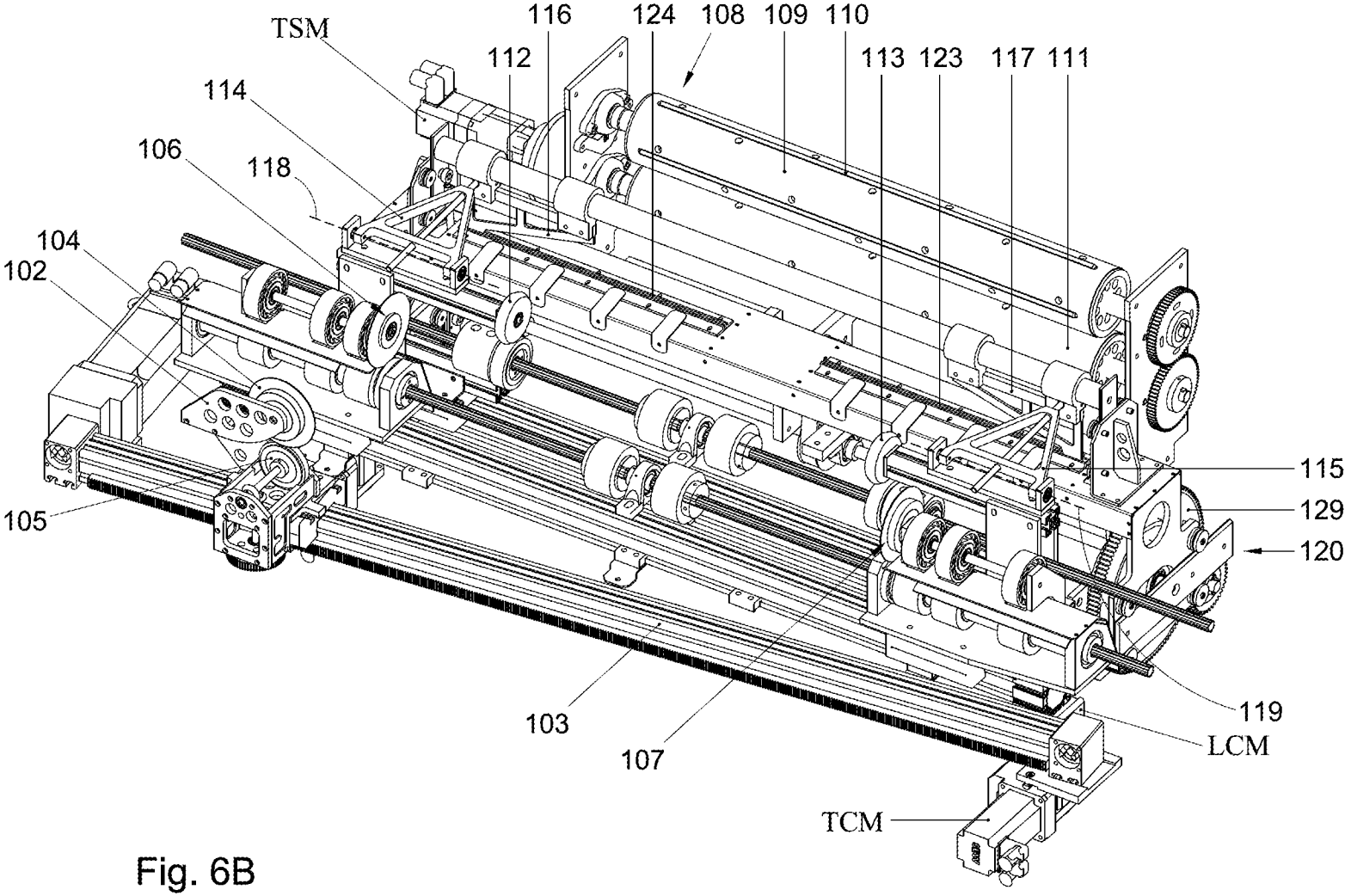
Figure 6C:
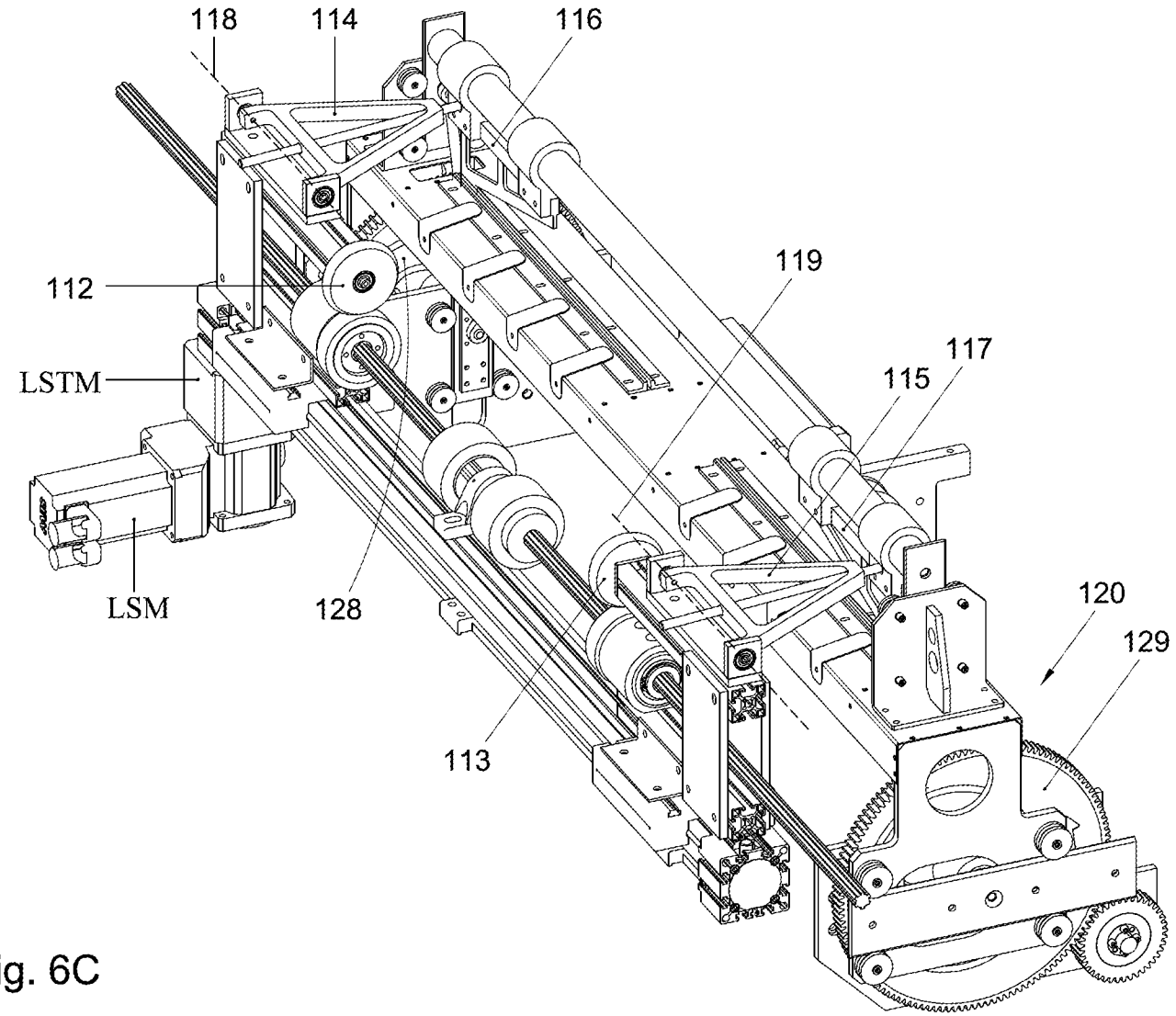
Figure 6D:
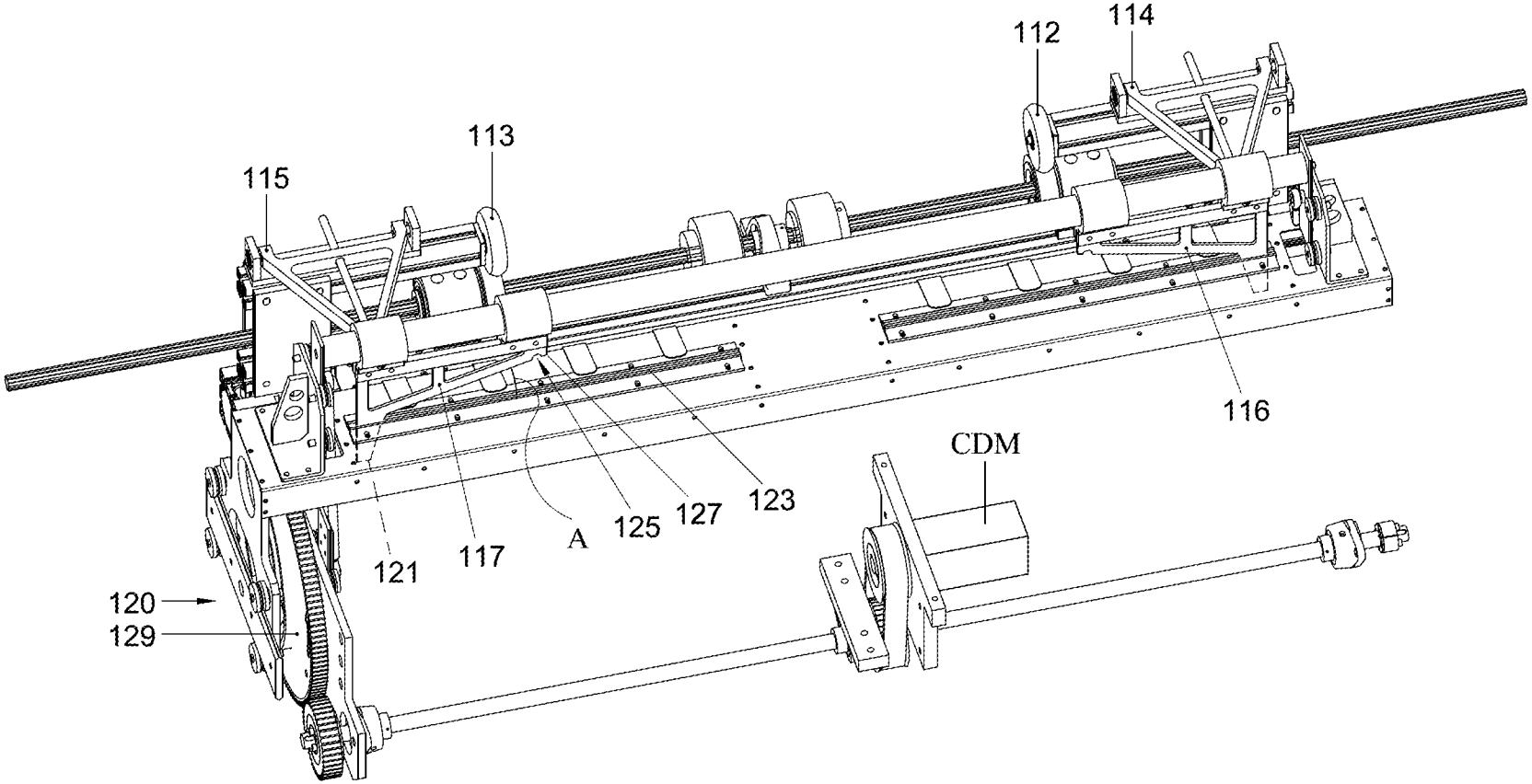

In FIG. 6A a top view in perspective of the blank forming apparatus 73 is shown in which blank material 101 is fed through the blank forming apparatus to indicate the position of the constituting parts relative to each other more clearly. In FIG. 6B the same view is shown but now with the blank material left out to more clearly show the lower parts of the blank forming apparatus 73.

The blank forming apparatus 73 comprises a single transverse cutter 102 for cutting blank material to length for a custom sized blank. The single transverse cutter 102 is suspended to be movable along a line or guide 103 which is positioned at an angle with respect to the feeding direction F of the blank material 101. The control unit 2, 62 is configured to control the movement of the single transverse cutter 102 by means of motor TCM along the line 103 and the feeding speed of the feeding conveyor such that the cutter 102 forms a cutting line in the blank material which is transverse to the feeding direction, i.e., which is perpendicular to the side edge of the blank material. The single transverse cutter 102 can comprise a rotatable knife 104 and a counter roller 105.

Although in embodiments the blank forming apparatus can comprise a single longitudinal cutter for cutting the custom sized blank to width the blank forming apparatus 73 shown in FIG. 6A comprises a pair of longitudinal cutters 106, 107 for cutting the blank material to width for the custom sized blank. The transverse distance between the pair of longitudinal cutters 106, 107 is adjustable by means of a motor LCM under control of the control unit 2, 62 based on the data indicative for the measured width and height dimensions. The longitudinal cutters 106, 107 can each comprise a rotatable knife and a counter roller.

The blank forming apparatus 73 furthermore comprises a single transverse score applicator 108 for applying transverse score lines as transverse folding lines to the blank material 101 between respective panels. The transverse score applicator 108 comprises an upper transverse score roller 109 with score ridges 110 and a lower counter score roller 111 optionally also provided with score ridges. A score ridge can be formed of a single ridge or multiple ridges closely spaced next to each other in order to form multiple score lines closely spaced next to each other. Rotation of the rollers 109, 111 is effected by means of a motor TSM under control of the control unit 2, 62 based on data indicative for the measured dimensions and the feeding speed of the blank material.

A pair of longitudinal score applicators 112, 113 (see also FIGS. 6C-6F) is provided for applying longitudinal score lines as longitudinal folding lines to the blank material 101. The longitudinal score applicators 112, 113 are suspended to be displaceable downwards by means of a motor LSM under control of the control unit 2, 62. The transverse distance between the longitudinal score applicators 112, 113 is adjustable by means of a motor LSTM under control of the control unit 2, 62 based on the data indicative of the measured width. Each longitudinal score applicator comprises an upper rotatable element 113A and a lower rotating counter element 1138 (see FIG. 6E). Each of the pair of upper longitudinal score applicators 112, 113 comprises a coupling 114, 115 for realizing a mechanically coupling to a respective cut-out knife 116, 117. The cut-out knives 116, 117 belong to a cutting-out device 120 which is configured to displace the cut-out knives 116, 117 downwards for forming the cut-outs between corner panels and adjoining side panels of the custom sized blank. Due to the couplings 114, 115 the transverse distance between the opposite cut-out knives 116, 117 is adjustable simultaneously with the adjustment of the longitudinal score applicators 112, 113 and thus this transverse distance is adjustable based on the data indicative for the measured width.

The couplings 114, 115 are configured for allowing a vertical movement of a cut-out knife 116, 117 relative to a respective longitudinal score applicator 112, 113, which is realized in the embodiment shown in FIG. 6 in that the couplings 114, 115 are pivotally mounted around pivot axes 118, 119 which lie in each other's extension. The couplings 114, 115 are in this embodiment formed by an A-frame.

Each cut-out knife 116, 117 comprise an extension 121 (only shown for cut-out knife 117 in FIG. 6D) which is in engagement with a lower transverse guide 123, 124. Due to the couplings 114, 115 and to the lower transverse guides 123, 124 the frame for mounting the cut-out knives 116, 117 can be realized by means of a light-weight construction. This can furthermore be promoted by providing cut-out knives with an extremely effective cutting operation. In the embodiment shown, this cutting operation is surprisingly effective in case the angle A (FIG. 6D) between the cutting edge and a horizontal line is approximately 15° and the free end of the cut-out knife is provided with an indentation 125 so that a sharp cutting projection 127 is formed on the free end of the cut-out knife 117.

Figure 6E:
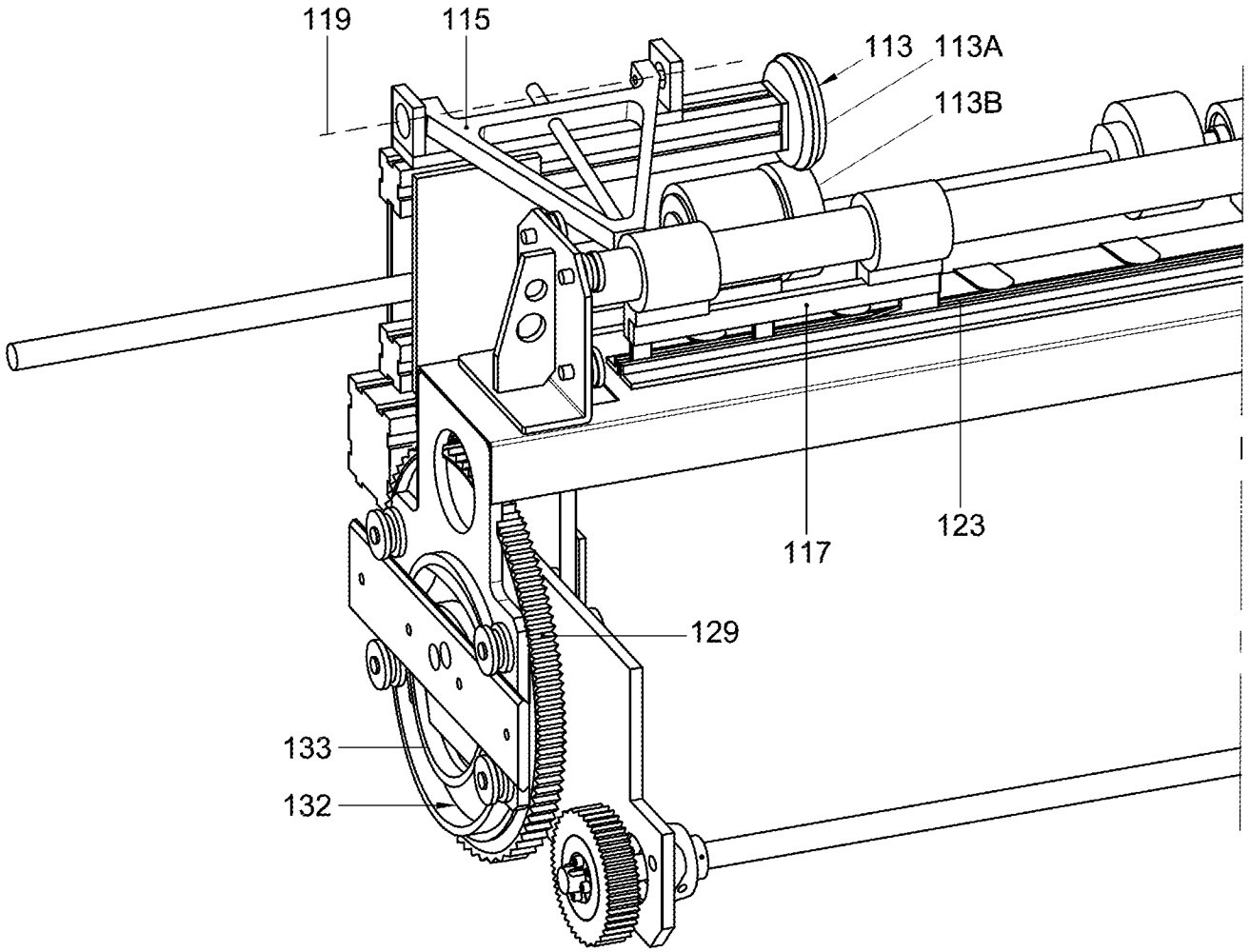
Figure 6F:
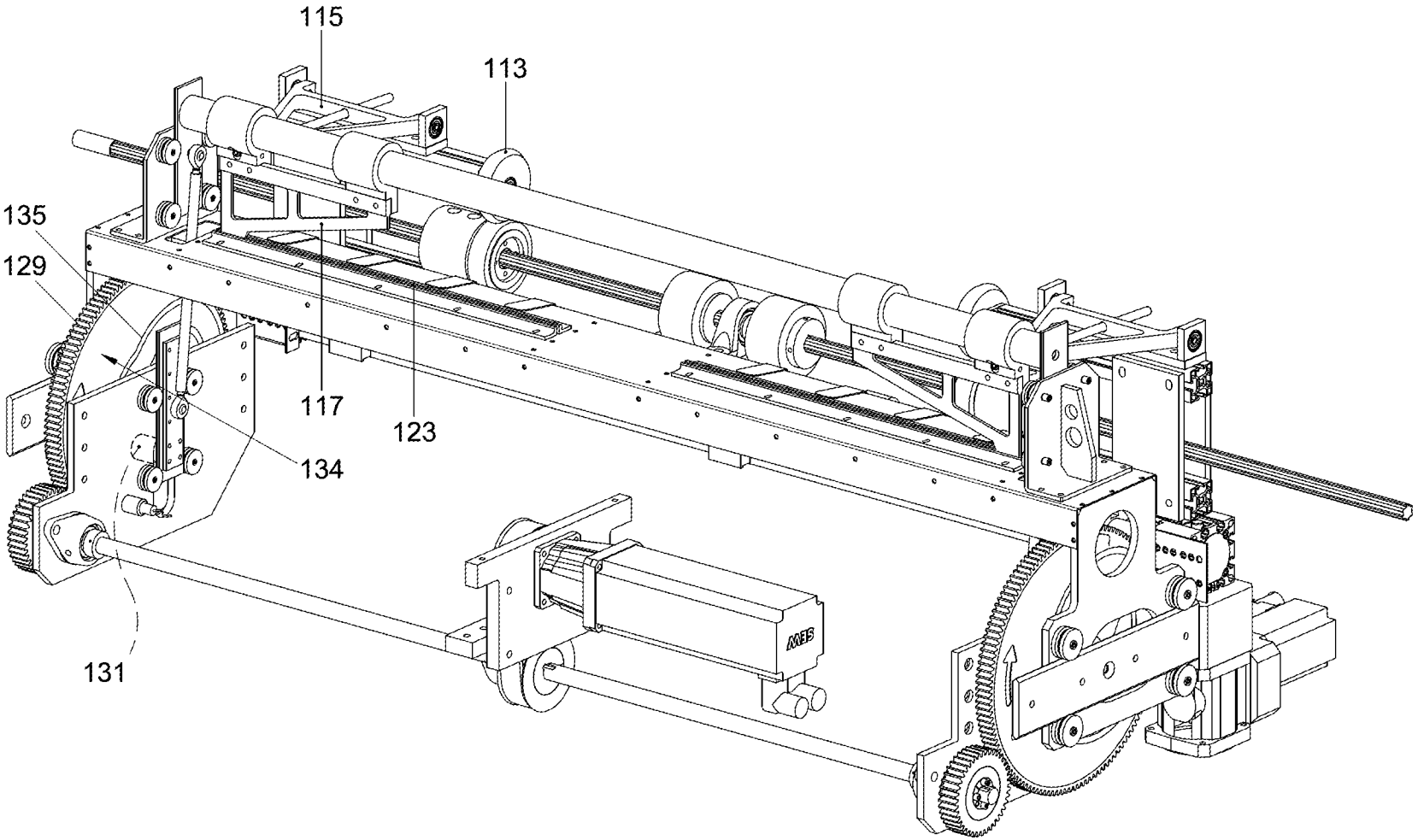

The cutting-out device 120 is suspended so as to be displaceable from an inactive position in which the cut-out knives 116, 117 are raised (FIG. 6D) to an active position downstream of the inactive position synchronously with the feeding speed of the blank material in feeding direction. In this active position the cut-out knives 116, 117 are still raised but are present at a position in which they can be lowered at a relatively high vertical speed such that they can be almost instantly positioned into the cutting position as shown in FIG. 6E. During lowering the cut-out knives 116, 117 into the cutting position the cut-out knives can in addition move in feeding direction. The control unit 2, 62 and the cutting-out device 120 are configured such that the active position, the vertical lowering speed and the optional horizontal speed are such that the cut-outs are provided in the correct position on the blank material, i.e., in line with respective transverse folding lines to be applied by the transverse score line applicator 109.

In the embodiment shown in FIG. 6 the cutting-out device comprises a pair of cam discs 128, 129 each cooperating with cam followers 131 (shown in FIG. 6F for cam disc 129) of a respective cut-out knife 117. Each cam disc 128, 129 comprises an outer surface 132 with an outer cam track 133 and an inner surface 134 provided with an inner cam track 135. In the shown embodiment, the outer cam track 133 controls the movement of the cutting-out device from the inactive position to the active position and vice versa in feeding direction and the inner cam track 135 controls the downward and upward movement of the cut-out knives. In particular, the outer cam track 133 is configured such that the cutting-out device 120 comprises the cut-out knives 116, 117 are displaceable in a direction opposite the feeding direction from the active position to the inactive position at a higher speed than the feeding speed of the blank material, which ensures a high production capacity of the blank forming apparatus since the feeding speed of blank material can be increased while it is still possible to provide the necessary plurality of cut-outs with only one cutting-out device 120. The cam discs 128, 129 are driven by a cam disc motor CDM (FIG. 6D) under control of the control unit 2, 62.

Although it is possible to configure the control unit 2, 62 such that it is possible to produce blanks with different kinds of shapes and panels, the blank forming apparatus can be used in a particularly advantageous manner for, under control of the control unit, cutting and creasing blank material into a custom sized blank having a rectangular bottom panel having a center line substantially parallel to the feeding direction, rectangular side panels and rectangular end panels joined to the bottom panel, rectangular corner panels joined to the end panels, a rectangular top panel joined to one of the end panels, rectangular top side panels joined to the top panel, a rectangular top end panel joined to the top panel and rectangular top corner panels joined to the top end panel, having score lines between the rectangular bottom panel, the rectangular side panels, the rectangular end panels and the rectangular top panel and having cut-outs in line with respective transverse score lines between the corner panels and the adjoining side panels provided by the cutting-out device 120 of the blank forming apparatus.

Figure 8:
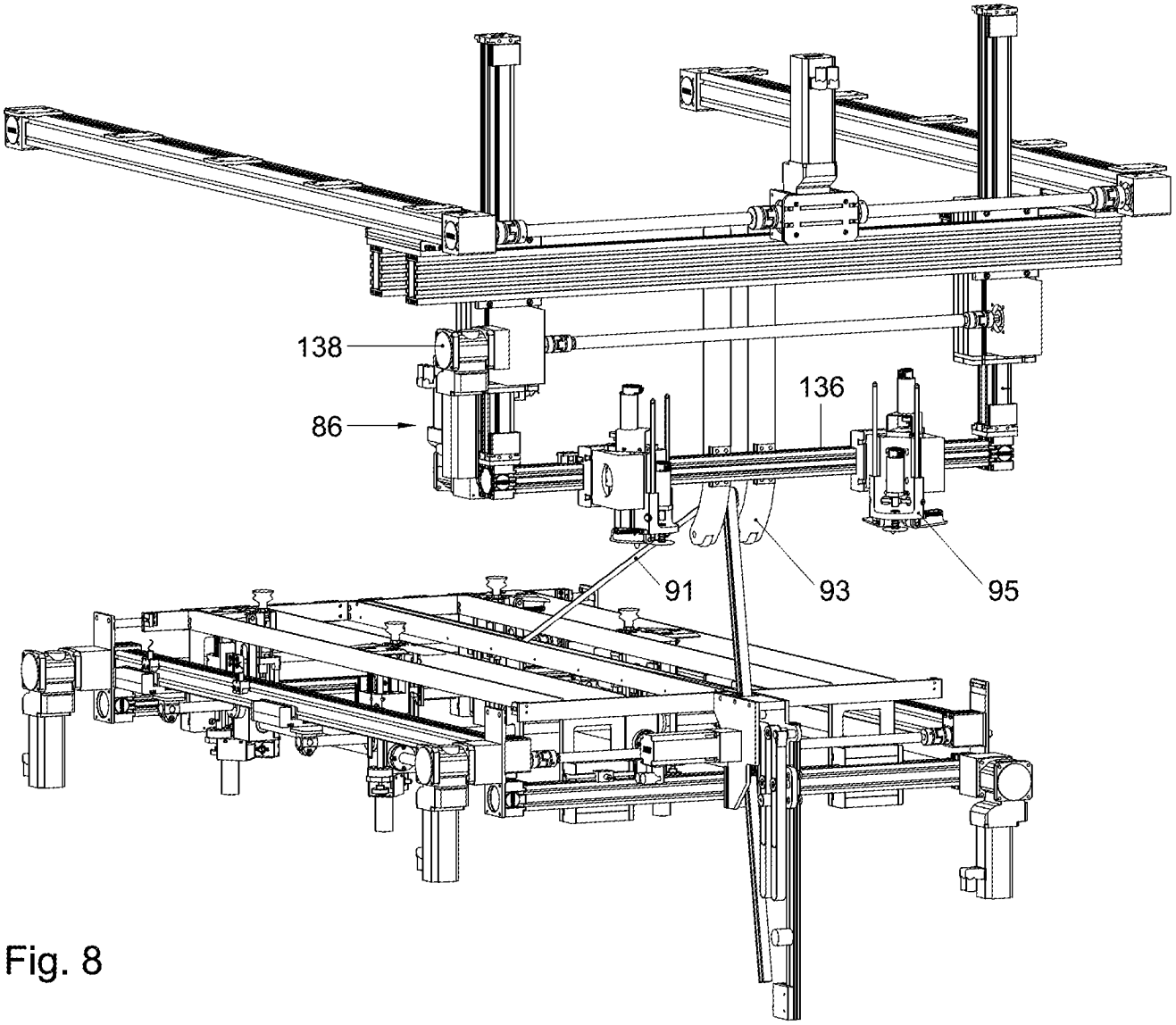
FIG. 8 shows a schematic view in perspective of a top panel folder 86 with slanting belt which top panel folder 86 can be used autonomously or in combination with any one of the systems 1, 61, 61' shown in FIGS. 1, 4 and 5, respectively.
Figure 9A:
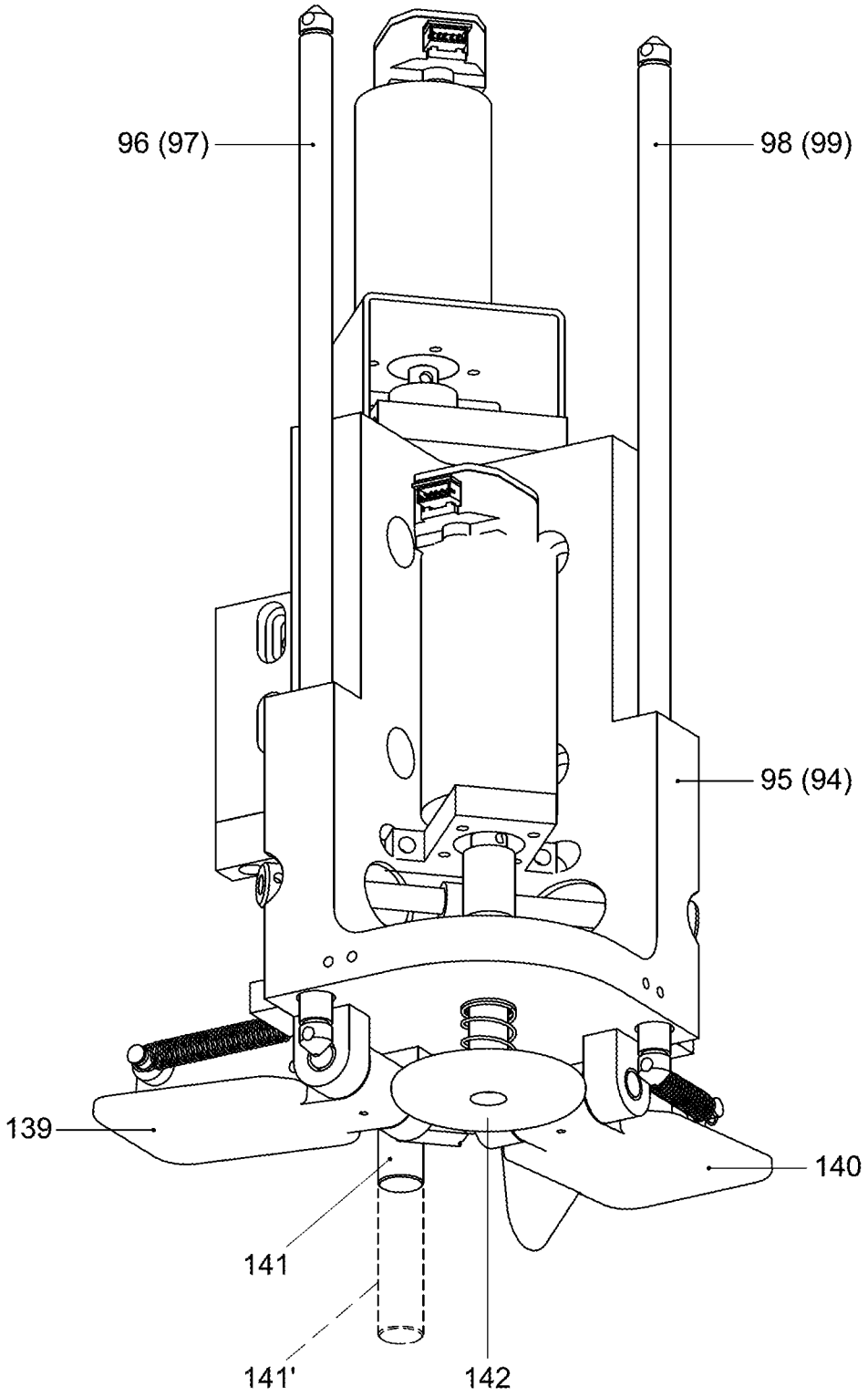
FIGS. 9A to 9D schematically show views in perspective of various stages of activation of a top folding unit provided with a pushing element 142, folding flaps and a corner flap initiator.
Figure 9B:
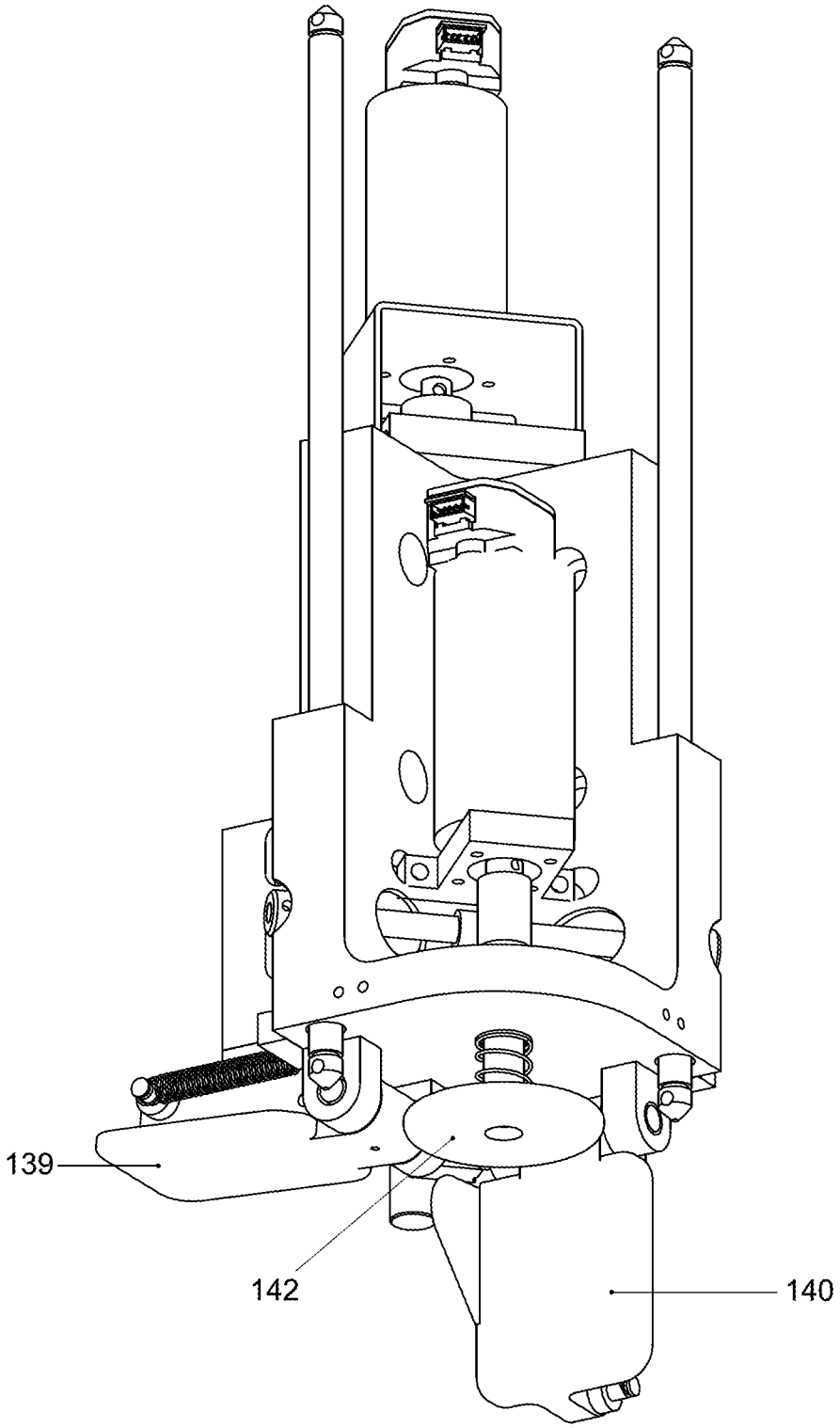
Figure 9C:
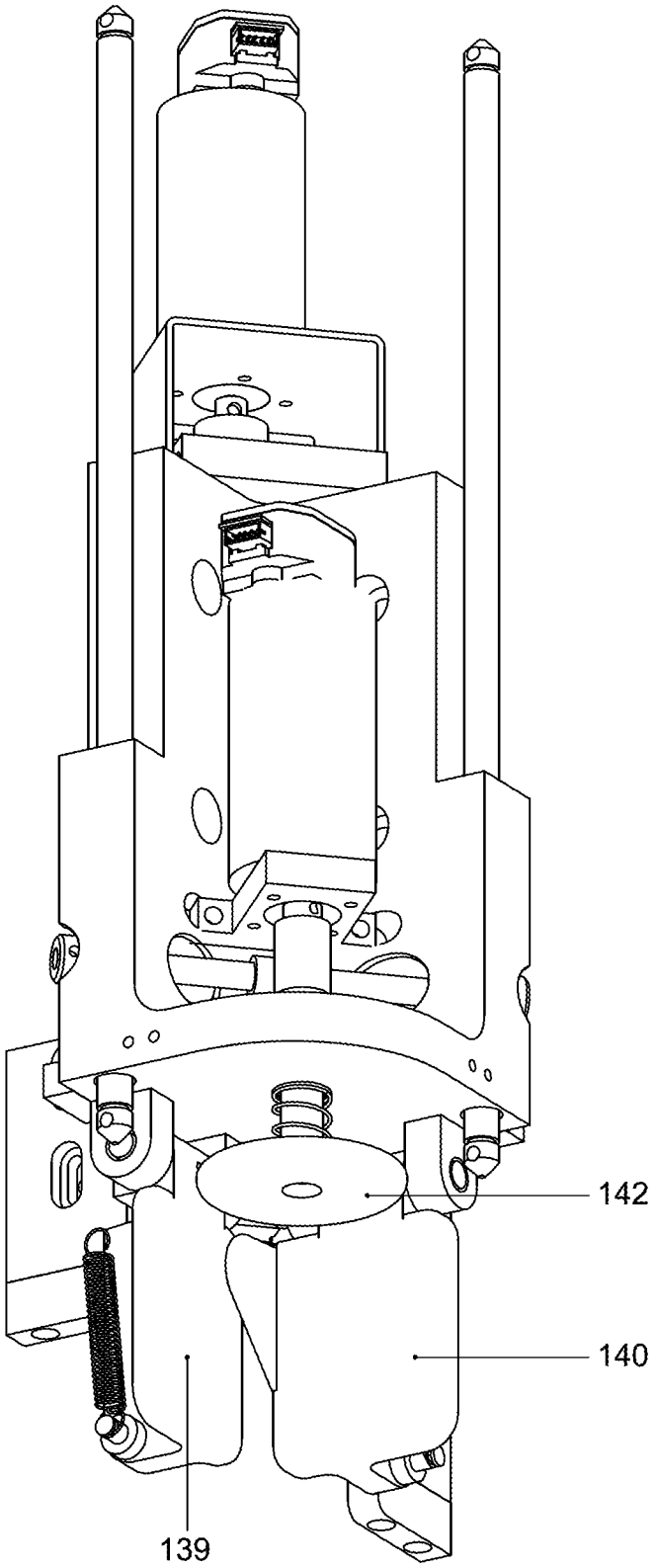
Figure 9D:
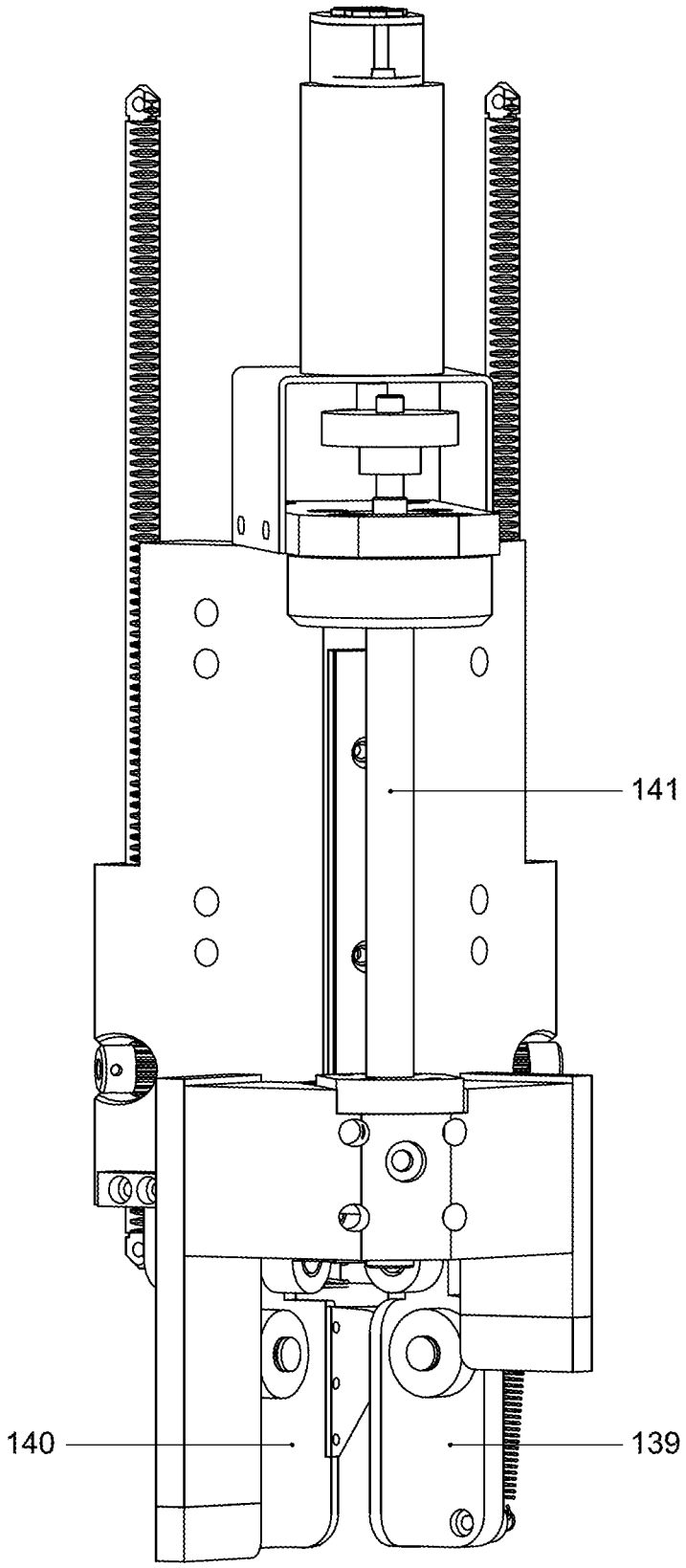

In FIG. 8 a view in perspective of the top panel folder 86 is shown to more clearly indicate the top panel guide 93. The top folding unit 95 is shown in more detail in FIG. 9, and it will be clear that the top folding unit 94 is formed analogously but with the side and end folding flaps interchanged. The pair of top folding units 94, 95 are suspended to be displaceable along a guide 136 with respect to one another under control of the control unit 2, 62 for adjusting a top transverse distance there between based on the data indicative for the measured width dimension by means of a motor 137 and can be lowered to come into contact with respective corners of the top panel 50 and raised out of contact therewith by means of a motor 138 under control of the control unit.

The top folding unit 95 is provided with a controllable end panel (53) folding flap 139 and a controllable side panel (52) folding flap 140 and a controllable initiator 141 for initiating the folding of a corner panel (54). In distinction from the folding units 80-83 the top folding units in this embodiment do not comprise gripping elements or suction cups but are provided with a controllable, vertically displaceable pushing element 142 for pushing down a respective corner of the top panel onto the upstanding side panels. However, in alternative embodiments the top folding units also comprise gripping elements. When the top folding units are in a correct position above the corners of the top panel the control unit 2, 62 activates the top folding unit 95 such that first the pushing element 142 is lowered for pushing and keeping the respective corner of the top panel 50 down. Thereafter the initiator is lowered into the position indicated by reference number 141' for initiating downward folding of the top corner panel 54. Then the side panel folding flap 140 is activated (FIG. 9B) and shortly thereafter the end panel folding flap 139 (FIG. 9C) to fold down the top side panel 52 and a top end panel 53 as indicated in FIGS. 2E, 2F. During activation of the folding flaps the top folding units can be moved a little distance towards each other to ensure correct folding.

As discussed above the top folding units 94, 95 are furthermore provided with controllable rods 96, 97 and 98, 99 which are activated, i.e., lowered, under control of the control unit 62 after the box is completely folded. The rods 98 and 99 engage the side surfaces of the box, whereas the rods 96, 97 engage the rear surface of the box. The rods 96-99 keep the box 67' in shape and prevent recoiling of the panels of the blank and can be used to transport the box.

Please note that the system can comprise further devices, preferably controlled by the control unit, such as for example: a device for supplying filling material, e.g., shredded paperboard, chips, filling bags or foam, into the box, for filling up possible empty spaces inside the box; an address printer for printing addresses directly onto the box or on an address sticker, which address sticker is adhered to the box by means of a sticker module; a scale for weighing the box including the items, a franking unit. In addition a wrapping unit may be present to wrap the box into for example gift paper. As an alternative to an applicator for applying tape to the box to seal it, it is possible to use a glue applicator which applies glue to appropriate panels for sealing the box. In addition sealing the box is in alternative embodiments performed by strapping, stapling or poly-wrapping.

The invention claimed is:

1. A method for automatically processing blanks for automatically forming packaging boxes from said blank for packaging at least one article in said packaging box, said method comprising:

by means of a feeding conveyor feeding blank material in a feeding direction from a storage of blank material to a blank forming apparatus for cutting and creasing blank material into a blank;

by means of a control unit controlling the operation of the blank forming apparatus;

by means of a measurement device measuring at least the dimensions of the least one article to be packaged, or by means of an automatic identification device determining at least the dimensions of the at least one article to be packaged through barcode scanning, RFID detection, image recognition and/or looking up the dimensions in databases, wherein the measurement device or the automatic identification device is communicatively coupled to the control unit and providing data indicative of the dimensions to the control unit, and by means of said blank forming apparatus, which is operatively connected to said control unit under control of the control unit, cutting and creasing blank material into a blank having:

a rectangular bottom panel having a center line substantially parallel to the feeding direction, rectangular side panels, including a first side panel and a second side panel, each joined to the rectangular bottom panel, rectangular end panels joined to the rectangular bottom panel, rectangular corner panels, including a first corner panel and a second corner panel, joined to the rectangular end panels, a rectangular top panel joined to one of the rectangular end panels, rectangular top side panels joined to the rectangular top panel, a rectangular top end panel joined to the rectangular top panel, rectangular top corner panels joined to the rectangular top end panel, score lines between the rectangular bottom panel and each of the rectangular side panels and the rectangular end panels, score lines between the rectangular corner panels and the rectangular end panels, score lines between the rectangular top panel and each of the rectangular top side panels and the rectangular top end panel, and score lines between the rectangular top corner panels and the rectangular top end panel, wherein the positions of the score lines are based on the dimensions of the at least one article to be packaged;

wherein cutting and creasing blank material into the blank is performed during feeding of said blank material in the feeding direction through the blank forming apparatus; wherein cutting and creasing blank material into a custom sized blank is performed by means of a cutting-out device of the blank forming apparatus comprising a pair of opposite cut-out knives cut-outs that are provided in line with the respective score lines between the corner panels and the adjoining side panels and provided between: 1) the first corner panel and the first adjoining side panel and 2) the second corner panel and the second adjoining side panel of the blank; and displacing the cutting-out device from an inactive position to an active position synchronously with feeding of the blank material in the feeding direction.

2. The method according to claim 1, wherein the method further comprises:

by means of a pair of longitudinal score line applicators applying longitudinal score lines as folding lines to the blank material between respective panels;

by means of a single transverse score line applicator applying transverse score lines as folding lines between respective panels;

by means of a single transverse cutter cutting the blank material to the length of the custom sized blank; and by means of a single longitudinal cutter or a pair of longitudinal cutters cutting the blank material to the width of the custom sized blank;

wherein the transverse distance between the pair of longitudinal score line applicators and the transverse distance between the longitudinal cutters are adjustable.

3. The method according to claim 2, wherein the method comprises moving the single transverse cutter along a line which is positioned at such an angle with respect to the feeding direction of the blank material that in combination with a feeding speed of the blank material a cutting line transverse to the feeding direction is formed in the blank material.

4. A method according to claim 2, wherein the method is used in the method for automatically forming a packaging box from said blank and packaging at least one article in said packaging box, wherein the method further comprises:

measuring the length, width and height dimensions of the at least one article; and adjusting the transverse distance between the pair of longitudinal score line applicators and the transverse distance between the longitudinal cutters based on the dimensions of the at least one article.

5. The method according to claim 1, wherein displacing the cutting-out device from an inactive position to an active position synchronously with feeding of the blank material in the feeding direction includes accelerating the cutting-out device in the first direction parallel with the feeding direction to match a transport speed of the blank material, and wherein the method further comprises: accelerating the cutting-out device in a direction that is transverse to the feeding direction of the blank material to cut the cut-outs from the blank material.

6. A system for automatically processing blanks for automatically forming packaging boxes from said blank for packaging at least one article in said packaging box, said system comprising:

a control unit for controlling the operation of the system;

a feeding conveyor operatively connected to said control unit for feeding blank material in a feeding direction from a storage of blank material;

a measurement device that measures at least the dimensions of at least one article to be packaged, or an automatic identification device that determines at least the dimensions of the at least one article to be packaged through barcode scanning, RFID detection, image recognition and/or looking up the dimensions in databases, wherein the measurement device respectively the automatic identification device is communicatively connected to the control unit for providing data indicative for the dimensions to the control unit, and a blank forming apparatus which is operatively connected to said control unit comprising a cutting-out device comprising a pair of opposite cut-out knives, said cut-out knives being suspended to be displaceable downwards for forming first and second cut-outs of a custom-sized blank having:

a rectangular bottom panel having a center line substantially parallel to the feeding direction, rectangular side panels, including a first side panel and a second side panel, joined to the rectangular bottom panel, rectangular end panels joined to the bottom panel, rectangular corner panels, including a first corner panel and a second corner panel, joined to the end panels, a rectangular top panel joined to one of the rectangular end panels, rectangular top corner side panels joined to the rectangular top panel, a rectangular top end panel joined to the rectangular top panel, rectangular top corner panels joined to the rectangular top end panel, score lines between the rectangular bottom panel and each of the rectangular side panels and the rectangular end panels, a first cut-out between the first corner panel and the adjoining first side panel, and a second cut-out between the second corner panel and the adjoining second side panel, wherein the first and second cut-outs are: 1) spaced apart from one another and 2) collinear along a line offset from the feeding direction, and wherein the cutting-out device is configured to displace the cut-out knives from an inactive position to an active position synchronously with a feeding speed of the blank material in the feeding direction;

wherein the control unit and the blank forming apparatus are configured for cutting and creasing the blank material into the custom-sized blank during feeding of said blank material in the feeding direction through the blank forming apparatus based on the dimensions of the at least one article to be packaged.

7. The system according to claim 6, wherein the cutting-out device comprises a lower transverse guide, and wherein the cut-out knives comprise an extension in engagement with the lower transverse guide.

8. The system according to claim 6, wherein the blank forming apparatus comprises a pair of longitudinal score line applicators, said longitudinal score line applicators being suspended to be displaceable downwards for applying longitudinal score lines as longitudinal folding lines to the blank material between respective panels, wherein the transverse distance between the longitudinal score line applicators is adjustable based on the data indicative of the width, and wherein each of the pair of longitudinal score applicators comprises a coupling for mechanically coupling to a respective cut-out knife, said coupling preferably being configured for allowing a relative vertical movement of a cut-out knife and a respective longitudinal score line applicator.

9. The system according to claim 6, wherein the angle of the cutting edge of a cut-out knife with a horizontal direction is approximately 15°.

10. The system according to claim 6, wherein the free end of a cut-out knife is provided with an indentation for forming a sharp cutting protrusion at the free end of the cut-out knife.

11. The system according to claim 6 incorporated in a system for automatically forming packaging boxes, said system comprising:

at least four folding units at a supporting station, wherein the at least four folding units comprise a front pair of folding units and a rear pair of folding units positioned at a longitudinal distance from the front pair of folding units, wherein the folding units of the front pair are positioned at a transverse distance from each other, and wherein the folding units of the rear pair are positioned at a transverse distance from each other;

the folding units being configured for supporting a blank formed by said blank forming apparatus;

wherein at least one of the at least four folding units is provided with a controllable gripping element for gripping the bottom panel, wherein the control unit is configured for activating said controllable gripping element into an operative mode for gripping the bottom panel and for deactivating said controllable gripping element for releasing the bottom panel; and wherein the at least one of the folding units is configured for folding respective side and/or end panels of the blank upwardly.

* * * * *